US008180271B2

(12) United States Patent
Hatakeyama et al.

(10) Patent No.: US 8,180,271 B2
(45) Date of Patent: May 15, 2012

(54) PROTECTIVE LAYER SETTING UNIT, PROCESS CARTRIDGE, AND IMAGE FORMING APPARATUS, AND METHOD OF EVALUATING PROTECTIVE LAYER SETTING UNIT

(75) Inventors: Kumiko Hatakeyama, Sagamihara (JP); Toshiyuki Kabata, Yokohama (JP); Tsutomu Hayashi, Susono (JP); Masahide Yamashita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 892 days.

(21) Appl. No.: 12/141,325

(22) Filed: Jun. 18, 2008

(65) Prior Publication Data

US 2009/0003853 A1 Jan. 1, 2009

(30) Foreign Application Priority Data

Jun. 27, 2007 (JP) ..... 2007-169188
Mar. 13, 2008 (JP) ..... 2008-064785

(51) Int. Cl.
*G03G 21/00* (2006.01)
*G03G 15/00* (2006.01)

(52) U.S. Cl. ..... 399/346; 399/34; 399/159

(58) Field of Classification Search ..... 399/25, 399/34, 159, 346
See application file for complete search history.

(56) References Cited

U.S. PATENT DOCUMENTS 4,967,238 A * 10/1990 Bares et al. ..... 399/34
7,177,570 B2 * 2/2007 Nagame et al. ..... 399/159
7,209,699 B2 * 4/2007 Yamaguchi et al. ..... 399/346
7,218,879 B2 5/2007 Enoki et al.
7,315,711 B2 1/2008 Ariizumi et al.
7,341,814 B2 * 3/2008 Kami et al. ..... 430/66
7,373,101 B2 * 5/2008 Hozumi et al. ..... 399/346
7,524,598 B2 * 4/2009 Iwanaga et al. ..... 430/66
7,542,713 B2 * 6/2009 Yoshida ..... 399/346
7,826,786 B2 * 11/2010 Suda et al. ..... 399/346

(Continued)

FOREIGN PATENT DOCUMENTS

JP 56101177 A * 8/1981

(Continued)

OTHER PUBLICATIONS

U.S. Appl. No. 12/168,336, filed Jul. 7, 2008, Hatakeyama, et al.

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A protective layer setting unit includes a protective agent, and an application unit for applying the protective agent on an image carrying member. An attenuated total reflection (ATR) method is used for detecting a surface condition of the image carrying member after applying the protective agent. A peak Pa at a given wavenumber, attributed to the image carrying member, has a peak area Sa in an infrared spectrum observed after applying the protective agent. A peak Pb at a given wavenumber, attributed to the protective agent, has a peak area Sb in the infrared spectrum observed after applying the protective agent. A peak area ratio of Sb/Sa is used for evaluating the protective layer setting unit. The protective layer setting unit is accepted when the Sb/Sa is set to a given range after applying the protective agent to the image carrying member for a given time period.

7 Claims, 19 Drawing Sheets

U.S. PATENT DOCUMENTS

| | | | | |
|---|---|---|---|---|
| 2005/0002705 | A1 * | 1/2005 | Shintani et al. | 399/346 |
| 2005/0084271 | A1 * | 4/2005 | Koike et al. | 399/12 |
| 2005/0169668 | A1 | 8/2005 | Koichi et al. | |
| 2007/0059626 | A1 * | 3/2007 | Inoue et al. | 430/108.8 |

FOREIGN PATENT DOCUMENTS

| | | | |
|---|---|---|---|
| JP | 05210338 | A * | 8/1993 |
| JP | 2597515 | | 5/1999 |
| JP | 2002-97483 | | 4/2002 |
| JP | 2004-198662 | | 7/2004 |
| JP | 2005-4051 | | 1/2005 |
| JP | 2005-17469 | | 1/2005 |
| JP | 2005-249901 | | 9/2005 |
| JP | 2005-274737 | | 10/2005 |
| JP | 2008096841 | A * | 4/2008 |

* cited by examiner

| | START AND END POINT OF BACKGROUND | | INTEGRATION AREA OF PEAK | |
|---|---|---|---|---|
| PEAK Pa1 (1770cm$^{-1}$) | 1801.3cm$^{-1}$ | 1751.1cm$^{-1}$ | 1785.8cm$^{-1}$ | 1764.6cm$^{-1}$ |
| PEAK Pa2 (3040cm$^{-1}$) | 3112.7cm$^{-1}$ | 3008.6cm$^{-1}$ | 3112.7cm$^{-1}$ | 3008.6cm$^{-1}$ |
| PEAK Pb1 (2850cm$^{-1}$) | 2867.8cm$^{-1}$ | 2821.5cm$^{-1}$ | 2856.2cm$^{-1}$ | 2842.7cm$^{-1}$ |
| PEAK Pb2 (2920cm$^{-1}$) | 2993.1cm$^{-1}$ | 2883.2cm$^{-1}$ | 2993.1cm$^{-1}$ | 2883.2cm$^{-1}$ |

FIG. 14

| EXAMPLE | PROTECTIVE AGENT BAR NO. | APPLICATION UNIT | | | |
|---|---|---|---|---|---|
| | | BRUSH | | | |
| | | BRUSH NO. | DIAMETER (μm) | NUMBER OF FIBERS | PRESSURE (N) |
| 1-1 | 11 | 2 | 33 | 50000 | 4.8 |
| 1-2 | 11 | 2 | 33 | 50000 | 4.8 |
| 1-3 | 11 | 3 | 39 | 50000 | 4.8 |
| 1-4 | 11 | 3 | 39 | 50000 | 4.8 |
| 1-5 | 11 | 2 | 33 | 50000 | 4.8 |
| 1-6 | 11 | 3 | 39 | 50000 | 4.8 |
| 1-7 | 11 | 2 | 33 | 50000 | 4.8 |
| 1-8 | 11 | 2 | 33 | 50000 | 4.8 |
| 1-9 | 11 | 3 | 39 | 50000 | 4.8 |
| 1-10 | 12 | 1 | 33 | 30000 | 2.0 |
| 1-11 | 11 | 3 | 39 | 50000 | 2.0 |
| 1-12 | 12 | 3 | 39 | 50000 | 4.8 |
| 1-13 | 11 | 2 | 33 | 50000 | 4.8 |
| 1-14 | 11 | 3 | 39 | 50000 | 4.8 |
| 1-15 | 12 | 1 | 33 | 30000 | 2.0 |
| 1-16 | 11 | 3 | 39 | 50000 | 2.0 |
| 1-17 | 12 | 3 | 39 | 50000 | 4.8 |
| 1-18 (BLACK) | 11 | 2 | 33 | 50000 | 4.8 |
| 1-18 (BLACK) | 11 | 2 | 33 | 50000 | 4.8 |
| 1-18 (CYAN) | 12 | 3 | 39 | 50000 | 4.8 |
| 1-18 (CYAN) | 12 | 3 | 39 | 50000 | 4.8 |

FIG. 15

| EXAMPLE | ATR CONDITION / ANALYSIS CONDITION / ANALYSIS RESULT | | | | | | | |
|---|---|---|---|---|---|---|---|---|
| | ATR CONDITION | | ANALYSIS CONDITION | | ANALYSIS RESULT (Sb/Sa) | | | JUDGMENT RESULT |
| | INCIDENT ANGLE (°) | ATR PRISM | PEAK FOR COMPUTING Sa ($cm^{-1}$) | PEAK FOR COMPUTING Sb ($cm^{-1}$) | INDEX FOR 10 MIN | INDEX FOR 360 MIN | ERROR FOR 360 MIN (%) | |
| 1-1 | 45 | Ge | 1770 | 2850 | 0.19 | 0.38 | 8 | - |
| 1-2 | 45 | Ge | 3040 | 2920 | 10.3 | 23.2 | 12 | - |
| 1-3 | 45 | Ge | 1770 | 2850 | 0.06 | 0.71 | 11 | - |
| 1-4 | 45 | Ge | 3040 | 2920 | 7.8 | 39.8 | 7 | - |
| 1-5 | 45 | DIAMOND | 1770 | 2850 | - | - | 35 | - |
| 1-6 | 85 | Ge | 1770 | 2850 | - | - | 32 | - |
| 1-7 | 30 | Ge | 1770 | 2850 | - | - | 25 | - |
| EVALUATION CRITERIA FOR 1-8 TO 1-12 | 45 | Ge | 1770 | 2850 | 0.03 OR MORE | 0.90 OR LESS | - | - |
| 1-8 | 45 | Ge | 1770 | 2850 | 0.17 | 0.36 | - | ○ |
| 1-9 | 45 | Ge | 1770 | 2850 | 0.06 | 0.82 | - | ○ |
| 1-10 | 45 | Ge | 1770 | 2850 | 0.02 | 0.23 | - | × |
| 1-11 | 45 | Ge | 1770 | 2850 | 0.02 | 0.43 | - | × |
| 1-12 | 45 | Ge | 1770 | 2850 | 0.12 | 1.1 | - | × |
| EVALUATION CRITERIA FOR 1-13 TO 1-17 | 45 | Ge | 3040 | 2920 | 6.5 OR MORE | 44.0 OR LESS | - | - |
| 1-13 | 45 | Ge | 3040 | 2920 | 12.1 | 22.8 | - | ○ |
| 1-14 | 45 | Ge | 3040 | 2920 | 8.0 | 43.3 | - | ○ |
| 1-15 | 45 | Ge | 3040 | 2920 | 6.0 | 18.7 | - | × |
| 1-16 | 45 | Ge | 3040 | 2920 | 5.8 | 27.6 | - | × |
| 1-17 | 45 | Ge | 3040 | 2920 | 10.3 | 73.2 | - | × |

FIG. 16

| EXAMPLE | EVALUATION OF IMAGE | | |
|---|---|---|---|
| | EVALUATION CONDITION | | RESULT |
| | PROCESS CARTRIDGE | NUMBER OF PRINTED SHEETS | JUDGMENT RESULT |
| 1-18 (BLACK) | BLACK | 5 | ○ |
| 1-18 (BLACK) | BLACK | 70000 | ○ |
| 1-18 (CYAN) | CYAN | 5 | ○ |
| 1-18 (CYAN) | CYAN | 70000 | × |

FIG. 17

| PROTECTION AGENT BAR | FT115 (WEIGHT PART) | TOPAS-TM (WEIGHT PART) | TRISORBITAN STEARATE (WEIGHT PART) | NORMAL PARAFFIN (WEIGHT PART) |
|---|---|---|---|---|
| NO.11 | 90 | 10 | -- | -- |
| NO.12 | 60 | -- | 25 | 15 |

FIG. 18

| | START AND END POINT OF BACKGROUND | | INTEGRATION AREA OF PEAK | |
|---|---|---|---|---|
| PEAK Pa1 (1770cm$^{-1}$) | 1801.3cm$^{-1}$ | 1751.1cm$^{-1}$ | 1785.8cm$^{-1}$ | 1764.6cm$^{-1}$ |
| PEAK Pb1 (2850cm$^{-1}$) | 2867.8cm$^{-1}$ | 2821.5cm$^{-1}$ | 2856.2cm$^{-1}$ | 2842.7cm$^{-1}$ |

FIG. 19

| EXAMPLE/ COMPARATIVE EXAMPLE | APPLICATION UNIT | | | | | |
|---|---|---|---|---|---|---|
| | APPLICATION UNIT NO. | PROTECTIVE AGENT BAR NO. | BRUSH | | | |
| | | | BRUSH NO. | DIAMETER (μm) | NUMBER OF FIBERS | PRESSURE (N) |
| EX. 2-1 | 21 | 21 | 2 | 33 | 50000 | 4.0 |
| EX. 2-2 | 22 | 21 | 3 | 39 | 50000 | 4.0 |
| COMP.EX. 2-1 | 23 | 21 | 1 | 33 | 30000 | 1.8 |
| COMP.EX. 2-2 | 24 | 22 | 3 | 39 | 50000 | 6.0 |
| COMP.EX. 2-3 | 25 | 22 | 3 | 39 | 50000 | 3.0 |

FIG. 20

| EXAMPLE/ COMPARATIVE EXAMPLE | ATR CONDITION / ANALYSIS CONDITION / ANALYSIS RESULT | | | | | |
|---|---|---|---|---|---|---|
| | ATR CONDITION | | ANALYSIS CONDITION | | ANALYSIS RESULT (Sb1/Sa1) | |
| | INCIDENT ANGLE (° ) | ATR PRISM | PEAK FOR COMPUTING Sa ($cm^{-1}$) | PEAK FOR COMPUTING Sb ($cm^{-1}$) | INDEX FOR 5 MIN. | INDEX FOR 150 MIN. |
| EX. 2-1 | 45 | Ge | 1770 | 2850 | 0.082 | 0.23 |
| EX. 2-2 | 45 | Ge | 1770 | 2850 | 0.044 | 0.45 |
| COMP.EX. 2-1 | 45 | Ge | 1770 | 2850 | 0.022 | 0.13 |
| COMP.EX. 2-2 | 45 | Ge | 1770 | 2850 | 0.14 | 0.88 |
| COMP.EX. 2-3 | 45 | Ge | 1770 | 2850 | 0.032 | 0.32 |

FIG. 21

| EXAMPLE/ COMPARATIVE EXAMPLE | EVALUATION OF IMAGE | | | | |
|---|---|---|---|---|---|
| | PROCESS CARTRIDGE | NUMBER OF PRINTED SHEETS | JUDGMENT RESULT | NUMBER OF PRINTED SHEETS | JUDGMENT RESULT |
| EX.2-1 | BLACK (1) | 5 | ○ | 60000 | ○ |
| EX.2-2 | BLACK (2) | 5 | ○ | 60000 | ○ |
| COMP.EX. 2-1 | CYAN (1) | 5 | ○ | 60000 | × |
| COMP.EX. 2-2 | MAGENTA (1) | 5 | ○ | 60000 | × |
| COMP.EX. 2-3 | CYAN (2) | 5 | ○ | 60000 | × |

FIG. 22

| PROTECTION AGENT BAR | FT115 (WEIGHT PART) | TOPAS-TM (WEIGHT PART) | TRISORBITAN STEARATE (WEIGHT PART) | NORMAL PARAFFIN (WEIGHT PART) |
|---|---|---|---|---|
| NO.21 | 85 | 10 | 5 | – |
| NO.22 | 55 | – | 20 | 25 |

FIG. 23

| | START AND END POINT OF BACKGROUND | | INTEGRATION AREA OF PEAK | |
|---|---|---|---|---|
| PEAK Pa2 (3040cm$^{-1}$) | 3112.7cm$^{-1}$ | 3008.6cm$^{-1}$ | 3112.7cm$^{-1}$ | 3008.6cm$^{-1}$ |
| PEAK Pb2 (2920cm$^{-1}$) | 2993.1cm$^{-1}$ | 2883.2cm$^{-1}$ | 2993.1cm$^{-1}$ | 2883.2cm$^{-1}$ |

FIG. 24

| EXAMPLE/ COMPARATIVE EXAMPLE | APPLICATION UNIT | | | | | |
|---|---|---|---|---|---|---|
| | APPLICATION UNIT NO. | PROTECTIVE AGENT BAR NO. | BRUSH | | | |
| | | | BRUSH NO. | DIAMETER (μm) | NUMBER OF FIBERS | PRESSURE (N) |
| EX. 3-1 | 31 | 31 | 2 | 33 | 50000 | 4.8 |
| EX. 3-2 | 32 | 31 | 3 | 39 | 50000 | 4.8 |
| COMP.EX. 3-1 | 33 | 31 | 1 | 33 | 30000 | 2.0 |
| COMP.EX. 3-2 | 34 | 32 | 3 | 39 | 50000 | 6.0 |
| COMP.EX. 3-3 | 35 | 32 | 3 | 39 | 50000 | 3.0 |

FIG. 25

| EXAMPLE/ COMPARATIVE EXAMPLE | ATR CONDITION / ANALYSIS CONDITION / ANALYSIS RESULT | | | | | |
|---|---|---|---|---|---|---|
| | ATR CONDITION | | ANALYSIS CONDITION | | ANALYSIS RESULT (Sb2/Sa2) | |
| | INCIDENT ANGLE (°) | ATR PRISM | PEAK FOR COMPUTING Sa ($cm^{-1}$) | PEAK FOR COMPUTING Sb ($cm^{-1}$) | INDEX FOR 15 MIN. | INDEX FOR 120 MIN. |
| EX. 3-1 | 45 | Ge | 3040 | 2920 | 9.8 | 13.5 |
| EX. 3-2 | 45 | Ge | 3040 | 2920 | 8.0 | 18.6 |
| COMP.EX. 3-1 | 45 | Ge | 3040 | 2920 | 6.3 | 8.1 |
| COMP.EX. 3-2 | 45 | Ge | 3040 | 2920 | 13.2 | 38.9 |
| COMP.EX. 3-3 | 45 | Ge | 3040 | 2920 | 9.4 | 25.5 |

FIG. 26

| EXAMPLE/ COMPARATIVE EXAMPLE | EVALUATION OF IMAGE | | | | |
|---|---|---|---|---|---|
| | PROCESS CARTRIDGE | NUMBER OF PRINTED SHEETS | JUDGMENT RESULT | NUMBER OF PRINTED SHEETS | JUDGMENT RESULT |
| EX. 3-1 | BLACK (1) | 5 | ○ | 50000 | ○ |
| EX. 3-2 | BLACK (2) | 5 | ○ | 50000 | ○ |
| COMP.EX. 3-1 | CYAN (1) | 5 | ○ | 50000 | × |
| COMP.EX. 3-2 | MAGENTA (1) | 5 | ○ | 50000 | × |
| COMP.EX. 3-3 | CYAN (2) | 5 | ○ | 50000 | × |

FIG. 27

| PROTECTION AGENT BAR | FT115 (WEIGHT PART) | TOPAS-TM (WEIGHT PART) | TRISORBITAN STEARATE (WEIGHT PART) | NORMAL PARAFFIN (WEIGHT PART) |
|---|---|---|---|---|
| NO.31 | 90 | 5 | 5 | – |
| NO.32 | 56 | – | 25 | 20 |

PROTECTIVE LAYER SETTING UNIT, PROCESS CARTRIDGE, AND IMAGE FORMING APPARATUS, AND METHOD OF EVALUATING PROTECTIVE LAYER SETTING UNIT

CROSS-REFERENCE TO RELATED APPLICATIONS

This application claims priority from Japanese Patent Application Nos. 2007-169188, filed on Jun. 27, 2007, and 2008-064785, filed on Mar. 13, 2008 in the Japan Patent Office, the entire contents of each of which are hereby incorporated by reference herein.

BACKGROUND OF THE INVENTION

1. Field of the Invention

The present disclosure generally relates to a protective layer setting unit for applying a protective agent to an image carrying member used in an image forming apparatus employing electrophotography and a process cartridge having the protective layer setting unit, and more particularly, to a method of evaluating a surface condition of a image carrying member coated with a protective agent not including a metal component.

2. Description of the Background Art

Typically, an image forming apparatus using electrophotography produces an image by sequentially conducting a series of processes, such as a charging process, an exposure process, a developing process, and a transfer process to a photoconductor such as an OPC (organic photoconductor). After conducting the transfer process, by-products generated by discharging during the charging process or toner particles remaining on the photoconductor are removed by a cleaning process. Such cleaning process can be conducted by using a cleaning blade, such as a rubber blade, which has a relatively simple and inexpensive structure but which cleans well.

However, such cleaning blade has a short lifetime and itself reduces the useful life of the photoconductor because the cleaning blade is pressed against the photoconductor to remove residual materials remaining on the photoconductor. More specifically, frictional pressure between the cleaning blade and the photoconductor abrades the rubber blade and a surface layer of a photoconductor.

Further, small-sized toner particles, used for coping with demand for higher quality images, may not be effectively trapped by such a cleaning blade, referred to as "passing of toner" or "toner passing." Such toner passing is more likely to occur by insufficient dimensional or assembly precision of the cleaning blade or when the cleaning blade vibrates unfavorably due to an external shock or the like. If such toner passing occurs, desired higher quality images may not be produced.

Accordingly, to extend the lifetime of the photoconductor and to produce higher quality images over time, frictional pressure on the photoconductor or cleaning blade needs to be reduced and cleaning performance of the photoconductor needs to be enhanced, by which degradation of the photoconductor or cleaning blade can be reduced and the aforementioned "toner passing" can be reduced.

Given the need for such frictional pressure reduction and cleaning performance enhancement, in general, a lubricant is applied to the photoconductor to form a lubricant layer on the photoconductor using the cleaning blade. Such lubricant layer can protect the surface of the photoconductor from an effect of frictional pressure caused by the cleaning blade pressing against the photoconductor, which abrades the photoconductor, or from a discharge energy effect during a charging process, which degrades the photoconductor. Further, the photoconductor having such lubricant layer can enhance lubricating performance of the photoconductor surface, by which an unfavorable vibration of cleaning blade can be reduced, and thereby toner passing amount can be reduced.

Such lubricating and protection performance of the lubricant is affected by an amount of lubricant applied on the photoconductor, requiring that an application amount of lubricant be carefully controlled. If the application amount of lubricant is too small, the aforementioned photoconductor abrasion by frictional pressure, photoconductor degradation by charging process, and toner passing may not be effectively reduced. Accordingly, the state of the lubricant application on the photoconductor, such as application amount, needs to be measured.

In general, a metallic soap such as zinc stearate is used as the lubricant. However, zinc stearate may adhere to a charge roller of an image forming apparatus and cause unfavorable charging, which may result in a lower quality image, for example an image containing black streaks. When zinc stearate is used as the lubricant, a lubricant amount of zinc stearate applied to a photoconductor is analyzed using XPS (X-ray photoelectron spectroscopy), in which the amount of zinc element as a percentage of all elements on the surface of the photoconductor is measured.

In XPS analysis, elements other than hydrogen existing in a top and a sub-surface of a sample can be detected. When an OPC (organic photoconductor) coated with zinc stearate is analyzed using XPS, an element amount profile detected by XPS varies depending on a coating amount or coating ratio of zinc stearate. For example, when no zinc stearate is applied to the OPC, the element amount profile shows an element distribution of the OPC itself, whereas when zinc stearate is applied to the OPC, the element amount profile shows a mixture of the element distribution of the OPC and the element distribution of the zinc stearate. If the zinc stearate is applied to the entire surface of the OPC (i.e., OPC is 100% coated with zinc stearate), the element amount profile only shows the element distribution of the zinc stearate, and therefore an upper limit of zinc amount or ratio on the OPC becomes a zinc amount or ratio of the zinc stearate itself. Accordingly, when zinc stearate, which has a chemical composition of $C_{36}H_{70}O_4Zn$, coats the entire surface of the photoconductor, theoretically the ratio of zinc to all elements should be 2.44%, which is the ratio of zinc to all the elements in zinc stearate ($C_{36}H_{70}O_4Zn$) excluding hydrogen.

However, XPS or X-ray fluorescence (XRF) analysis is preferably used for detecting metal components. Therefore, when a protective agent such as paraffin, which does not contain metal, is applied to the OPC, XPS analysis shows only peak values for carbon (C) and oxygen (O), meaning that the amount of protective agent applied to the photoconductor may not be effectively measured. Inductively coupled plasma (ICP) spectroscopic analysis, which can be similarly used to evaluate the amount of protective agent applied to the photoconductor by detecting the metal component in the protective agent, also suffers from the same drawback and cannot be used to effectively measure the amount of a protective agent such as paraffin that does not contain metal.

Further, an attenuated total reflection (ATR) method is known for analyzing organic materials. In the ATR method, infrared absorption spectrum is measured using total reflection. Specifically, an ATR prism having a higher refractive index is closely contacted against a sample, an infrared (IR) light is irradiated to the sample via the ATR prism, and then an outgoing light from the ATR prism is analyzed spectrometrically. The infrared light can be totally reflected at a contact face of the ATR prism and the sample (i.e., total reflection) when the infrared light is irradiated to the ATR prism with a given angle or more, wherein such given angle is determined based on a relationship of the refractive index of the ATR prism and the sample. During such IR light irradiation, the IR light reflects from an internal surface of the ATR prism and generates an evanescent wave which projects orthogonally into the sample. Some of the energy of the evanescent wave is absorbed by the sample and the reflected IR light is attenuated and received by a detector, by which absorption spectrum of the sample can be obtained.

The ATR method is useful because it can accommodate various samples because an absorption spectrum of the sample can be measured by contacting a portion of the sample against the ATR prism. For example, absorption spectrum of a thick sample or low-transmittance sample can be measured if such sample can be closely contacted to the ATR prism. Moreover, in the ATR method, a functional group in the sample can be determined based on wavenumber corresponding to absorbed infrared light, and therefore the ATR method is widely used for qualitative analysis. However, because a peak intensity of absorption spectrum varies due to the pressure with which the sample is pressed against the ATR prism, and therefore the ATR method may not be used so often for quantitative analysis.

Recently, a charging process for electrophotography has been employing AC charging using a charge roller, in which an alternating current voltage is superimposed on the direct current voltage. Such AC charging has many advantages, in that it can charge a photoconductor more uniformly, can reduce generation of oxidizing gas, such as ozone and nitrogen oxide (NOx), and can contribute a size reduction of an image forming apparatus, for example.

However, a photoconductor may be acceleratingly degraded because a discharge of positive and negative voltages repeatedly occurs with a frequency of the applied alternating current voltage, such as several hundred to several thousand times per second between a charging device and the photoconductor. Such degradation of the photoconductor can be reduced by applying a lubricant, such as metallic soap, on the photoconductor because such lubricant can absorb discharge energy of the AC charging so as to prevent the discharge energy effect to the photoconductor.

Such lubricant (e.g., metallic soap) itself also may be decomposed by the AC charging. More precisely, the metallic soap is not decomposed completely but to a lower molecular weight fatty acid, and a friction pressure between the photoconductor and a cleaning blade increase as the lubricant is decomposed. Such fatty acid and toner may adhere to the photoconductor as a film which degrades image resolution, abrades the photoconductor, and causes uneven image concentration.

In light of such phenomenon, a greater amount of metallic soap may be applied on the photoconductor so as to effectively coat a surface of the photoconductor with metallic soap even if some fatty acid may be generated. However, in actuality only some of the metallic soap may actually adhere to the photoconductor even if the photoconductor is supplied with a greater amount of metallic soap, and most of the metallic soap applied on the photoconductor may be transferred with toner, or removed with waste toner, for example. Accordingly, the metallic soap may be consumed rapidly, and the metallic soap may need to be replaced with new metallic soap in a time period, which may be shorter than a lifetime of the photoconductor.

In view of such drawback, instead of using metallic soap, higher alcohol having a greater carbon number, such as from 20 to 70, is used as a main component of a lubricant (or protective agent) in one related art. When such lubricant is applied to a photoconductor, higher alcohol accumulates on a leading edge of a cleaning blade as indefinite-shaped particles, and such lubricant has surface wet-ability with the surface of photoconductor, by which such lubricant can be used for a long period of time.

However, if higher alcohol is used as lubricant, one molecule of higher alcohol may coat a relatively larger area on the photoconductor, and thereby density of higher alcohol molecules absorbed on the photoconductor per unit area may become smaller (i.e., smaller molecular weight per unit area), which is not preferable from a viewpoint of reducing the electrical stress of the AC charging to the photoconductor.

Another related art proposes using powder of an alkylene bis-alkyl acid amide compound as a lubrication component to supply powder to a surface boundary between a photoconductor (or image carrying member) and a cleaning blade, contacting the photoconductor, so as to provide smooth lubrication effect on the surface of the photoconductor for a long period. However, if the lubricant having nitrogen atom is used, the lubricant itself may generate decomposition products having ion-dissociative property, such as nitrogen oxide and a compound having ammonium when the lubricant is subjected to the electrical stress of AC charging. Such products then intrude into a lubrication layer, reducing resistance of the lubrication layer under a high-humidity condition and possibly causing grainy images as a result.

It is known that a protective agent having paraffin as a main component can protect a photoconductor from the electrical stress of AC charging, can reduce a frictional pressure between the photoconductor and a cleaning blade, and can remove toner remaining on the photoconductor well, for example. Further, the protective agent having paraffin may not generate so much fatty acid even if the protective agent is oxidized by the electrical stress of AC charging, which is preferable for reducing a variation of the frictional pressure between the photoconductor and the cleaning blade.

However, when image forming operations are repeated by using the protective agent having paraffin, abnormal images, such as streak image, are produced in some cases, wherein such abnormal images may be caused by abrasion of the photoconductor and the cleaning blade. Based on research, probability of such abnormal images varies among product lots of protective layer setting units. Research was further conducted for photoconductors, which produced and did not produce abnormal images, to find that the abnormal images occurred on an area where a layer thickness of the photoconductor was relatively thinner or an area where toner was attracted with a greater amount on the photoconductor. However, root causes of such abnormal images are known yet.

As mentioned, paraffin can be effectively used as a protective agent instead of metallic soap. However, when a protective agent, such as paraffin, not containing metal component is applied to the OPC, XPS or XRF analysis show only peak values for carbon (C) and oxygen (O), and therefore the amount of protective agent applied to the photoconductor may not be effectively evaluated. Further, ICP spectroscopic analysis may not be suitable for effectively evaluating the amount of protective agent, not containing metal component, applied to the photoconductor because the ICP spectroscopic analysis is also used for detecting a protective agent (e.g., metallic soap) having metal component. If the amount of protective agent on a photoconductor cannot be effectively evaluated, a photoconductor having an insufficient amount of protective agent may be assembled in a process cartridge or an image forming apparatus, and such photoconductor can cause image quality degradation.

As such, a conventional analysis method may not be suitable for detecting an amount of a protective agent, such as paraffin, not including a metal component, and therefore a method of effectively evaluating a surface condition of a photoconductor coated with a protective agent not including a metal component is desired.

SUMMARY

In an aspect of the present disclosure, a protective layer setting unit for forming a protective layer on an image carrying member includes a protective agent, and an application unit for applying the protective agent on the image carrying member. The protective layer setting unit employs an attenuated total reflection (ATR) infrared absorption spectrum method to detect a surface condition of the image carrying member.

In another aspect of the present disclosure, a method of evaluating a protective layer setting is devised to detect a surface condition of an image carrying member using an attenuated total reflection (ATR) prism of germanium (Ge) and an incident angle of infrared light of 45° as a measurement condition. An absorbance spectrum obtained by an ATR method is referred to as infrared (IR) spectrum. The method includes: observing an IR spectrum A as an IR spectrum of a surface of the image carrying member before applying a protective agent, observing an IR spectrum B as an IR spectrum of the protective agent alone; observing an IR spectrum C as an IR spectrum of the surface of the image carrying member after applying the protective agent, in which a peak Pa at a given wavenumber in the IR spectrum A is not substantially observed in the IR spectrum B, and the peak Pa has a peak area Sa in the IR spectrum C, whereas a peak Pb at a given wavenumber in the IR spectrum B is not substantially observed in the IR spectrum A, and the peak Pb has a peak area Sb in the IR spectrum C; and using a peak area ratio of Sb/Sa. The peak area ratio of Sb/Sa, detected in the IR spectrum C, is used to evaluate an application amount of the protective agent to the image carrying member, which is set by the protective layer setting unit. The protective layer setting unit is accepted when the Sb/Sa is set to a first value or more after applying the protective agent to the image carrying member for a first time period, and when the Sb/Sa is set to a second value or less after applying the protective agent to the image carrying member for a second time period. The first time period is shorter than the second time period, and the first value is smaller than the second value.

In another aspect of the present disclosure, a method of evaluating a protective layer setting unit used for applying a protective agent on a surface of an image carrying member using an attenuated total reflection (ATR) infrared (IR) absorption spectrum method is devised to analyze a condition of the surface of the image carrying member. An absorbance spectrum obtained by the ATR method is referred to as infrared (IR) spectrum. An IR spectrum A is observed as an IR spectrum of the surface of the image carrying member before applying the protective agent, an IR spectrum B is observed as an IR spectrum of the protective agent alone, and an IR spectrum C is observed as an IR spectrum of the surface of the image carrying member after applying the protective agent. A peak Pa in the IR spectrum A is not substantially observed in the IR spectrum B, and the peak Pa has a peak area Sa in the IR spectrum C detected by the ATR method. A peak Pb in the IR spectrum B is not substantially observed in the IR spectrum A, and the peak Pb has a peak area Sb in the IR spectrum C detected by the ATR method. The method includes 1) identifying and computing the peak area Sa of the peak Pa in the IR spectrum C; 2) identifying and computing the peak area Sb of the peak Pb in the IR spectrum C; and 3) computing a ratio of "Sb/Sa" as an index for evaluating an application amount of the protective agent to the image carrying member.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIGS. 14 to 17 show conditions for protective agent bars, protective layer setting units, ATR analysis, and results of ATR analysis and image evaluation for Example;

FIG. 18 shows conditions of peak used for computing a peak area for each of peaks, in which start and end point of background for computing a peak area, and integration area of peak are included with wavenumber information;

FIGS. 19 to 22 show conditions for protective agent bars, protective layer setting units, ATR analysis, and results of ATR analysis and image evaluation for Example and Comparative Example;

FIG. 23 shows conditions of peak used for computing a peak area for each of peaks, in which start and end point of background for computing a peak area, and integration area of peak are included with wavenumber information; and FIGS. 24 to 27 show conditions for protective agent bars, protective layer setting units, ATR analysis, and results of ATR analysis and image evaluation for Example and Comparative Example.

Figure 1:
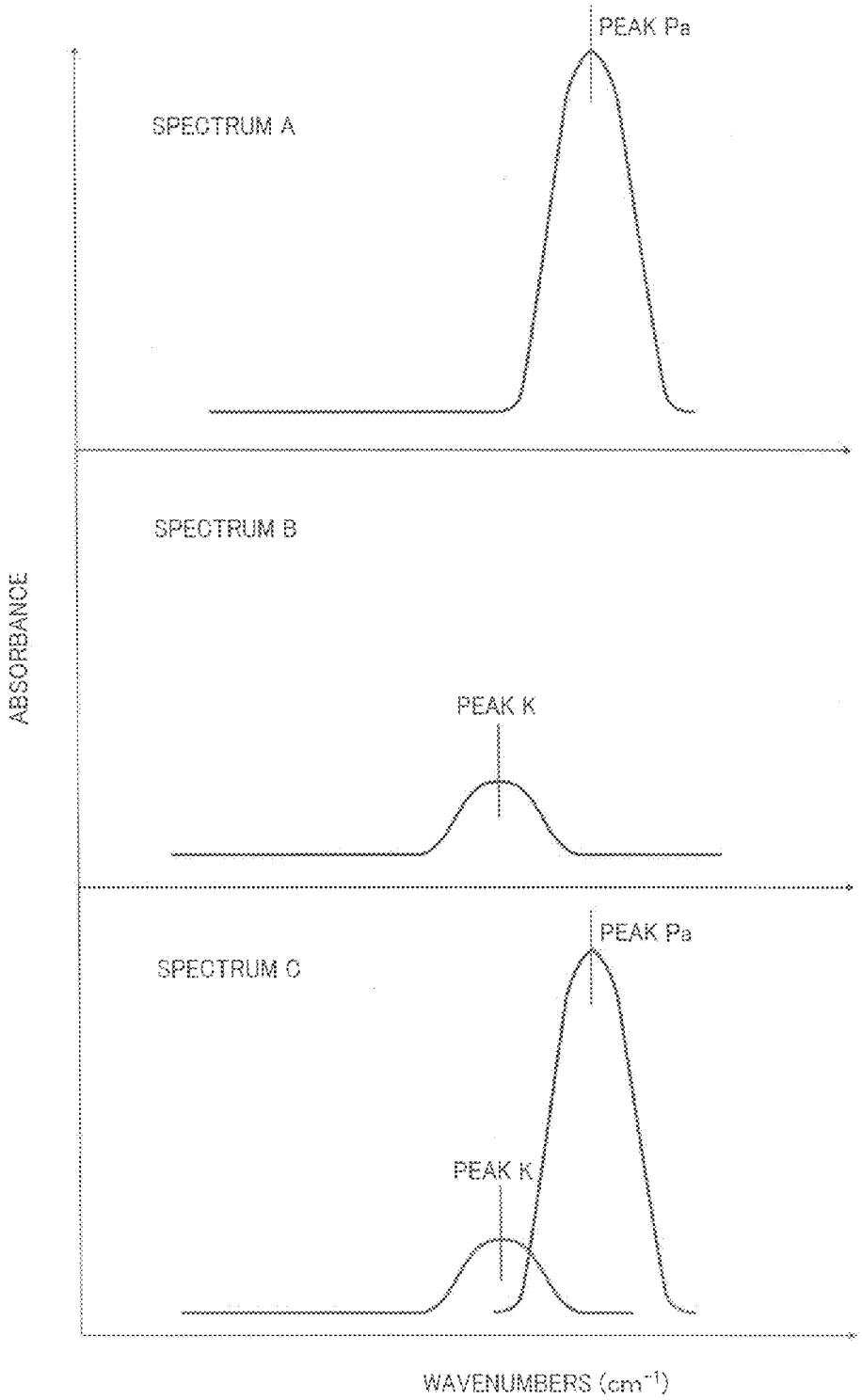
FIG. 1 shows one pattern of IR spectrum A to C used for detection.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXEMPLARY EMBODIMENTS

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

A description is now given to a method of evaluating a protective layer setting unit according to an exemplary embodiment. In an exemplary embodiment, an attenuated total reflection method (hereinafter, referred as ATR method or ATR) is used to evaluate a protective agent not including a metal component, such as paraffin, applied to a photoconductor. In the ATR method, a projection depth of infrared (IR) light into a sample becomes different depending on measurement conditions, such as ATR prism, incident angle, by which results of measured spectrum of a same sample may become different depending on such measurement conditions. For example, one spectrum result shows only a peak attributed to a photoconductor, another spectrum result shows only a peak attributed to a protective agent, or another spectrum result shows a mixture of a peak attributed to a photoconductor and a peak attributed to a protective agent.

In an exemplary embodiment, measurement condition which can detect both of a peak attributed to a photoconductor and a peak attributed to a protective agent is determined based on researches on measurement conditions, in which a plurality of conditions were examined for ATR prism, incident angle, or the like. Under such measurement condition, an infrared (IR) spectrum profile for a photoconductor is measured to evaluate an application amount of the protective agent applied on the photoconductor.

In the ATR method, a spectrum profile of a sample may vary for each of measurements because a measurement portion of a sample deforms by a pressure for holding the sample, wherein such pressure may vary for each of the measurements although such pressure may be controlled within a given range. Accordingly, a peak intensity of target component, which is used for detecting a surface condition of the sample, may vary for each of measurements. Accordingly, peak intensity of spectrum alone may not be used for effectively detecting a surface condition of the sample.

In view of such peak intensity variation of one sample, a substantially consistent condition may be set when setting a sample on a measurement device so as to obtain infrared (IR) spectrum profile under a constant condition. Specifically, a gap between a fixing jig for holding the sample and the ATR prism is maintained at a substantially consistent level, or a pressure for holding the sample is maintained at a substantially consistent level. Under such condition, a measurement of infrared (IR) spectrum profile is conducted for a photoconductor applied with the protective agent, and each peak in the IR spectrum profile is evaluated and attributed to a specific material, functional group, or the like while changing an application time of the protective agent for each of sample photoconductors. In an exemplary embodiment, a peak area ratio between a peak area attributed to a photoconductor and a peak area attributed to a protective agent is computed, in which the peak area ratio becomes greater as an application time of the protective agent increases.

In an exemplary embodiment, an application amount of the protective agent applied to a surface of a photoconductor is evaluated as follows. In this disclosure, a protective layer setting unit is used to apply the protective agent to the surface of photoconductor (in this disclosure, surface of photoconductor may be referred as photoconductor surface).

Specifically, an IR spectrum A of the photoconductor surface before applying the protective agent and an IR spectrum B of the protective agent alone are measured by the ATR method using infrared absorption spectrum. The IR spectrum A has at least one absorption peak that is not substantially included in the IR spectrum B, and the IR spectrum B has at least one absorption peak that is not substantially included in the IR spectrum A, for example, wherein the number of such absorption peak may be one or more. After applying the protective agent using the protective layer setting unit, an IR spectrum C of the photoconductor is observed. Specifically, the IR spectrum A has a given specific peak that is not substantially included in the IR spectrum B, which is termed as a peak Pa and such peak Pa has a peak area Sa in this disclosure. The IR spectrum B has a given specific peak that is not substantially included in the IR spectrum A, which is termed as a peak Pb and such peak Pb has a peak area Sb in this disclosure. The application amount of the protective agent on the photoconductor is evaluated using a peak area ratio "Sb/Sa" for such peaks Pa and Pb, which is observed in the IR spectrum C, obtained after applying the protective agent on the photoconductor.

Figure 2:
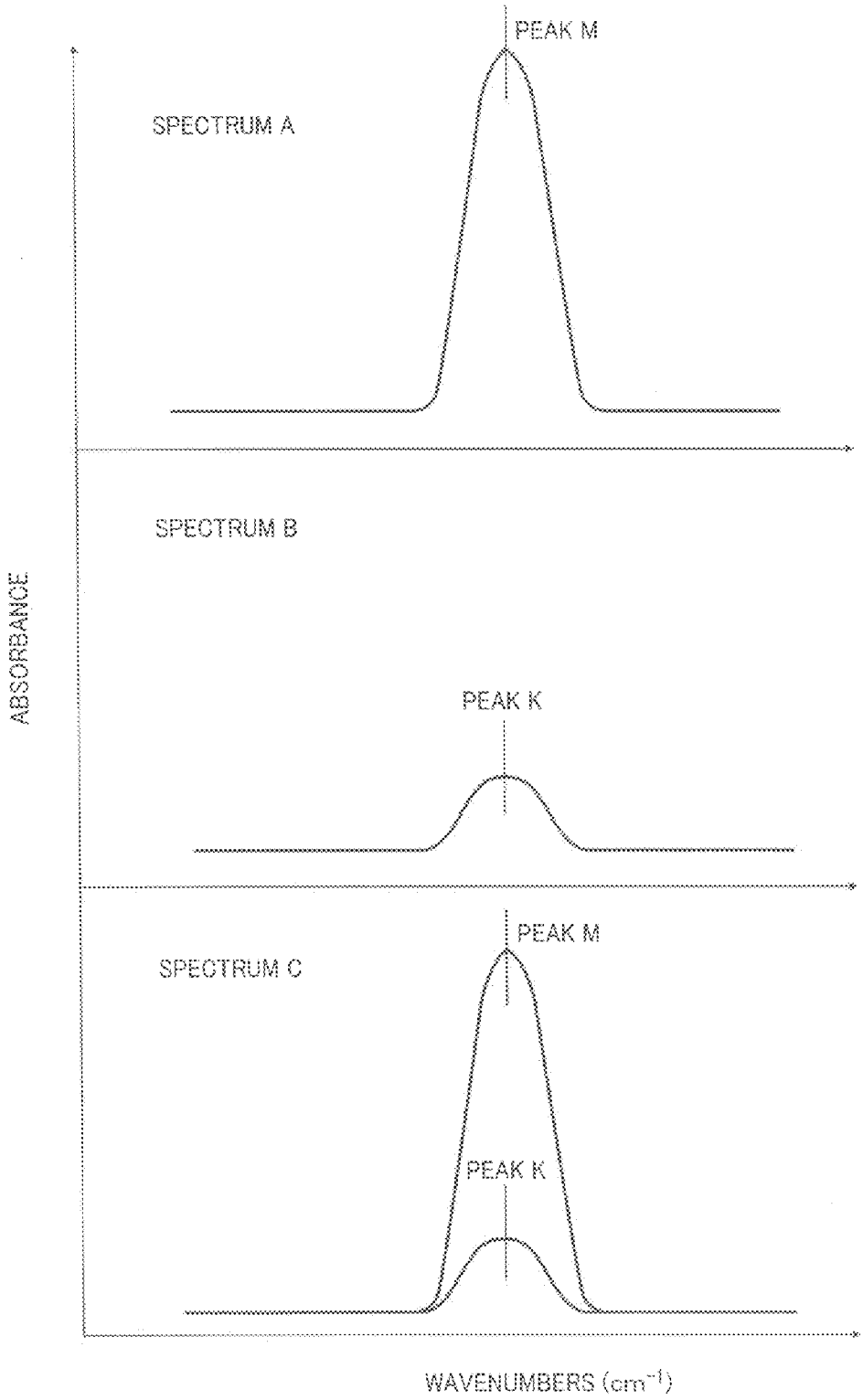
FIG. 2 shows one pattern of IR spectrum peaks, which is not preferable for detection.
Figure 3:
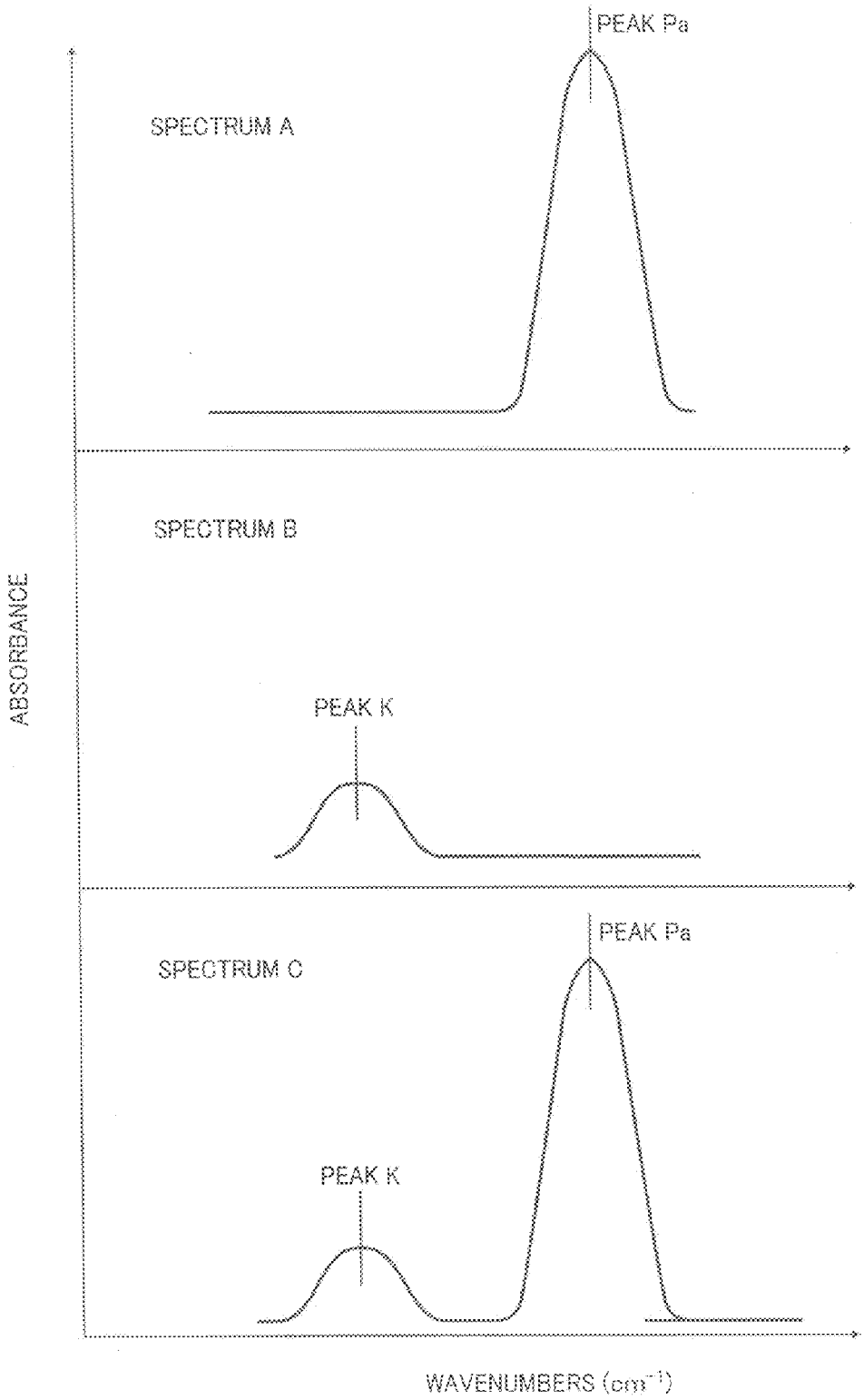
FIG. 3 shows another one pattern of IR spectrum A to C used for detection.

A description is given to a relative position of peaks in the IR spectrum A, the IR spectrum B, and the IR spectrum C with reference to FIGS. 1 to 3. As aforementioned, the IR spectrum C is a spectrum after applying the protective agent on the photoconductor, and thereby the IR spectrum C includes peaks attributed to both of the IR spectrum A and B.

In FIG. 1, the peak Pa of the IR spectrum A has a wavenumber, which is not substantially detected in the IR spectrum B. In other words, a peak is not substantially detected in the IR spectrum B at the wavenumber that the peak Pa is detected in the IR spectrum A. If a peak is detected in both of the IR spectrum A and B at a same wavenumber as shown in FIG. 2, such peak (peak M in FIG. 2) is not preferably used for computing the peak area ratio "Sb/Sa." Preferably, as shown in FIG. 3, the peak Pa in the IR spectrum A and a given specific peak (peak K) in the IR spectrum B have no overlapping area. In other words, it is preferable that the peak Pa and the peak K do not overlap each other at peak top or tail of each peak.

If the peak Pa and the peak K overlap each other at peak top or tail of each peak as shown in FIG. 1, a differential spectrum of the IR spectrum C and the IR spectrum B needs to be computed, in which a peak area of the peak K is subtracted from the IR spectrum C to obtain a correct value of the peak Pa, by which the peak area ratio "Sb/Sa" can be computed effectively by eliminating an effect of the peak K of the IR spectrum B.

However, such subtraction step can be omitted if the peak Pa has a too great area compared to the peak K even if the peak Pa and the peak K overlap each other at peak top or tail of each peak. If such subtraction step can be omitted, a computation of the peak area ratio "Sb/Sa" can be simplified and a computation can be conducted more precisely.

Figure 4:
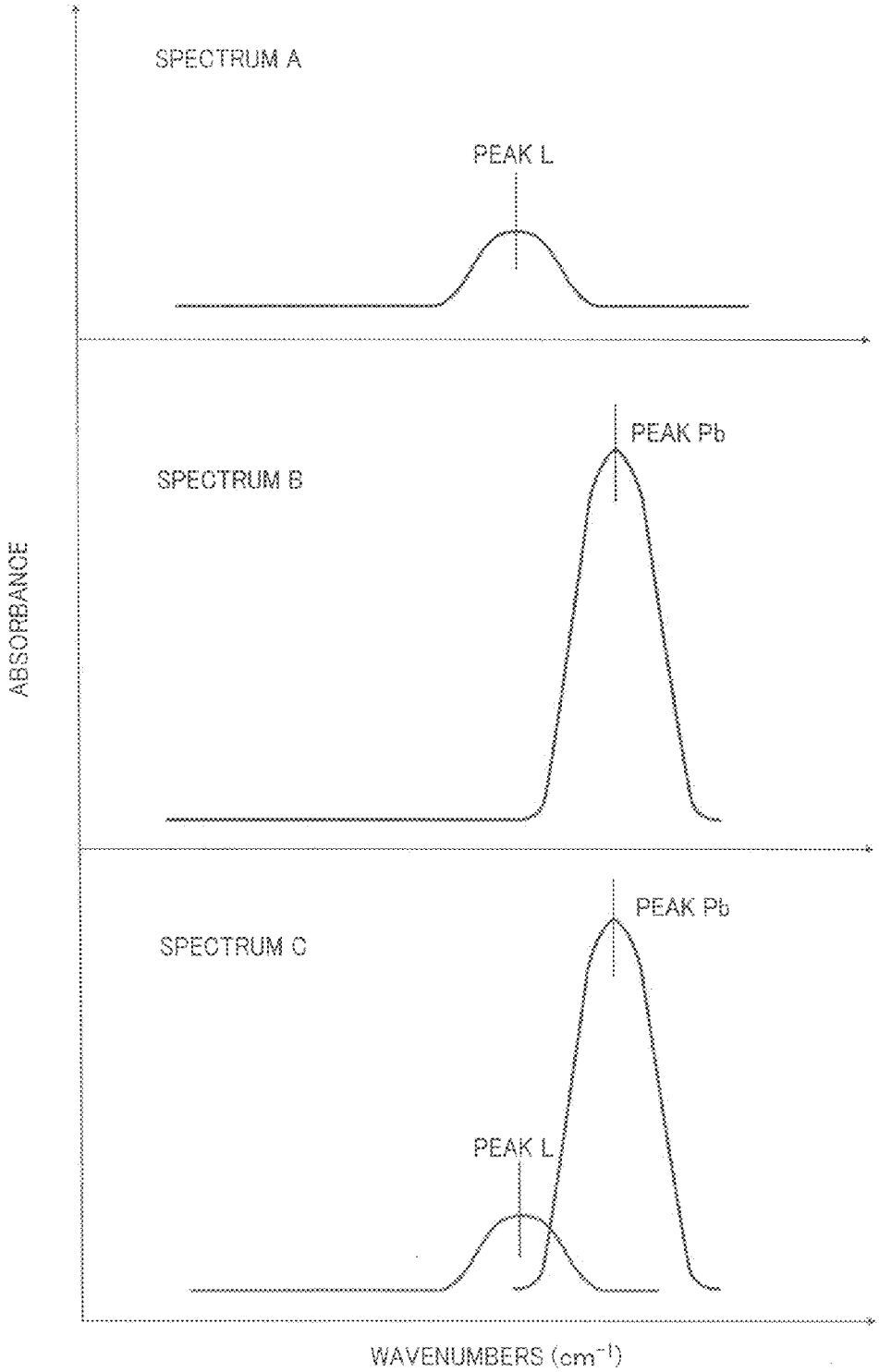
FIG. 4 shows another pattern of IR spectrum A to C used for detection.
Figure 5:
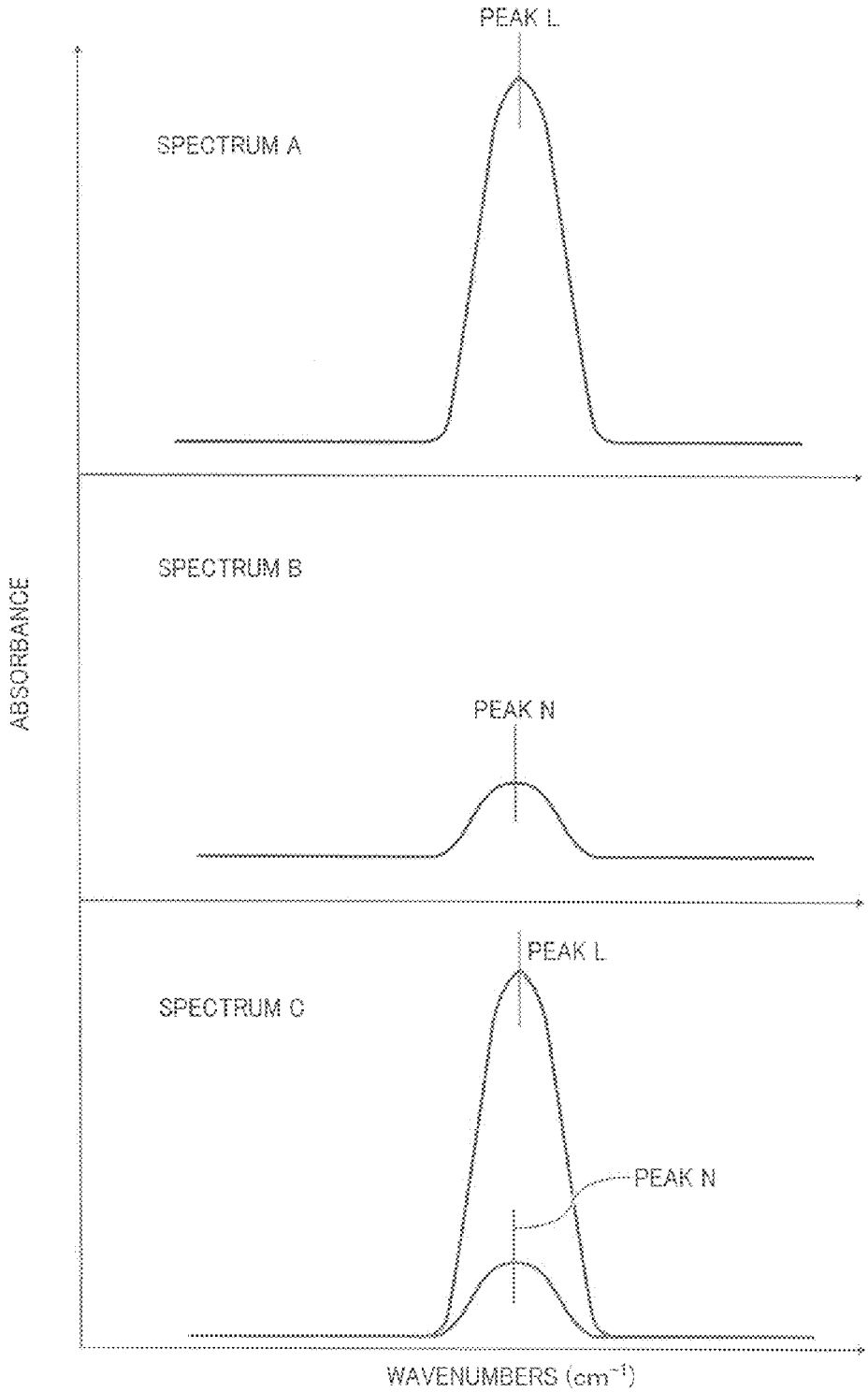
FIG. 5 shows one pattern of IR spectrum, which is not preferable for detection.

In FIG. 4, the peak Pb of the IR spectrum B has a wavenumber, which is not substantially detected in the IR spectrum A. In other words, a peak is not substantially detected in the IR spectrum A at the wavenumber that the peak Pb is detected in the IR spectrum B. If a peak is detected in both of the IR spectrum A and the IR spectrum B at a same wavenumber as shown in FIG. 5, such peak (peak N in FIG. 5) is not preferably used for computing the peak area ratio "Sb/Sa."

Figure 6:
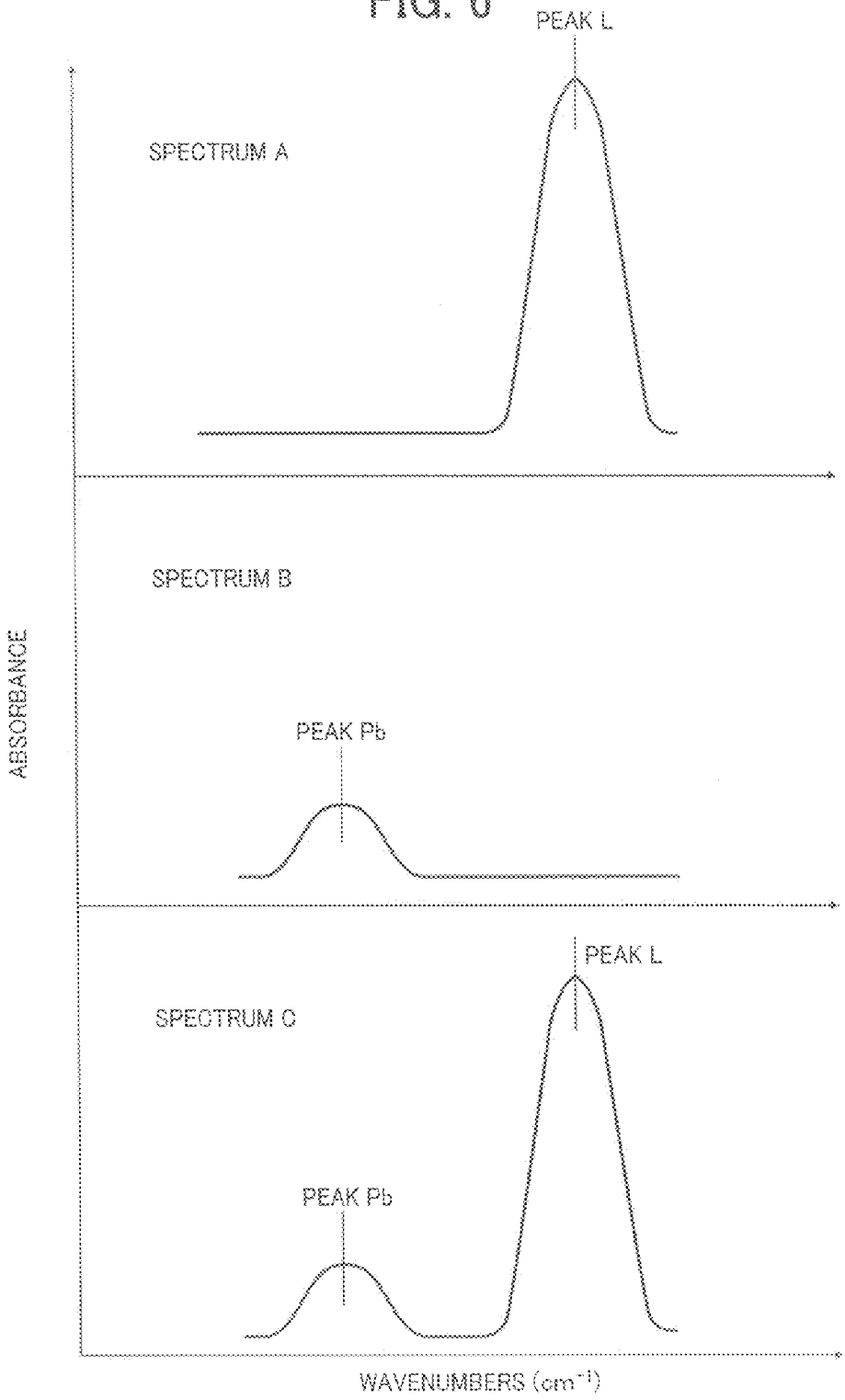
FIG. 6 shows another one pattern of IR spectrum A to C used for detection.

Preferably, as shown in FIG. 6, the peak Pb in the IR spectrum B and a given specific peak (peak L) in the IR spectrum A have no overlapping area. In other words, it is preferable that the peak Pb and the peak L do not overlap each other at peak top or tail of each peak. If the peak Pb and the peak L overlap each other at peak top or tail of each peak as shown in FIG. 4, a differential spectrum of the IR spectrum C and the IR spectrum A needs to be computed, in which a peak area of the peak L is subtracted from the IR spectrum C to obtain a correct value of the peak Pb, by which the peak area ratio "Sb/Sa" can be computed effectively by eliminating an effect of the peak L of the IR spectrum A.

However, such subtraction step can be omitted if the peak Pb has a too great area compared to the peak L, even if the peak Pb and the peak L overlap each other at peak top or tail of each peak as shown in FIG. 4. If such subtraction step can be omitted, a computation of the peak area ratio "Sb/Sa" can be simplified and a computation can be conducted more precisely.

IR spectrum indicates a change of intensity profile of a sample with respect to a wavenumber (or wavelength) of an infrared light source. Such IR spectrum profile is drawn as a curve profile by setting wavenumber ($cm^{-1}$), which is an inverse number of wavelength, in a horizontal axis and setting transmission factor (T) or absorbance (a) in a vertical axis. The transmission factor (T) is a ratio of light energy entered a sample and light energy transmitted from the sample, and the absorbance (a) is obtained by a process of common logarithm of an inverse number of the transmission factor (T). Because the absorbance is proportional to sample concentration (Lambert-Beer law), peak intensity of absorbance spectrum is used for quantitative determination of sample. As for a peak intensity of IR spectrum, absorbance is preferably used for quantitative analysis instead of the transmission factor.

In general, IR spectrum can be measured by two types of machine: diffusion type infrared spectrophotometer and fourier transform infrared spectrophotometer, wherein the fourier transform infrared (FT-IR) spectrophotometer is mainly used for IR spectrum measurement in view of higher efficiency on measurement time, light energy usage, resolution power of wavenumber, and precision of wavenumber. IR spectrum can be measured with such machine using methods, such as a transmission method or the like, which can be selected depending on a purpose of measurement, sample shape, or the like. Among the measurement methods, the ATR method is widely used for FT-IR measurement because the ATR method does not need a complex sample treatment for IR spectrum measurement.

In the ATR method, a sample is contacted to an ATR prism for measurement. Accordingly, a deviation of contact condition of the sample and ATR prism may affect measurement of peak intensity. Specifically, even if a same sample is measured, measurement results may deviate among each of measurements, which is not preferable for quantitative analysis. Recently, several accessories have been devised to control such contact condition. For example, one accessory is used to maintain a gap between an ATR prism and a holding jig, which fixes a sample, at a given level; another accessory is used to maintain a pressure applied to a sample at a given level; and another accessory having a pressure gauge, which can change pressure applied to a sample, is used.

Such accessories can reduce deviation of measurement results for peak intensity. However, when one accessory for maintaining a gap between an ATR prism and a holding jig is used and the gap is measured for several times using a same sample, a variation of about 20% may be observed for the gap. Because of such variation of gap distance, it is hard to effectively evaluate an application amount of the protective agent on the photoconductor by just using peak intensity alone. Instead, an peak area ratio between a peak area attributed to a protective agent and a peak area attributed to a photoconductor is used for evaluating an application amount of the protective agent to the photoconductor, to conduct an evaluation of an application amount of the protective agent more reliably. Such peak area ratio may be used as an evaluation index.

In an exemplary embodiment, a layer thickness of protective agent is 0.4% to 85% of a projection depth of infrared light used in the ATR method using infrared absorption spectrum. In the ATR method, infrared light is not reflected on a boundary face of a sample and an ATR prism, but infrared light projects into an internal portion of a sample (or projects for a projection depth in a sample) and then reflects as total reflection from the projection depth. The projection depth of infrared light is a distance from a surface of a sample, wherein an infrared light intensity at such distance becomes "1/e" of an infrared light intensity on the surface of the sample, which is defined by the following equation 1, in which "e" is the base of natural logarithms.

As indicated in the equation 1, the projection depth of infrared light to the sample is determined by incident angle, refractive index of ATR prism, and wavelength of light. Specifically, the greater the incident angle θ, the greater the refractive index of ATR prism, or the smaller the measurement wavelength, the projection depth becomes smaller. If a smaller projection depth is used, a condition closer to the surface of the sample can be obtained as IR spectrum.

$$dp=\lambda/2\pi n_1[\sin^2\theta-(n_2/n_1)^2]^{1/2} \quad \text{(equation 1)}$$

dp: projection depth $n_2$ and $n_1$: refractive index of ATR prism and sample

θ: incident angle

λ: wavelength

Depending on a layer thickness of protective agent, ATR prism, incident angle of infrared light, and wavelength for an index peak are selected, wherein the index peak is the peak Pa and peak Pb. Such ATR prism, incident angle of infrared light, and wavelength for an index peak are selected so as to set the layer thickness of protective agent as 0.4% to 85% of the projection depth of infrared light, preferably 15% to 70%, and more preferably 25 to 60%.

If the layer thickness of protective agent is too great compared to the projection depth of infrared light, the peak area Sb for the peak Pb is saturated at a given level, and a peak intensity for the peak Pa becomes smaller, by which the peak area Sa for the peak Pa has a greater error, and the peak area ratio "Sb/Sa" is affected by the error of peak area Sa, which is not preferable.

If the layer thickness of protective agent is too small compared to the projection depth of infrared light, the peak area Sa for the peak Pa is saturated at a given level, and a peak intensity for the peak Pb becomes too small, by which the peak area Sb for the peak Pb has a greater error, and the peak area ratio "Sb/Sa" is affected by the error of peak area Sb, which is not preferable.

If the layer thickness of protective agent is not within a range of the 0.4 to 85% of the projection depth when a photoconductor supplied with a protective agent is measured by the ATR method under a condition having a specific ATR prism, a specific incident angle of infrared light, and a specific wavelength for index peak, the projection depth can be changed to preferable value by adjusting refractive index of ATR prism, incident angle of infrared light, and wavelength of index peak as indicated in the equation 1. Accordingly, if the projection depth is too small or too great with respect to the thickness of protective agent, refractive index of ATR prism, incident angle of infrared light, and wavelength of index peak used for computing an application amount of protective agent may need to be adjusted so as to set a preferable relationship between a layer thickness of the protective agent and projection depth.

In some cases, the projection depth may not be adjusted by adjusting wavelength of index peak because the wavelength of index peak is dependent to material types of protective agent and photoconductor when a specific ATR prism and incident angle of infrared light are used for the ATR method.

If the protective agent and photoconductor have a plurality of functional groups and each of the functional group has a peak, which can be detected at a greatly different wavelength, for example, the projection depth can be adjusted by selecting one peak for one functional group. For example, a peak having a greater wavelength is selected to set a greater depth for the projection depth.

However, if the protective agent, such as paraffin, has too little functional group, and only one or several peaks are detected and if such several peaks are detected at a relatively similar wavelength, the projection depth cannot be adjusted by selecting one peak. In this case, the projection depth can be adjusted to a preferable level by changing the refractive index of ATR prism, and the incident angle of infrared light.

In general, the ATR prism may be KRS-5 (refractive index 2.4), germanium (refractive index 4.0), AMTIR (refractive index 2.5), silicon (refractive index 3.4), zinc selenide (refractive index 2.4), and diamond (refractive index 2.4), or the like. In general, the incident angle of infrared light for ATR measurement may be from 30° to 85°.

In an exemplary embodiment, the projection depth of the peak Pa is from 50% to 170% of the projection depth of the peak Pb, preferably from 70% to 140%, and more preferably from 80% to 120%. If the projection depth of the peak Pa becomes too small with respect to the projection depth of the peak Pb, sensitivity of evaluation index "Sb/Sa" for determining an application amount of the protective agent becomes unpreferably small. If the projection depth of the peak Pa becomes too great with respect to the projection depth of the peak Pb, sensitivity of evaluation index "Sb/Sa" for determining an application amount of the protective agent becomes also unpreferably small.

In an exemplary embodiment, a protective agent includes paraffin for 50 wt % (weight percent) or more, for example, and the peak Pb used for computing evaluation index "Sb/Sa" for determining an application amount of the protective agent is preferably attributed to methylene group. Such paraffin includes normal paraffin, isoparaffin, and cyclo paraffin, for example, which may be a chemically stable material such as less-likely-to-occur addition reaction and less-likely-to-occur oxidation reaction in the atmosphere. Accordingly, paraffin, effectively protecting a photoconductor, can be preferably used as a protective agent from a viewpoint of material stability over time.

In an exemplary embodiment, a protective agent includes paraffin for 50 wt % (weight percent) or more, preferably 60 wt % or more, and more preferably 70 wt % or more, for example. If the paraffin amount included in the protective agent is too small, the protective agent may not effectively protect a photoconductor, which is not preferable. However, if a protective agent includes another component other than paraffin, which has a sufficient protection effect, the paraffin amount included in the protective agent can be set less than 50 wt %.

Further, if the protective agent includes paraffin for 50 weight percent (wt %) or more, methylene peak having a sufficient peak intensity can be detected at wavenumebrs of 2850±15 $cm^{-1}$ and 2925±15 $cm^{-1}$, and thereby the peak Pb can be set as methylene peak corresponding to methylene group in the protective agent. With such setting for the peak Pb, the evaluation index "Sb/Sa" for evaluating an application amount of the protective agent can be computed more reliably. Especially, when a protective agent, such as paraffin, not including a metal component and not having too many infrared (IR) peaks that are distinguishable, an application amount of the protective agent may not be evaluated effectively except the FT-IR analysis. In view of such situation, a method according to an exemplary embodiment, which effectively evaluates a surface condition of a photoconductor coated with a protective agent not including a metal component, is desirably used.

Other than paraffin, a protective agent may include cyclic olefin copolymer (COC), and amphiphilic organic compound, for example. Such amphiphilic organic compound may be anionic surfactant, cationic surfactant, zwitterionic surfactant, nonionic surfactant, or a complex compound of these, for example.

The nonionic surfactant may preferably be an ester compound of alkylcarboxylic acid (see chemical formula (1)) and polyalcohol, in which "n" is an integral number from 15 to 35.

$$C_nH_{2n+1}COOH \qquad \text{(chemical formula(1))}$$

If a straight chain alkylcarboxylic acid is used as alkylcarboxylic acid (chemical formula(1)), amphiphilic organic compound can be preferably adhered on a surface of an image carrying member such as photoconductor. Specifically, hydrophobicity portion of the amphiphilic organic compound can be oriented to a surface of an image carrying member in an orderly manner, and thereby the amphiphilic organic compound can be preferably adsorbed on the image carrying with a higher adsorption density.

Alkylcarboxylic acid ester has hydrophobicity. The greater the number of alkylcarboxylic acid ester in one molecule, the more effective to reduce an adsorption of dissociated material generated by aerial discharge to a surface of an image carrying member such as photoconductor, and the more effective to reduce a electrical stress to a surface of the image carrying member during a charging process. However, if a ratio of alkylcarboxylic acid ester becomes too great, polyalcohol having hydrophilicity may be blocked by the alkylcarboxylic acid ester, by which an adsorption performance may not be effectively obtained depending on a surface condition of an image carrying member. Accordingly, the average number of ester bond in one molecule of amphiphilic organic compound may be preferably from 1 to 3.

Such average number of ester bond in one molecule of amphiphilic organic compound can be set or adjusted by selecting one amphiphilic organic compound or by mixing a plurality of amphiphilic organic compounds, each compound having different number of ester bonds. Such amphiphilic organic compound may include anionic surfactant, cationic surfactant, zwitterionic surfactant, and nonionic surfactant, as above described.

Examples of the anionic surfactant include compounds of alkali metal ion (e.g., sodium, potassium), alkaline-earth metal ion (e.g., magnesium, calcium), metal ion (e.g., aluminum, zinc), or ammonium ion bonded with a compound having an anion at hydrophobicity portion, such as alkyl benzene sulfonate, α-olefin sulfonate, alkane sulfonate, sulfuric alkyl salt, sulfuric alkylpolyoxyethylene salt, alkyl phosphate salt, long-chain aliphatic acid salt, α-sulfoaliphatic acid ester salt, and alkyl ether sulfate.

Examples of the cationic surfactant include compounds composed of chlorine, fluorine, bromine, phosphoric ion, nitrate ion, sulphuric ion, thiosulphuric ion, carbonate ion, and hydroxide ion, which are bonded to a compound having a cation at hydrophobicity portion, such as alkyltrimethyl ammonium salt, dialkylmethyl ammonium salt, and alkyldimethylbenzyl ammonium salt.

Examples of the zwitterionic surfactant include dimethylalkylamine oxide, N-alkylbetaine, imidazoline derivatives, and alkylamino acid.

Examples of the nonionic surfactant include alcohol compound, ether compound, or amide compound, such as long-chain alkylalcohol, alkylpolyoxyethylene ether, polyoxyethylene alkyl phenyl ether, aliphatic acid diethanolamide, alkyl polyglucoxide, and polyoxyethylene sorbitan alkylester. Further, examples of the nonionic surfactant preferably include long-chain alkylcarboxylic acid, such as lauric acid, paltimic acid, stearic acid, behenic acid, lignoceric acid, cerinic acid, montanic acid, melissic acid; polyalcohol, such as ethylene glycol, propylene glycol, glycerin, erythritol, hexitol; and ester compound having partially anhydride compound of these.

Examples of ester compounds include alkylcarboxylic acid glyceryl or its substitution, such as monoglyceryl stearate, diglyceryl stearate, monoglyceryl palmitate, diglyceryl laurate, triglyceryl laurate, diglyceryl palmitate, triglyceryl palmitate, diglyceryl myristate, triglyceryl myristate, glyceryl palmitate/stearate, monoglyceryl arachidate, diglyceryl arachidate, monoglyceryl behenate, glyceryl stearate/behenate, glyceryl cerinate/stearate, monoglyceryl montanate, monoglyceryl melissate; and alkylcarboxylic acid sorbitan or its substitution, such as monosorbitan stearate, trisorbitan stearate, monosorbitan palmitate, disorbitan palmitate, trisorbitan palmitate, disorbitan myristate, trisorbitan myristate, sorbitan paltimate/stearate, monosorbitan arachidate, disorbitan arachidate, monosorbitan behenate, sorbitan stearate/behenate, sorbitan cerinate/stearate, monosorbitan montanate, monosorbitan melissate, but not limited those. These amphiphilic organic compound can be used alone or in combinaton.

In an exemplary embodiment, a protective agent preferably includes an organic compound having methylene group, and the peak Pb is preferably attributed to the methylene group for computing the evaluation index "Sb/Sa" for determining an application amount of the protective agent. When a protective agent, such as paraffin, not including a metal component and not having too many infrared (IR) peaks that are distinguishable, an application amount of the protective agent may not be evaluated effectively except the FT-IR analysis. In view of such situation, a method according to an exemplary embodiment, which effectively evaluates a surface condition of a photoconductor coated with a protective agent not including a metal component, is desirably used. Such method can be used other protective agent having an organic compound having methylene group, wherein such organic compound may be a metallic soap, such as zinc stearate, zinc palmitate, zinc oleate, and lead stearate.

In an exemplary embodiment, a photoconductor preferably includes an organic compound having phenyl group in its surface, and the peak Pa is preferably attributed to the phenyl group for computing the evaluation index "Sb/Sa" for determining an application amount of the protective agent. If the photoconductor surface includes an organic compound having phenyl group, the phenyl group can be detected at a wavenumber of 3055±25 $cm^{-1}$, which is closer to the wavenumber that the methylene group is detected. Because the phenyl group and the methylene group can be detected at wavenumbers ($cm^{-1}$), closer to each other, the projection depth of the light used for detection can be set to values closer to each other, by which the evaluation index "Sb/Sa" can be computed with a higher sensitivity and higher reliability.

In general, materials used for detecting peaks, such as peak Pa, may exist in a photoconductor with some concentration variation in a depth direction of a photoconductive layer, and further other materials, such as filler agent, may also be dispersed in a photoconductor with some concentration variation in a depth direction of a photoconductive layer. Accordingly, if the peak Pa and the peak Pb can be detected at wavenumbers ($cm^{-1}$), closer to each other, the projection depth for each of the peak Pa and the peak Pb can be set closer to each other, by which an effect of the above-mentioned concentration variation to detection precision of the peak Pa and the peak Pb can be reduced. Therefore, the closer the projection depth of the peak Pa and the peak Pb, the more reliable for obtaining better evaluation index "Sb/Sa."

Preferably, the photoconductor may not include a material, which has a peak that overlaps with the peak attributed to phenyl group, in its surface.

Further, in an exemplary embodiment, a photoconductor preferably includes an organic compound having carbonate bond, and the peak Pa is preferably attributed to the carbonate bond for computing the evaluation index "Sb/Sa" for determining an application amount of the protective agent. If the photoconductor surface includes an organic compound having carbonate bond, the photoconductor can preferably increase its strength. Further, if the photoconductor surface includes an organic compound having carbonate bond, the carbonate bond can be detected at a wavenumber of 1760±20 $cm^{-1}$, which is closer to the wavenumber that the methylene group is detected.

Because the carbonate bond and the methylene group can be detected at wavenumbers ($cm^{-1}$), closer to each other, the projection depth of the light used for detection can be set to values closer to each other, by which the evaluation index "Sb/Sa" can be computed with a higher sensitivity and higher reliability. Preferably, the photoconductor may not include a material, which has a peak that overlaps with the peak attributed to carbonate bond, in its surface.

In an exemplary embodiment, a protective layer setting unit is evaluated as follows: a protective agent is applied to a photoconductor for a given time, and if the evaluation index "Sb/Sa" can be set to a given threshold value or less within a given application time, such protective layer setting unit is determined as acceptable, in which the evaluation index "Sb/Sa" indicates application amount of the protective agent on the photoconductor.

Figure 7:
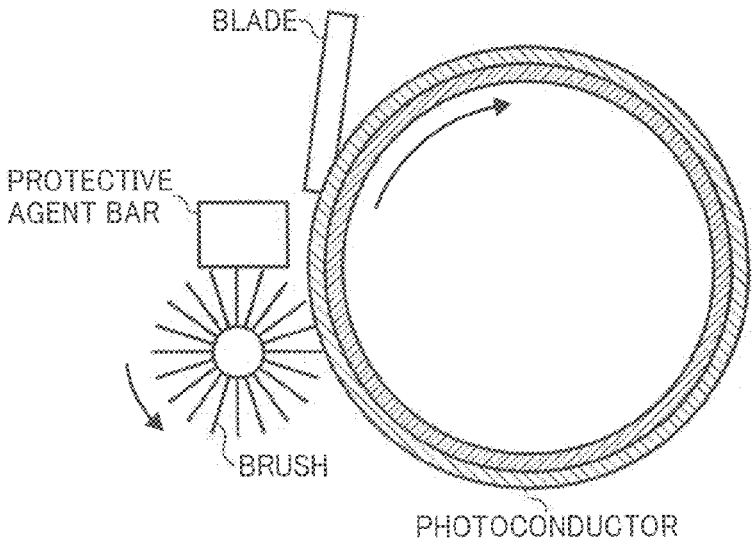
FIG. 7 illustrates a schematic configuration of a protective layer setting unit used for evaluation.

In an exemplary embodiment, a protective layer setting unit includes a blade, a brush, and a protective agent bar as shown in FIG. 7. A photoconductor and the brush are rotated at a given speed by a drive mechanism, such as gears. The brush scrapes the protective agent from the protective agent bar, and the protective agent is then supplied to the photoconductor surface with a rotation of the brush. The blade extends the protective agent over the photoconductor when the photoconductor comes to a position facing the blade, by which the protective agent is applied on the photoconductor as a protective layer.

A description is now given to a configuration of a protective layer setting unit, a method of evaluating the protective layer setting unit, and a process cartridge or an image forming apparatus having a protective layer setting unit according to an exemplary embodiment.

A description is now given to a protective layer setting unit according to an exemplary embodiment.

As background information, reason of abnormal image occurrence in an image forming apparatus having a protective layer setting unit was examined by observing a surface of photoconductor, coated with the protective agent, with a scanning electron microscope (SEM) under an assumption that an occurrence of the abnormal image may be attributed to an amount of the protective agent, such as abnormal image may occur where the protective agent is not applied, and abnormal image may not occur where the protective agent is applied. Although such surface observation confirmed that the protective agent adhered on the photoconductor, such SEM observation was not effective for determining an amount of the protective agent on the photoconductor, by which reason of abnormal image occurrence was not determined.

Another SEM observation was then conducted to determine reason of abnormal image occurrence under an assumption that an abnormal image may occur differently depending on image types to be formed. Based on SEM observation for observing a portion of photoconductor where abnormal image occurred, it was found that when a formed image area was small, toner was more likely to adhere the photoconductor, by which image resolution became lower, and when a formed image area was great, the photoconductor was partially abraded, by which abnormal image was more likely to occur.

Because abnormal image occurs in various manners depending on images to be formed, it is assumed that a surface condition of photoconductor applied with a protective agent may be correlated to occurring or not occurring abnormal image. In other words, an application performance of protective agent by a protective layer setting unit may be correlated to occurring or not occurring abnormal image. In view of such background, an application amount of the protective agent on the photoconductor is evaluated as follows. Because conditions of protective agent on the photoconductor change depending on formed images, an application amount of the protective agent on the photoconductor is evaluated without forming an image on the photoconductor.

As above noted, a conventional analysis method may not be suitable for detecting an amount of a protective agent, such as paraffin, not including metal component. In view of such background, the ATR method using fourier transform infrared spectrophotometer (FT-IR) is used for effectively evaluating a surface condition of a photoconductor coated with a protective agent not including metal component.

IR spectrum indicates a change of intensity profile of sample with respect to a wavenumber (or wavelength) of an infrared light source. Such IR spectrum profile is drawn as a curve profile by setting wavenumber($cm^{-1}$), which is an inverse number of wavelength in a horizontal axis and setting transmission factor (T) or absorbance (a) in a vertical axis.

The transmission factor (T) is a ratio of light energy entered a sample and light energy transmitted from the sample, and the absorbance (a) is obtained by a process of common logarithm of an inverse number of the transmission factor (T). Because the absorbance is proportional to sample concentration (Lambert-Beer law), peak intensity of absorbance spectrum is used for quantitative determination of sample. As for a peak intensity of IR spectrum, absorbance is preferably used for quantitative analysis instead of the transmission factor.

In general, IR spectrum can be measured by two types of machine: diffusion type infrared spectrophotometer and fourier transform infrared spectrophotometer, wherein the fourier transform infrared (FT-IR) spectrophotometer is mainly used for IR spectrum be measurement with respect to higher efficiency on measurement time, light energy usage, resolution power of wavenumber, and precision of wavenumber. IR spectrum can be measured with such machine using methods, such as a transmission method or the like, which can be selected depending on a purpose of measurement, sample shape, or the like. Among the measurement methods, the ATR method is widely used for FT-IR measurement because the ATR method does not need a complex sample treatment for IR spectrum measurement.

In the ATR method, infrared absorption spectrum is measured using total reflection. Specifically, an ATR prism having a higher refractive index is closely contacted against a sample, an infrared (IR) light is irradiated to the sample via the ATR prism, and then an outgoing light from the ATR prism is analyzed spectrometrically. The infrared light can be totally reflected at a contact face of the ATR prism and the sample (i.e., total reflection) when the infrared light is irradiated to the ATR prism with a given angle or more, wherein such given angle is determined based on a relationship of the refractive index of the ATR prism and the sample. During such IR light irradiation, the IR light reflects from an internal surface of the ATR prism and generates an evanescent wave which projects orthogonally into the sample. Some of the energy of the evanescent wave is absorbed by the sample and the reflected IR light is attenuated and received by a detector, by which absorption spectrum of the sample can be obtained.

The ATR method can be applied for various samples because an absorption spectrum of the sample can be measured by contacting a portion of the sample against the ATR prism. For example, absorption spectrum of a thick sample or low-transmittance sample can be measured if such sample can be closely contacted to the ATR prism. In the ATR method, a functional group in the sample can be determined based on wavenumber corresponding to absorbed infrared light, and thereby the ATR method is widely used for qualitative analysis. However, because a peak intensity of absorption spectrum is varied due to a press-down pressure of sample, the ATR method may not be used so often for quantitative analysis in general.

In an exemplary embodiment, the ATR method is used for quantitative analysis for evaluating an application amount of a protective agent on a photoconductor by measuring and analyzing IR spectrum under various conditions.

In an exemplary embodiment, an attenuated total reflection method (hereinafter, referred as ATR method or ATR) is used to evaluate a protective agent not including metal component, such as paraffin applied to a photoconductor. In the ATR method, a projection depth of infrared (IR) light into a sample becomes different depending on measurement conditions, such as ATR prism, incident angle, by which results of measured spectrum of a same sample may become different depending on such measurement conditions. For example, one spectrum result shows only a peak attributed to a photoconductor, another spectrum result shows only a peak attributed to a protective agent, or another spectrum result shows a mixture of a peak attributed to a photoconductor and a peak attributed to a protective agent.

In an exemplary embodiment, a measurement condition which can detect both of a peak attributed to a photoconductor and a peak attributed to a protective agent is determined based on researches on measurement conditions, in which conditions of the ATR prism, incident angle, or the like are changed in many values. Under such measurement condition, an infrared (IR) spectrum profile for a photoconductor is measured to evaluate an application amount of the protective agent on the photoconductor.

In the ATR method, a measurement portion of a sample deforms due to a pressure for holding the sample, by which peak intensity of spectrum may vary. Accordingly, peak intensity of spectrum alone may not be used for effectively detecting a surface condition of the sample.

In view of such variation of measurement results, a substantially consistent condition is set when setting a sample on a measurement device so as to obtain infrared (IR) spectrum profile under the consistent condition. Specifically, a gap between a fixing jig for holding the sample and the ATR prism is maintained at a consistent level, or a pressure for holding the sample is maintained at a consistent level. Then, a measurement of infrared (IR) spectrum profile is conducted for a photoconductor applied with the protective agent, and each peak in the IR spectrum profile is evaluated and attributed to a specific material, functional group, or the like. In an exemplary embodiment, an area ratio between a peak area attributed to photoconductor an a peak area attributed to protective agent is computed, wherein the peak area ratio becomes greater as an application time of the protective agent increases.

In an exemplary embodiment, a peak area attributed to photoconductor and a peak area attributed to protective agent are used to evaluate an application amount of the protective agent on the photoconductor.

As described later in this disclosure, when an peak area ratio between a peak area attributed to a photoconductor and a peak area attributed to protective agent is set within a given range, higher quality images can be formed, in which an area ratio of peak area attributed to protective agent with respect to a peak area attributed to a photoconductor is used as evaluation index for evaluating an application amount of a protective agent on a photoconductor.

In an exemplary embodiment, an application amount of the protective agent applied to a surface of a photoconductor is evaluated as follows. As above mentioned, the protective layer setting unit is used to apply the protective agent, such as paraffin, to the surface of photoconductor. The ATR method using infrared absorption spectrum uses an ATR prism made of germanium (Ge) and incident angle of infrared light of 45° as measurement condition, for example. Specifically, an IR spectrum A of the photoconductor surface before applying the protective agent and an IR spectrum B of the protective agent alone are measured by the ATR method using infrared absorption spectrum, and an IR spectrum C after applying the protective agent on the photoconductor is measured by the ATR method.

Figure 8:
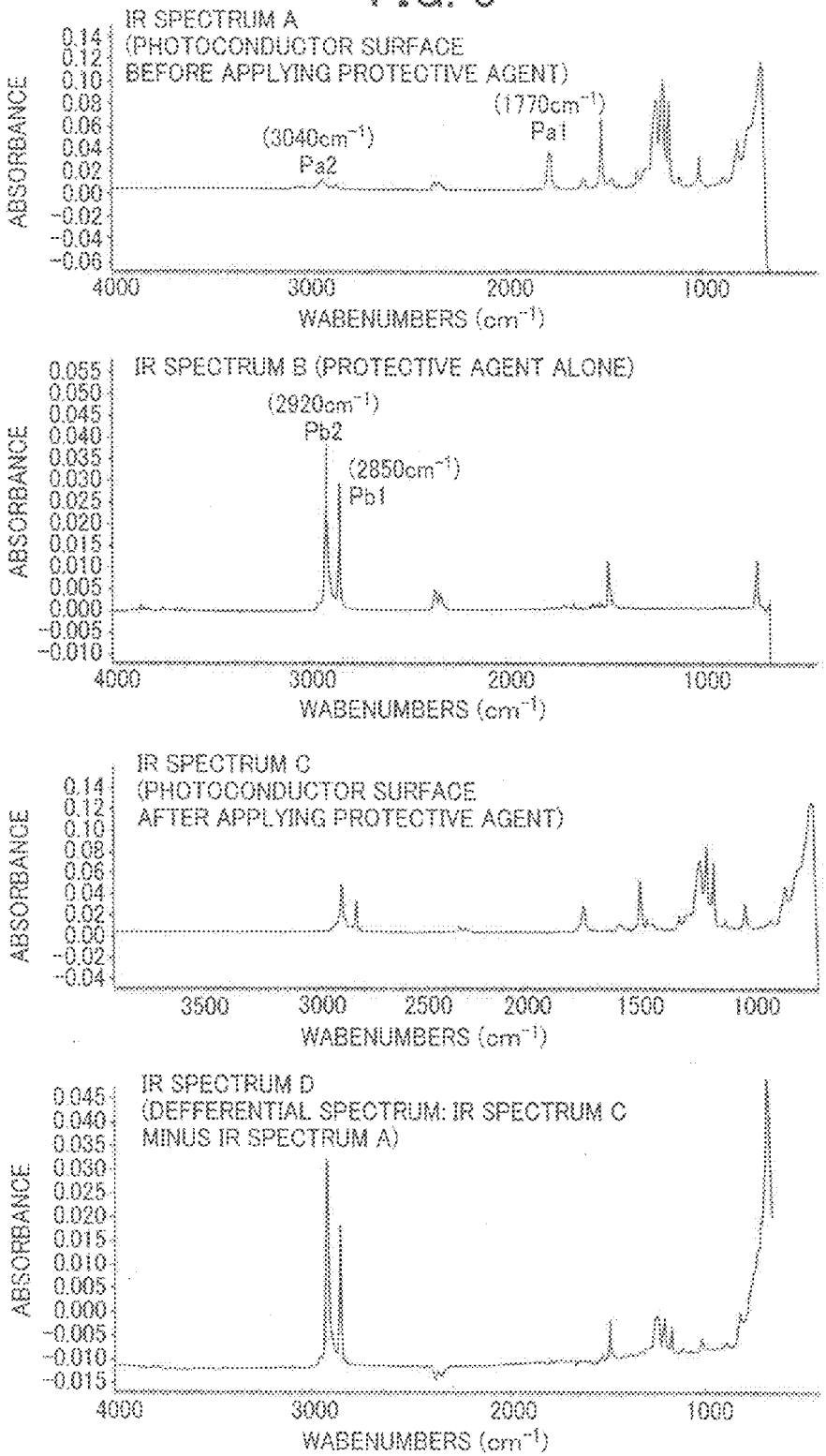
FIG. 8 shows example IR spectrum, in which IR spectrum A is for a photoconductor surface before applying the protective agent, IR spectrum B is for a protective agent alone, IR spectrum C is for a photoconductor surface after applying a protective agent, and differential spectrum D, obtained by subtracting IR spectrum A from the IR spectrum C.

FIG. 8 shows the IR spectrum A (absorbance spectrum) for a photoconductor surface before applying the protective agent, the IR spectrum B (absorbance spectrum) for a protective agent alone, the IR spectrum C (absorbance spectrum) for a photoconductor surface after applying a protective agent, and differential spectrum D, obtained by subtracting the IR spectrum A from the IR spectrum C.

The IR spectrum A has a given specific peak that is not included in the IR spectrum B, which is termed as a peak Pal and such peak Pa1 has a peak area Sa1 at a wavenumber of 1770 $cm^{-1}$. The IR spectrum B has a given specific peak that is not included in the IR spectrum A, which is termed as a peak Pb1 and such peak Pb1 has a peak area Sb1 at a wavenumber of 2850 $cm^{-1}$. The application amount of the protective agent on the photoconductor is evaluated using a peak area ratio "Sb1/Sa1."

In an exemplary embodiment, the peak area ratio "Sb1/Sa1" is preferably set to 0.02 or more after applying the protective agent on the photoconductor for 5 minutes, and the peak area ratio "Sb1/Sa1" is preferably set to 0.85 or less after applying the protective agent on the photoconductor for 150 minutes. The peak Pb1 is a peak attributed to protective agent, and most of IR spectrum peaks of an organic photoconductor (OPC) are detected around the peak Pb1. Accordingly, the peak area Sb1 of the Pb1 is computed using a differential spectrum, in which IR spectrum A is subtracted from IR spectrum C.

Further, in an exemplary embodiment, another peaks may be used in a similar manner.

Specifically, the IR spectrum A has a given specific peak that is not included in the IR spectrum B, which is termed as a peak Pa2 and such peak Pa2 has a peak area Sa2 at a wavenumber of 3040 $cm^{-1}$. The IR spectrum B has a given specific peak that is not included in the IR spectrum A, which is termed as a peak Pb2 and such peak Pb2 has a peak area Sb2 at a wavenumber of 2920 $cm^{-1}$. The application amount of the protective agent on the photoconductor is evaluated using a peak area ratio "Sb2/Sa2." In an exemplary embodiment, the peak area ratio "Sb2/Sa2" is preferably set to 6.5 or more after applying the protective agent on the photoconductor for 15 minutes, and the peak area ratio "Sb2/Sa2" is preferably set to 38 or less after applying the protective agent on the photoconductor for 120 minutes.

In the ATR method, infrared light is not reflected on a boundary face of a sample and an ATR prism, but infrared light projects into an internal portion of a sample (or projects for a projection depth in a sample) and then reflects as total reflection from the projection depth. The projection depth of infrared light is a distance from a surface of a sample, wherein an infrared light intensity at such distance becomes 1/e of an infrared light intensity on the surface of the sample, which is defined by the aforementioned equation 1. As indicated in the equation 1, the projection depth of infrared light to the sample is determined by incident angle, refractive index of ATR prism, and wavelength. Specifically, the greater the incident angle θ, the greater the refractive index of ATR prism, or the smaller the measurement wavelength, the projection depth becomes smaller. If a smaller projection depth is used, a condition closer to the surface of the sample can be obtained as IR spectrum.

Specifically, the ATR prism may be germanium (Ge) prism having a higher refractive index to obtain condition information closer to the surface of the sample, which is a photoconductor coated with the protective agent. Further, an incident angle of infrared light to the sample is set to 45° so as to obtain the evaluation index "Sb/Sa" more precisely. With such condition of using a germanium (Ge) prism as the ATR prism and setting the incident angle of infrared light to 45°, an application amount of the protective agent on the photoconductor by the protective layer setting unit can be determined more precisely using the evaluation index "Sb/Sa."

The peak Pb1 and Pb2 are peaks attributed to methylene group, which is detectable having a sufficient intensity. Accordingly, the peak Pb1 and Pb2 can be preferably used as index peak for evaluating an application amount of the protective agent on the photoconductor. Further, the peak Pa1 and Pa2 are peaks attributed to polycarbonate bond included in a photoconductor, which is detectable having a sufficient intensity. Accordingly, the peak Pa1 and Pa2 can be preferably used as index peak for evaluating an application amount of the protective agent on the photoconductor, which has polycarbonate. Because the peak Pa2 and the peak Pb2 can be detected at wavenumbers ($cm^{-1}$), closer to each other, the projection depth of the light used for detection can be set to values closer to each other, by which the evaluation index "Sb/Sa" can be preferably computed with a higher sensitivity and higher reliability. Further, as for computing a peak area of IR spectrum, absorbance is preferably used for quantitative analysis.

In the FT-IR analysis, an application amount of the protective agent on the photoconductor may be evaluated by just observing a peak intensity (or area) attributed to a protective agent. However, in the ATR method, it is hard to effectively evaluate an application amount of the protective agent on the photoconductor by just using peak intensity (or area) alone because the peak area may vary due to a variation of pressure for holding a sample. Instead, a peak area ratio between a peak area attributed to a protective agent and a peak area attributed to a photoconductor is used for evaluating an application amount of the protective agent to the photoconductor so as to conduct an evaluation of an application amount of the protective agent more reliably. Such peak area ratio "Sb/Sa" is used as an evaluation index.

The peak Pa (Pa1, Pa2) in the IR spectrum C is one peak in the IR spectrum A, which is not detected in the IR spectrum B. In FIG. 1, the peak Pa of the IR spectrum A has a wavenumber, which is not detected in the IR spectrum B. In other words, a peak is not detected in the IR spectrum B at the wavenumber that the peak Pa is detected in the IR spectrum A. If a peak is detected in both of the IR spectrum A and the IR spectrum B at a same wavenumber as shown in FIG. 2, such peak (peak M in FIG. 2) is not preferably used for computing the peak area ratio or evaluation index "Sb/Sa."

Preferably, as shown in FIG. 3, the peak Pa in the IR spectrum A and a given specific peak (peak K) in the IR spectrum B have no overlapping area. In other words, it is preferable that the peak Pa and the peak K do not overlap each other at peak top or tail of each peak. If the peak Pa and the peak K overlap each other at peak top or tail of each peak as shown in FIG. 1, a differential spectrum of the IR spectrum C and the IR spectrum B needs to be computed, in which a peak area of the peak K is subtracted from the IR spectrum C to obtain a correct value of the peak Pa, by which the peak area ratio "Sb/Sa" can be computed effectively by eliminating an effect of the peak K of the IR spectrum B.

However, such subtraction step can be omitted if the peak Pa has an area, which is too great compared to the peak K, even if the peak Pa and the peak K overlap each other at peak top or tail of each peak as shown in FIG. 1. If such subtraction step can be omitted, a computation of the peak area ratio "Sb/Sa" can be simplified and a computation can be conducted more precisely.

The peak Pb (Pb1, Pb2) in the IR spectrum C is one peak in the IR spectrum B, which is not detected in the IR spectrum A. In FIG. 4, the peak Pb of the IR spectrum B has a wavenumber, which is not detected in the IR spectrum A. In other words, a peak is not detected in the IR spectrum A at the wavenumber that the peak Pb is detected in the IR spectrum B. If a peak is detected in both of the IR spectrum A and the IR spectrum B at a same wavenumber as shown in FIG. 5, such peak (peak N in FIG. 5) is not preferably used for computing the peak area ratio "Sb/Sa."

Preferably, as shown in FIG. 6, the peak Pb in the IR spectrum B and a given specific peak (peak L) in the IR spectrum A have no overlapping area. In other words, it is preferable that the peak Pb and the peak L do not overlap each other at peak top or tail of each peak. If the peak Pb and the peak L overlap each other at peak top or tail of each peak as shown in FIG. 4, a differential spectrum of the IR spectrum C and the IR spectrum A needs to be computed, in which a peak area of the peak L is subtracted from the IR spectrum C to obtain a correct value of the peak Pb, by which the peak area ratio "Sb/Sa" can be computed effectively by eliminating an effect of the peak L of the IR spectrum A.

However, such subtraction step can be omitted if the peak Pb has an area, which is too great compared to the peak L, even if the peak Pb and the peak L overlap each other at peak top or tail of each peak as shown in FIG. 4. If such subtraction step can be omitted, a computation of the peak area ratio "Sb/Sa" can be simplified and a computation can be conducted more precisely.

As above described, the peak area ratio "Sb1/Sa1" is set to 0.020 or more after applying the protective agent on the photoconductor for 5 minutes, preferably from 0.040 to 0.3, and more preferably from 0.045 to 0.2. If the Sb1/Sa1 is too small after the application time of 5 minutes, the protective agent may not effectively protect the photoconductor at an earlier stage (or initial usage timing) of an image forming apparatus, which is not preferable. Further, as above described, the peak area ratio "Sb1/Sa1" is set to 0.85 or less after applying the protective agent on the photoconductor for 150 minutes, preferably from 0.1 to 0.6, and more preferably from 0.15 to 0.4. If the Sb1/Sa1 becomes too great within the application time of 120 minutes, the protective agent may be excessively applied to the photoconductor, by which the photoconductor may not be charged effectively, or an image blur may occur, which is not preferable.

As above described, the peak area ratio "Sb2/Sa2" is set to 6.5 or more after applying the protective agent on the photoconductor for 15 minutes, preferably from 7 to 23, and more preferably from 8 to 15. If the Sb2/Sa2 is too small after the application time of 15 minutes, the protective agent may not effectively protect the photoconductor at an earlier stage (or initial usage timing) of an image forming apparatus, which is not preferable. Further, as above described, the peak area ratio "Sb2/Sa2" is set to 38 or less after applying the protective agent on the photoconductor for 120 minutes, preferably from 8 to 25, and more preferably from 9 to 16. If the Sb2/Sa2 becomes too great after the application time of 120 minutes, the protective agent may be excessively applied to the photoconductor, by which the photoconductor may not be charged effectively, or an image blur may occur, which is not preferable.

In an exemplary embodiment, the protective layer setting unit uses a protective agent having paraffin for 50 to 95 weight percent (wt %). The ratio of paraffin in the protective agent is a ratio of paraffin of all organic constituents in the protective agent. If the protective agent includes inorganic constituent, the ratio of paraffin is a ratio of paraffin of all organic constituents in the protective agent computed by excluding inorganic constituent.

Although a threshold value for evaluation index "Sb1/Sa1" may vary depending on a ratio of paraffin in a protective agent, the peak area ratio "Sb1/Sa1" can be set 0.020 or more after applying the protective agent on the photoconductor for 5 minutes, and the peak area ratio "Sb1/Sa1" can be set 0.85 or less after applying the protective agent on the photoconductor for 150 minutes, wherein such value indicates that an application amount of the protective agent to the photoconductor is in good level.

Although a threshold value for evaluation index "Sb2/Sa2" may vary depending on a ratio of paraffin in a protective agent, the peak area ratio "Sb2/Sa2" can be set 6.5 or more after applying the protective agent on the photoconductor for 15 minutes, and the peak area ratio "Sb2/Sa2" can be set 38 or less after applying the protective agent on the photoconductor for 120 minutes, wherein such value indicate that an application amount of the protective agent to the photoconductor is in good level.

In an exemplary embodiment, the protective layer setting unit uses a protective agent having paraffin as main component, for example. Such paraffin includes normal paraffin, and isoparaffin, for example, which can be used alone or in combination. In an exemplary embodiment, a protective agent, used as a protective agent bar, includes paraffin with 50 wt % (weight percent) or more, more preferably 60 wt % or more, and further preferably 70 wt % or more, for example. If the paraffin amount included in the protective agent is too small, a photoconductor may not be effectively protected by the protective agent, by which the photoconductor may be abraded during image forming, which is not preferable. If the paraffin amount included in the protective agent is too great, the photoconductor surface may not be effectively coated by paraffin, which is not preferable. In general, it is difficult to form a uniform thin layer of paraffin on a photoconductor by using a brush or blade pressure if only paraffin is used as a protective agent. Therefore, a protective agent may need to include paraffin and other material.

Such other material may be amphipathic organic compound; hydrocarbons, such as aliphatic unsaturated hydrocarbon, alicyclic saturated hydrocarbon (e.g., cyclo paraffin, cyclic polyolefin), alicyclic unsaturated hydrocarbon, aromatic hydrocarbon; fluorocarbon polymer or wax, such as PTFE (polytetrafluoroethylene), PFA (perfluoroalkoxy), FEP (fluorinated ethylene-propylene), PVDF (polyvinylidene fluoride), ETFE (Ethylene tetrafluoroethylene); silicone polymer or wax, such as polymethyl silicone, polymethylphenyl silicone; inorganic compound having lubricating property, such as mica isinglass, but not limited to these. Among these, amphipathic organic compound and alicyclic saturated hydrocarbon are preferably included in a protective agent to enhance an application performance of protective agent, and alicyclic saturated hydrocarbon, such as cyclic polyolefin is preferably used to form a uniform layer of protective agent on a photoconductor. These materials can be used alone or in combination.

Such amphiphilic organic compound may be anionic surfactant, cationic surfactant, zwitterionic surfactant, nonionic surfactant, or a complex compound of these, for example. Because a protective agent is applied to a photoconductor used for image forming, such protective agent may need to have a property that does not cause a problem on electric property of the photoconductor. The nonionic surfactant, which is an amphiphilic organic compound, may not be ionic dissociated, and thereby electric charge leak by aerial discharge can be reduced and image quality can be maintained at a higher level even if environmental condition, such as humidity, changes greatly.

The nonionic surfactant may preferably be an ester compound of alkylcarboxylic acid (see chemical formula (1)) and polyalcohol, in which "n" is an integral number from 15 to 35.

$$C_nH_{2n+1}COOH \qquad \text{(chemical formula(1))}$$

If a straight chain alkylcarboxylic acid is used as alkylcarboxylic acid (chemical formula(1)), amphiphilic organic compound can be preferably adhered on a surface of an image carrying member such as photoconductor. Specifically, hydrophobicity portion of the amphiphilic organic compound can be oriented to a surface of an image carrying member in an orderly manner, and thereby the amphiphilic organic compound can be preferably adsorbed on the image carrying with a higher adsorption density.

Alkylcarboxylic acid ester has hydrophobicity. The greater the number of alkylcarboxylic acid ester in one molecule, the more effective to reduce an adsorption of dissociated material generated by aerial discharge to a surface of an image carrying member such as photoconductor, and the more effective to reduce a electrical stress to a surface of the image carrying member during a charging process. However, if a ratio of alkylcarboxylic acid ester becomes too great, polyalcohol having hydrophilicity may be blocked by the alkylcarboxylic acid ester, by which an adsorption performance may not be effectively obtained depending on a surface condition of an image carrying member. Accordingly, the average number of ester bond in one molecule of amphiphilic organic compound may be preferably from 1 to 3.

Such average number of ester bond in one molecule of amphiphilic organic compound can be set or adjusted by selecting one amphiphilic organic compound or by mixing a plurality of amphiphilic organic compounds, each compound having different number of ester bonds. Such amphiphilic organic compound may include anionic surfactant, cationic surfactant, zwitterionic surfactant, and nonionic surfactant, as above described.

Examples of the anionic surfactant include compounds of alkali metal ion (e.g., sodium, potassium), alkaline-earth metal ion (e.g., magnesium, calcium), metal ion (e.g., aluminum, zinc), or ammonium ion bonded with a compound having an anion at hydrophobicity portion, such as alkyl benzene sulfonate, α-olefin sulfonate, alkane sulfonate, sulfuric alkyl salt, sulfuric alkylpolyoxyethylene salt, alkyl phosphate salt, long-chain aliphatic acid salt, α-sulfoaliphatic acid ester salt, and alkyl ether sulfate.

Examples of the cationic surfactant include compounds composed of chlorine, fluorine, bromine, phosphoric ion, nitrate ion, sulphuric ion, thiosulphuric ion, carbonate ion, and hydroxide ion, which are bonded to a compound having a cation at hydrophobicity portion, such as alkyltrimethyl ammonium salt, dialkylmethyl ammonium salt, and alkyldimethylbenzyl ammonium salt.

Examples of the zwitterionic surfactant include dimethylalkylamine oxide, N-alkylbetaine, imidazoline derivatives, and alkylamino acid.

Examples of the nonionic surfactant include alcohol compound, ether compound, or amide compound, such as long-chain alkylalcohol, alkylpolyoxyethylene ether, polyoxyethylene alkyl phenyl ether, aliphatic acid diethanolamide, alkyl polyglucoxide, and polyoxyethylene sorbitan alkylester. Further, examples of the nonionic surfactant preferably include long-chain alkylcarboxylic acid, such as lauric acid, paltimic acid, stearic acid, behenic acid, lignoceric acid, cerinic acid, montanic acid, melissic acid; polyalcohol, such as ethylene glycol, propylene glycol, glycerin, erythritol, hexitol; and ester compound having partially anhydride compound of these.

Examples of ester compounds include alkylcarboxylic acid glyceryl or its substitution, such as monoglyceryl stearate, diglyceryl stearate, monoglyceryl palmitate, diglyceryl laurate, triglyceryl laurate, diglyceryl palmitate, triglyceryl palmitate, diglyceryl myristate, triglyceryl myristate, glyceryl palmitate/stearate, monoglyceryl arachidate, diglyceryl arachidate, monoglyceryl behenate, glyceryl stearate/behenate, glyceryl cerinate/stearate, monoglyceryl montanate, monoglyceryl melissate; and alkylcarboxylic acid sorbitan or its substitution, such as monosorbitan stearate, trisorbitan stearate, monosorbitan palmitate, disorbitan palmitate, trisorbitan palmitate, disorbitan myristate, trisorbitan myristate, sorbitan paltimate/stearate, monosorbitan arachidate, disorbitan arachidate, monosorbitan behenate, sorbitan stearate/behenate, sorbitan cerinate/stearate, monosorbitan montanate, monosorbitan melissate, but not limited those. These amphiphilic organic compound can be used alone or in combinaton.

Further, the protective agent may be included with filler, such as metal oxides, silicate compound, mica isinglass, boron nitride, as required.

Figure 9:
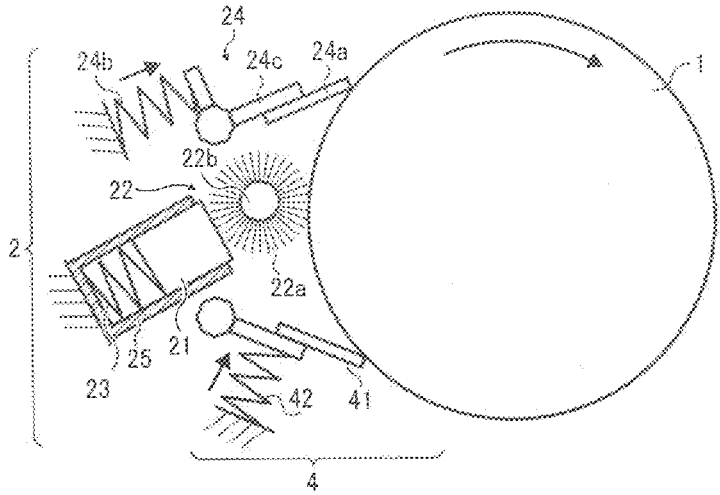
FIG. 9 illustrates a schematic configuration of a protective layer setting unit according to an exemplary embodiment, which is used in an image forming engine.

A description is now given to a configuration of a protective layer setting unit according to an exemplary embodiment. FIG. 9 illustrates a schematic configuration of an image forming engine, in which a protective layer setting unit 2 is schematically shown with a photoconductor drum 1 used as an image carrying member and a cleaning unit 4. The protective layer setting unit 2 is opposed to the photoconductor drum 1. The protective layer setting unit 2 includes an agent bar 21, an agent applicator 22, a biasing force applicator 23, a layer adjusting unit 24, and a support guide 25, for example.

The agent bar 21 may be a block of protective agent, which may be made by melting and/or compressing a protective agent in a given shape such as bar shape (e.g., circular, quadrangular, hexagonal shape). Such protective layer setting unit 2 can be used as an "application unit" for applying a protective agent onto the photoconductor drum 1. The agent applicator 22 includes a brush 22*a* that contacts the agent bar 21 and supplies the protective agent to the photoconductor drum 1. The biasing force applicator 23 presses the agent bar 21 against the brush 22*a* of the agent applicator 22 to transfer the protective agent to the brush 22*a*. The layer adjusting unit 24 is used to form a thin layer of the protective agent on the photoconductor. The support guide 25 supports the agent bar 21 so as to prevent shaking of the agent bar 21. In an exemplary embodiment, the agent bar 21 can be prepared by a melt-casting method or a compression casting method. In the melt-casting method, a protective agent is melted and poured in a cast, and then cooled. In the compression casting method, powder of protective agent is compressed. The cleaning unit 4 includes a cleaning member 41, and a biasing device 42, for example.

The agent bar 21 is pressed against the brush 22*a* of the agent applicator 22 using a biasing force of the biasing force applicator 23 to transfer the protective agent from the agent bar 21 to the brush 22*a*, wherein the agent applicator 22 may be formed as brush roller, and the biasing force applicator 23 may include a spring, for example. The agent applicator 22, rotating at a given speed having a different linear velocity with respect to the photoconductor drum 1, slidably contacts the photoconductor drum 1 to apply the protective agent to the surface of the photoconductor drum 1 from the brush 22*a*, which has the protective agent transferred from the agent bar 21. The protective agent supplied to the photoconductor drum 1 may be indefinite-shaped particles. Depending on material types of protective agent, a protective layer may not be effectively and uniformly formed on the photoconductor drum 1 just by applying the protective agent. In light of such situation, the layer adjusting unit 24 having a layer forming device 24*a* and a biasing member 24*b* is used to form a protective layer uniformly on the photoconductor drum 1. The layer forming device 24*a* may be a blade (hereinafter, blade 24*a*), and the biasing member 24*b*, such as spring, presses the blade 24*a* against the photoconductor drum 1.

With such configuration, the photoconductor drum 1 can be supplied with a protective agent sufficiently, and a uniform protective layer can be effectively formed on the photoconductor drum 1 by the layer adjusting unit 24. Accordingly, a contamination caused by a charging device, such as charge roller, may be reduced, and thereby abnormal image may not be produced. Further, replacement of consumable parts can be reduced, and higher quality image can be produced over time.

Instead of using the agent bar 21, powders of protective agent can be directly supplied to a surface of the photoconductor drum 1. In this case, the agent bar 21, the agent applicator 22, and the biasing force applicator 23 can be omitted from the process cartridge PC, and a container for containing powders of protective agent and a powder transport unit for transporting protective agent powders are disposed. The powder transport unit may be a known transport unit, such as pump, auger, or the like.

The blade 24*a* may be made of a known elastic body, such as urethane rubber, hydrin rubber, silicone rubber, fluorocarbon rubber, or the like, which can be used alone or mixed. Such blade 24*a* may be coated with a material having a lower frictional coefficient to reduce friction at a contact portion with the photoconductor drum 1, wherein the blade 24*a* may be coated with such material by a dipping method or the like. Further, to adjust hardness of the elastic body, fillers such as organic filler or inorganic filler can be dispersed in the elastic body.

Such blade 24*a* is fixed to a blade supporter 24*c* using adhesive or fused directly to the blade supporter 24*c* so that a leading edge of the blade 24*a* can be effectively pressed against the photoconductor drum 1 with a given pressure. The blade 24*a* has a thickness of from 0.5 mm to 5 mm, and preferably from 1 mm to 3 mm, for example, wherein the thickness of the blade 24*a* is determined in view of pressure biased to the blade 24*a*. The blade 24*a* has a free length portion of from 1 mm to 15 mm, and preferably from 2 mm to 10 mm, for example, wherein the free length of the blade 24*a* is also determined in view of pressure biased to the blade 24*a*. The free length portion is a flexibly bend-able portion, not attached to the blade supporter 24*c*.

Alternatively, the blade 24*a* can be made of a resilient metal and an elastic material formed on the resilient metal by a coating method or a dipping method using a coupling agent or a primer component. Further, a thermosetting process may be conducted for such blade 24*a* made of a resilient metal and an elastic material. Further, such blade 24*a* may be subjected to a surface polishing process. The resilient metal may be a sheet spring, and the elastic material may be resin, rubber, elastomer, or the like. The resilient metal has a thickness of from 0.05 mm to 3 mm, and preferably from 0.1 mm to 1 mm, for example. Further, the blade 24*a* made from the resilient metal may be bended in a direction parallel to a support direction after fixing the blade 24*a* to the blade supporter 24*c* to prevent twisting of the blade 24*a*. The surface layer of the blade 24*a* may be fluorocarbon polymer, such as PFA (perfluoroalkoxy), PTFE (polytetrafluoroethylene), FEP (fluorinated ethylene-propylene), PVDF (polyvinylidene fluoride), fluorocarbon rubber; and silicone elastomer, such as methylphenyl silicone elastomer, but not limited to these. These can be used alone or used with filler material, as required.

Further, the blade 24*a* may be pressed against the photoconductor drum 1 by the biasing member 24*b* with a linear load of preferably from 5 gf/cm to 80 gf/cm, more preferably from 10 gf/cm to 60 gf/cm, which is effective for extending and forming a protective layer on the photoconductor drum 1.

A description is now given to the agent applicator 22. The agent applicator 22 may preferably be a brush roller having a number of brush fibers (i.e., brush 22*a*), used for supplying a protective agent to the photoconductor drum 1. Such brush fibers (i.e., brush 22*a*) have a given level of flexibility to reduce or reduce mechanical stress to be applied to a surface of the photoconductor drum 1.

Such brush fibers having some flexibility may be made of known materials having flexibility, such as polyolefin resin (e.g., polyethylene, polypropylene); polyvinyl resin and polyvinylidene resin (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone); copolymer of polyvinyl chloride/vinyl acetate; copolymer of styrene/acrylic acid; styrene/butadiene resin; fluorocarbon polymer (e.g., polytetrafluoroethylene, polyvinyl fluoride, polyvinylidene fluoride, polychlorotrifluoroethylene); polyester; nylon; acrylic; rayon; polyurethane; polycarbonate; phenol resin; and amino resin (e.g., urea/formaldehyde resin, melamine resin, benzog anamine resin, urea resin, polyamide resin), for example. Such materials can be used alone or in combination. Further, to adjust flexibility of brush fibers, diene rubber, styrene-butadiene rubber (SBR), ethylene-propylene rubber, isoprene rubber, nitrile rubber, urethane rubber, silicone rubber, hydrin rubber, and norbomene rubber, or the like can be added.

Such brush 22*a* used as the agent applicator 22 have a core metal 22*b* and brush fibers formed on the core metal 22*b* by winding brush fibers in a spiral manner, for example. Such brush fibers may have a fiber diameter of from 10 μm to 500 μm, and more preferably from 20 μm to 300 μm. If the fiber diameter is too small, a supplying or applying speed of a protective agent becomes too slow.

If the fiber diameter is too great, the number of brush fibers per unit area becomes small, by which brush fibers may not contact the photoconductor drum 1 uniformly. If the brush fibers do not contact the photoconductor drum 1 uniformly, a protective agent may not be uniformly applied to a surface of the photoconductor drum 1. Further, if the fiber diameter is too great, brush fibers may be more likely to cause damages to the photoconductor drum 1. Further, if the fiber diameter is too great, brush fibers may scrape a protective agent with a greater force, by which a lifetime of the protective agent becomes shorter. Further, if the fiber diameter is too great, brush fibers may supply a protective agent having relatively larger sized particles to the photoconductor drum 1, by which such particles may adhere and contaminate a charge roller. Further, if the fiber diameter is too great, a greater torque may be required to rotate the brush roller or the photoconductor drum 1, which is not preferable.

Such brush fiber has a fiber length of from 1 mm to 15 mm, and more preferably from 3 mm to 10 mm. If the length of brush fiber is too small, the core metal of the agent applicator 22 may be disposed too close to the photoconductor drum 1, by which the core metal 22*b* may contact and cause damages to the photoconductor drum 1, which is not preferable. If the length of brush fiber is too great, brush fibers may scrape a protective agent with a smaller force and brush fibers may contact the photoconductor drum 1 with a smaller force, in which the protective agent may not be effectively applied to the photoconductor drum 1 and the brush fibers may be more likely to drop from the core metal 22*b*, which are not preferable.

Such brush fiber has a fiber density of 10,000 to 300,000 fibers per square inch (or $1.5\times10^7$ to $4.5\times10^8$ fibers per square meter). If the fiber density is too small, a protective agent may not be uniformly applied to a surface of the photoconductor drum 1, or the protective agent may not be effectively applied to the photoconductor drum 1, which are not preferable. If the fiber density is too great, a diameter of brush fiber may need to be set to a significantly smaller size, which is not preferable.

Such brush roller preferably has a higher fiber density to uniformly and reliably apply a protective agent to the photoconductor drum 1, in which one brush fiber may be preferably made of a bundle of tiny fibers such as several to hundreds of tiny fibers. For example, one brush fiber may be composed of a bundle of 50 tiny fibers, in which one tiny fiber has 6.7 decitex (6 denier) and a bundle of 50 filaments has a value of 333 decitex computed by a equation of 6.7 decitex×50 filament (or 300 denier=6 denier×50 filament).

Such brush fiber is preferably made of single fiber having a diameter of 28 μm to 43 μm, more preferably 30 μm to 40 μm, to effectively and efficiently supply a protective agent. Because brush fibers are generally made by twisting fibers, brush fibers may not have a uniform fiber diameter, and thereby a unit of "denier" and "decitex" are used in general. However, if a single fiber is used as one brush fiber, brush fibers have a uniform fiber diameter, and thereby brush fibers may be preferably defined by a fiber diameter. If the single fiber has too small diameter, a protective agent may not be efficiently supplied, which is not preferable. If the single fiber has too great diameter, the single fiber has too great stiffness, by which the photoconductor drum 1 may be damaged, which is not preferable.

Further, such single fiber having a diameter of 28 μm to 43 μm is preferably implanted to a surface of the core metal 22*b* in a perpendicular direction, and electrostatic implantation method using electrostatic force may be preferably used to implant brush fibers on the core metal. In an electrostatic implantation method, an adhesive agent is applied to the core metal 22*b*, and then the core metal 22*b* is charged. Under such charged condition, a number of single fibers are dispersed in a space using electrostatic force, and then implanted on the core metal 22*b* applied with the adhesive agent. The adhesive agent is hardened after such implantation to form a brush roller. As such, a brush roller having a fiber density of 50,000 to 600,000 fibers per square inch can be made by an electrostatic implantation method.

Further, such brush fiber (i.e., brush 22*a*) may have a coat layer on a surface of fiber, as required, to stabilize a surface shape and fiber property against environmental effect, for example. The coat layer may be made of material, which can change its shape when brush fibers flex. Such material having flexibility may be polyolefin resin (e.g., polyethylene, polypropylene, chlorinated polyethylene, chlorosulfonated polyethylene); polyvinyl and polyvinylidene resin such as polystyrene, acrylic resin (e.g., polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone; copolymer of polyvinyl chloride/vinyl acetate; silicone resin or its modified compound having organosiloxane bonding (e.g., modified compound of alkyd resin, polyester resin, epoxy resin, polyurethane); fluorocarbon resin, such as perfluoro alkylether, polyfluorovinyl, polyfluorovinylvinyliden, polychlorotrifluoroethylene; polyamide; polyester; polyurethane; polycarbonate; amino resin, such as urea/formaldehyde resin; and epoxy resin, for example. These materials can be used alone or in combination.

Hereinafter, a process cartridge (or image forming engine) according to an exemplary embodiment is explained with reference to FIG. 10. The process cartridge according to an exemplary embodiment includes the above described photoconductor applied with a protective agent, a charging unit for uniformly charging the photoconductor, a developing unit for developing a latent image formed on the surface of photoconductor as toner image using a developing agent having toner, and a protective layer setting unit used for applying the protective agent to the photoconductor.

Specifically, the process cartridge 10 may be termed as an image forming engine 10. FIG. 10 illustrates a schematic configuration of the image forming engine 10, which includes the photoconductor drum 1, the protective layer setting unit 2, a charge roller 3, the cleaning unit 4, and a development unit 5, for example. Such image forming engine 10 may be disposed proximity to a transfer roller 6 and a intermediate transfer member 7, such as transfer belt. The photoconductor drum 1 can be supplied with a protective agent as above-described using the protective layer setting unit 2, which is disposed between the cleaning unit 4 and the charge roller 3. The cleaning unit 4 removes toner remaining on the photoconductor drum 1 after an image transfer process. In an exemplary embodiment, the cleaning unit 4 cleans the photoconductor surface before applying the protective agent to the photoconductor drum 1 to apply the protective agent at a good surface condition. Accordingly, the cleaning unit 4 may be one part of the protective layer setting unit 2.

The charge roller 3 may use a direct current charging method or an AC charging method, but preferably use the AC charging method, which superimposes direct-current voltage on alternating-current voltage using a high voltage power source (not shown).

The development unit 5 includes a developing roller 51, and agitation transport screws 52 and 53, for example. The developing roller 51 carries and transports a developing agent, such as one-component developing agent not having carrier, and two-component developing agent having toner and carrier, and the agitation transport screws 52 and 53 agitate and transport the developing agent. As above described with reference to FIG. 9, the protective layer setting unit 2 includes the agent bar 21, the agent applicator 22, the biasing force applicator 23, the layer adjusting unit 24, and the support guide 25, for example.

After conducting a transfer process, partially degraded protective agent or toner remaining on the surface of the photoconductor drum 1 can be cleaned by the cleaning member 41, supported by the biasing device 42 of the cleaning unit 4. The cleaning member 41 may have a blade shape, for example. In FIG. 9, the cleaning member 41 is angled and contacted to the photoconductor drum 1 in a counter direction. Although the blade 24*a* of the layer adjusting unit 24 is angled and contacted to the photoconductor drum 1 in a trailing direction, the blade 24*a* can be angled and contacted to the photoconductor drum 1 in a counter direction.

After the photoconductor surface is cleaned by the cleaning unit 4, new protective agent is supplied to the photoconductor surface by the agent applicator 22, and the protective agent is extended on photoconductor surface as a thin protective layer by the blade 24*a* of the layer adjusting unit 24. The protective agent used in an exemplary embodiment can be absorbed well to a higher hydrophilic portion of the photoconductor surface, wherein the hydrophilic portion is caused by electrical stress. Accordingly, even if the photoconductor surface is partially degraded by greater electrical stress, which may occur temporarily, degradation of the photoconductor can be reduced or lessened by absorption of the protective agent on the photoconductor.

After the charge roller 3 charges the photoconductor drum 1 supplied with a protective layer, an optical writing unit (not shown) irradiates a laser beam L to the photoconductor drum 1 to form a latent image on the photoconductor drum 1, and then the latent image is developed by toner supplied by the development unit 5 as a toner image, which is transferred to the intermediate transfer member 7 by using the transfer roller 6.

In an exemplary embodiment, the process cartridge 10 includes a charging unit using corona discharge, scorotron charging, or a charge roller. From a viewpoint of reducing a size of apparatus and oxidizing gas generation, such as ozone, a charge roller is preferably used. The charge roller 3 may contact the photoconductor drum 1 or may be disposed opposite to the photoconductor drum 1 across a gap, such as 20 μm to 100 μm. Such charge roller 3, supplied with a given voltage, charges the photoconductor drum 1. The charge roller 3 charges the photoconductor drum 1 with a direct-current voltage (referred as DC charging), or a superimposed voltage superimposing a given alternating voltage to a direct-current voltage (referred as AC charging), for example. In the AC charging method, electric discharges are repeatedly occurred between the photoconductor drum 1 and the charge roller 3 for thousands of times per second, and thereby the photoconductor drum 1 may receive damages during a charging process. In view of such damages, a protective agent may be constantly applied to the photoconductor drum 1 to protect the photoconductor drum 1 from an effect of the AC charging because the protective agent may be degraded or decomposed during a charging process.

The charge roller 3 may be preferably configured with a conductive supporter, a polymer layer, and a surface layer. The conductive supporter, used as a supporter and an electrode of the charge roller 3, is made of a conductive material, such as metal or metal alloy (e.g., aluminum, cupper alloy, stainless steel), metal (e.g., iron) coated with chrome or nickel, or resin added with a conductive material, for example.

The polymer layer may be a conductive layer having a given resistance, such as from $10^6$ Ωcm to $10^9$ Ωcm, in which a conductive agent is added in a polymeric material to adjust a resistance. Such polymeric material may be thermoplastic elastomer, such as polyester, polyolefin; thermoplastic resin having styrene, such as polystyrene, copolymer of styrene/butadiene, copolymer of styrene/acrylonitrile, copolymer of styrene/butadiene/acrylonitrile; rubber material, such as isoprene rubber, chloroprene rubber, epichloro hydrin rubber, butyl rubber, urethane rubber, silicone rubber, fluorocarbon rubber, styrene/butadiene rubber, butadiene rubber, nitrile rubber, ethylene-propylene rubber, epichlorohydrin/ethyleneoxide copolymer rubber, epichlorohydrin/ethyleneoxide/allylglycidyl ether copolymer rubber, ethylene/propylene/dien copolymer rubber(EPDM), acrylonitrile/butadiene copolymer rubber, natural rubber, and rubber mixing these rubber materials. Among the rubber materials, silicone rubber, ethylene/propylene rubber, epichlorohydrin/ethyleneoxide copolymer rubber, epichlorohydrin/ethyleneoxide/allylglycidyl ether copolymer rubber, acrylonitrile/butadiene copolymer rubber, and rubber mixing these rubber materials are preferably used. Such rubber materials may be foamed rubber or unfoamed rubber.

The conductive agent may be an electronic conductive agent, or an ion conductive agent, for example. The electronic conductive agent may be fine powders of carbon black, such as ketjen black, acetylene black; thermal decomposed carbon, graphite; conductive metal or alloy, such as aluminum, cupper, nickel, stainless steel; conductive metal oxide, such as tin oxide, indium oxide, titanium oxide, tin oxide/antimony oxide solid solution, tin oxide/indium oxide solid solution; and surface-treated insulation material having conductivity, for example. The ion conductive agent may be perchlorate or chlorate of tetraethyl ammonium or lauryl trimethyl ammonium; and perchlorate or chlorate of alkali metal or alkaline-earth metal, such as lithium, magnesium, for example. Such conductive agents may be used alone or in combination.

Although such conductive agents may be added to a polymeric material with a given amount, the electronic conductive agent is added to a 100 weight part of polymeric material for a range of 1 to 30 weight part, and more preferably a range of 15 to 25 weight part, and the ion conductive agent is added to a 100 weight part of polymeric material for a range of 0.1 to 5.0 weight part, and more preferably a range of 0.5 to 3.0 weight part.

The surface layer of the charge roller 3, composed of polymeric material, may have a dynamic ultra-micro hardness of from 0.04 to 0.5, for example. Such polymeric material may be polyamide, polyurethane, polyvinylidene fluoride, copolymer of ethylene tetrafluoride, polyester, polyimide, silicone resin, acrylic resin, polyvinyl butyral, copolymer of ethylene tetrafluoroethylene, melamine resin, fluorocarbon rubber, epoxy resin, polycarbonate, polyvinyl alcohol, cellulose, polyvinylidene chloride, polyvinyl chloride, polyethylene, copolymer of ethylene vinyl acetate, or the like, for example. From a viewpoint of separation performance with toner, polyamide, polyvinylidene fluoride, copolymer of ethylene tetrafluoride, polyester, and polyimide are preferably used. Such polymeric materials can be used alone or in combination. Such polymeric material has a number average molecular weight, preferably in a range of 1,000 to 100,000, and more preferably in a range of 10,000 to 50,000, for example.

The surface layer is formed by mixing the polymeric material, the conductive agent, and fine powders. The fine powders may be metal oxide or complex metal oxide, such as silicon oxide, aluminum oxide, barium titanate, or polymer powder of tetrafluoroethylene, vinylidene fluoride, for example, but not limited thereto. Such fine powders can be used alone or in combination.

Figure 10:
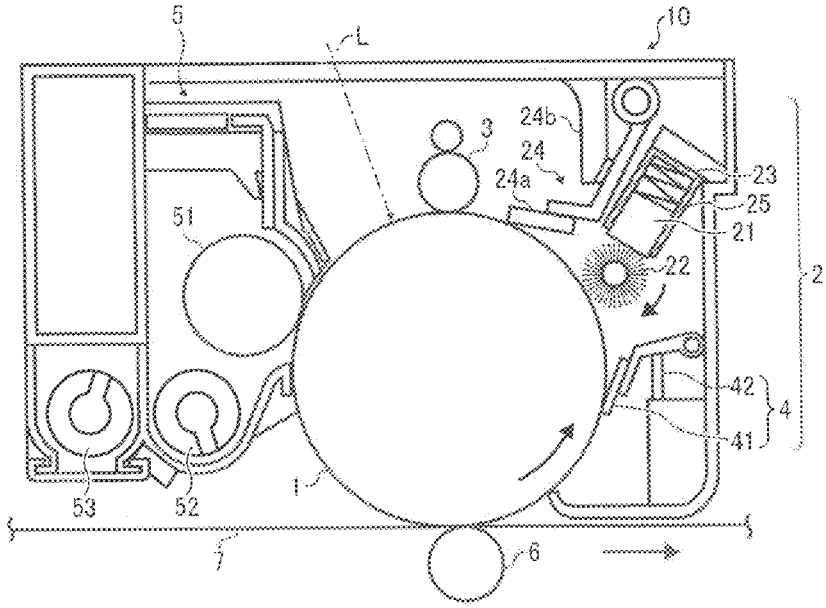
FIG. 10 illustrates a schematic cross-sectional view of a process cartridge having a protective layer setting unit according to an exemplary embodiment.

A description is given to a development unit used in a process cartridge according to an exemplary embodiment with reference to FIG. 10. The process cartridge 10 includes a development unit to develop a latent image formed on the photoconductor drum 1 as a toner image using a developing agent. Such developing agent may be one-component developing agent not having carrier, and two-component developing agent having toner and carrier. As shown in FIG. 10, the development unit 5 includes the developing roller 51 used as a developing agent carrier, partially exposed to the photoconductor drum 1 through an opening of a casing of the development unit 5.

Toner particles supplied to the development unit 5 from a toner bottle (not shown) are agitated with carrier particles and transported by the agitation transport screws 52 and 53, and then carried on the developing roller 51, which includes a magnet roller and a developing sleeve, wherein the magnet roller generates a magnetic field, and the developing sleeve coaxially rotates around the magnet roller. Chains of carrier particles of the developing agent accumulate on the developing roller 51 with an effect of magnetic force of the magnet roller, and then transported to a developing section facing the photoconductor drum 1. The developing roller 51 may rotate at a linear velocity greater than a linear velocity of the photoconductor drum 1 at the developing section, for example. Chains of carrier particles accumulated on the developing roller 51 contact a surface of the photoconductor drum 1, and supply toner particles adhered on the carrier surface to the surface of the photoconductor drum 1. At this time, the developing roller 51 is supplied with a developing bias from a power source (not shown) to form a developing electric field at the developing section. In such developing electric field, toner particles move from the developing roller 51 to a latent image on the photoconductor drum 1, and adhere the latent image. Such toner adhesion to the latent image of the photoconductor drum 1 generates a toner image of each color.

Figure 11:
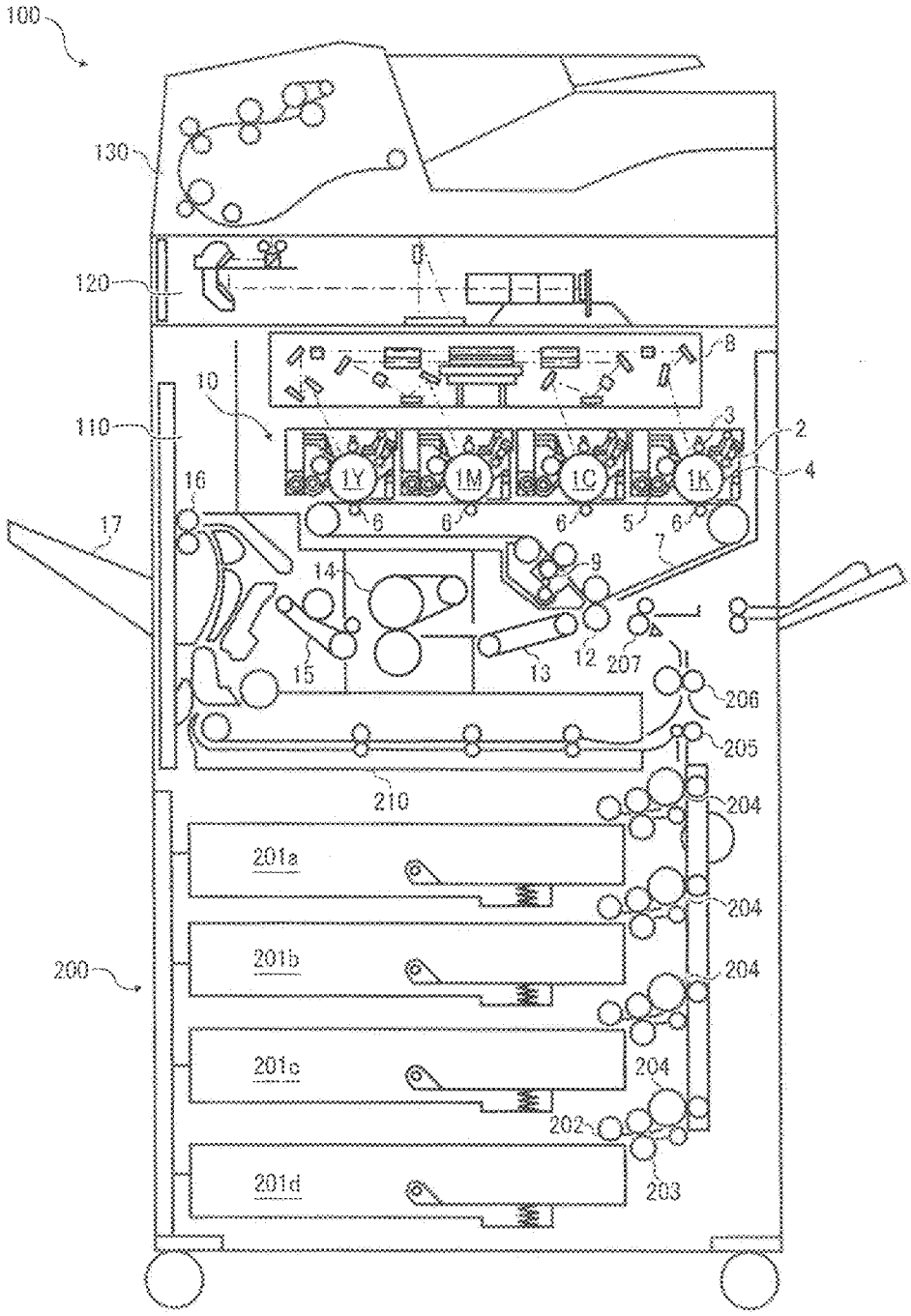
FIG. 11 illustrates a schematic cross-sectional view of an image forming apparatus having a protective layer setting unit according to an exemplary embodiment.

A description is now given to an image forming apparatus according to an exemplary embodiment with reference to FIG. 11. FIG. 11 illustrates a schematic cross-sectional view of an image forming apparatus 100 employing the protective layer setting unit 2 according to an exemplary embodiment. The image forming apparatus 100 includes an image forming unit 110, a scanner 120, an automatic document feeder (ADF) 130, and a sheet feed unit 200, for example. The image forming unit 110 conducts an image forming. The scanner 120 is disposed over the image forming unit 110, and the ADF 130 is disposed over the scanner 120. The sheet feed unit 200 is disposed under the image forming unit 110. The image forming apparatus 100 may have and communication function with an external device, such as personal computer or the like, in which the image forming apparatus 100 can be used as a printer or a scanner. The image forming apparatus 100 may also have a facsimile function, in which the image forming apparatus 100 can be used as a facsimile by connecting the image forming apparatus 100 with a telephone line or optical fiber line.

The image forming unit 110 includes four image forming engines 10 having a similar configuration one another except colors of toner used in the development unit 5. Each of the image forming engines 10 respective toner color image, such as yellow(Y), magenta(M), cyan(C), black(K) color image, and such toner images are transferred to a transfer sheet or an intermediate transfer member to form a full color image. In FIG. 11, the image forming engines 10 are tandemly arranged over the intermediate transfer member 7, extended by rollers, in which the toner images formed by the image forming engines 10 are transferred to the intermediate transfer member 7, and then transferred to a transfer sheet using a secondary transfer unit 12.

The image forming engine 10 has a configuration similar to a configuration shown in FIG. 10, wherein photoconductor drum 1 is surrounded by the protective layer setting unit 2, the charge roller 3, the optical writing unit 8, the development unit 5, the transfer roller 6, and the cleaning unit 4. The image forming engine 10 may be used as the process cartridge 10 as similar to FIG. 10. Such process cartridge 10 is detachably mountable to the image forming unit 110.

A description is now given to an image forming apparatus according to an exemplary embodiment with reference to FIG. 11. Hereinafter, an image forming process using negative/positive process is described.

The photoconductor drum 1 may be an OPC (organic photoconductor) having an organic photoconductive layer, which is de-charged by a decharging lamp (not shown) to prepare for an image forming operation. Such photoconductor drum 1 is uniformly charged to a negative charge by the charge roller 3. Such charge unit 3 is applied with a given voltage, such as direct current voltage superimposed with alternating-voltage, from a voltage power source (not shown), in which such given voltage is used to charge the photoconductor drum 1 to a given potential.

The charged photoconductor drum 1 is then irradiated with a laser beam emitted from the optical writing unit 8 to form a latent image on the charged photoconductor drum 1, in which an absolute potential value of light-exposed portion becomes smaller than an absolute potential value of non-exposed portion. The laser beam, emitted by a laser diode, is reflected by a polygon mirror rotating at a high speed, and then scanned on the surface of the photoconductor drum 1 in an axial direction of the photoconductor drum 1.

Such formed latent image is then developed by a developing agent, supplied from a developing sleeve of the development unit 5, as a visible toner image. The developing agent may be toner-only component or a mixture of toner particles and carrier particles. When developing the latent image, a voltage power source (not shown) may supply a given developing bias voltage to the developing sleeve, wherein such developing bias voltage may be direct-current voltage or a voltage having direct-current voltage superimposed with alternating-current voltage having a voltage value, set between a potential of light-exposed portion and a potential of non-exposed portion of the photoconductor drum 1, for example.

The toner images formed on the photoconductor drum 1 are transferred to the intermediate transfer member 7 by the transfer roller 6, and such toner image is then transferred to a transfer medium such as a paper fed from the sheet feed unit 200. The sheet feed unit 200 has sheet cassettes 201*a*, 201*b*, 201*c*, 201*d*, a feed roller 202, a separation roller 203, transport rollers 204, 205, 206, and a registration roller 207. A transfer sheet is fed by the feed roller 202 and the separation roller 203 from one of the sheet cassettes 201 to the registration roller 207 via the transport rollers 204, 205, 206 at a given timing synchronized to a timing of image forming, such as primary transfer timing. Then, the registration roller 207 feed the transfer sheet to a secondary transfer nip. At the secondary transfer nip, the secondary transfer unit 12 transfers the toner images from the intermediate transfer member 7 to the transfer sheet. In such transfer process, the transfer roller 6 and the secondary transfer unit 12 are preferably supplied with a transfer bias voltage having a polarity opposite to a polarity of toner particles. Toner particles remaining on the photoconductor drum 1 are removed by the cleaning member 41, and then recovered in a toner recovery section in the cleaning unit 4. Toner particles remaining on the intermediate transfer member 7 are removed by a cleaning member of a belt cleaning unit 9, and then recovered in a toner recovery section in the belt cleaning unit 9.

The image forming apparatus 100 may have a plurality of the image forming engines 10 arranged in tandem along the intermediate transfer member 7. The plurality of image forming engines 10, form different toner color images, and sequentially transfer the toner color images to the intermediate transfer member 7, and then the toner color images are transferred to a transfer medium. Then, a transport unit 13 transports the transfer medium to a fixing unit 14 to fix toner images on the transfer medium by applying heat. After the fixing process, the transfer medium is ejected to a tray 17 by a transport unit 15 and an ejection roller 16. Further, the image forming apparatus 100 can print images on both face of a transfer medium. When printing images on both face, a transport route after the fixing unit 14 is switched to transport the transfer medium to an inverting unit 210 to invert the faces of the transfer medium, and then the transfer medium is fed to the secondary transfer nip by the transport roller 206 and the registration roller 207 to form an image on back face the transfer medium. Then, the transport unit 13 transports the transfer medium to the fixing unit 14 to fix toner images on the transfer medium, and the transfer medium is ejected to the tray 17.

Alternatively, toner color images can be transferred from the photoconductor drums 1Y, 1M, 1C, and 1K of the image forming engines 10 using a direct transfer method. Specifically, a transport belt is used instead of the intermediate transfer member 7, and toner color images are transferred from the photoconductor drums 1Y, 1M, 1C, and 1K to a transfer medium transported by the transport belt, and then the toner images is fixed on the transfer medium by a fixing unit.

In the image forming apparatus 100, the charge roller 3 preferably contacts the photoconductor drum 1 or is preferably disposed opposite to the photoconductor drum 1 across a tiny gap. Such charge roller 3 can preferably reduce oxidizing gas generation, such as ozone, compared to a corona discharge unit, such as corotron, scorotron charging using wire for discharge during a charging process. However, because electrical discharge occurs proximity to the photoconductor surface when such charge roller 3 is used, the photoconductor drum 1 receives greater electrical stress. In an exemplary embodiment, the protective layer setting unit 2 is used to apply a protective agent to the photoconductor drum 1, by which the photoconductor drum 1 can be protected from such electrical stress effectively and a degradation of the photoconductor drum 1 can be reduced or lessened over time. Accordingly, the image forming apparatus 100 can produce higher quality images over time while reducing variation of image quality caused by environmental condition or the like.

A description is now given to a photoconductor preferably used in an exemplary embodiment. The photoconductor used in an image forming apparatus is composed of a conductive support and a photosensitive layer provided thereon.

The photosensitive layer may be of a monolayer type in which a charge generation material and a charge transport material are mixed, or a forward lamination type in which a charge transport layer is provided on a charge generation layer, or a reverse lamination type in which a charge generation layer is provided on a charge transport layer. Further, a surface protective layer may be provided on the photosensitive layer to enhance physical strength, anti-abrasiveness, anti-gas property, cleaning performance and the like of the photoconductor. Further, a backing layer may be provided between the photosensitive layer and the conductive support. Further, each layer may be added with an appropriate amount of plasticizer, antioxidant, leveling agent and the like as required.

The conductive support of the photoconductor may have a drum shape prepared as below, for example. A cylindrically shaped plastic/paper is covered with a metal compound by vapor deposition or spattering to form the conductive support.

The metal compound may be aluminum, nickel, chromium, nichrome, copper, gold, silver, or platinum, or metal oxide, such as tin oxide or indium oxide, having conductivity of volume resistance of equal to or less than $10^{10}$ Ω·cm. Alternatively, a metal plate, such as aluminum, aluminum alloy, nickel, stainless, or a tube obtained by extruding or drawing the metal plate, is subjected to surface treatment such as grinding, super-finishing, polishing and the like to form the conductive support. As the drum-like support, those having a diameter ranging from 20 mm to 150 mm, preferably from 24 mm to 100 mm, more preferably from 28 mm to 70 mm can be used. Diameter of drum-like support of equal to or less than 20 mm is not preferable because arrangement of a charging device, a light exposure device, a development device, a transfer device, and a cleaning device around the drum is physically difficult, and diameter of drum-like support of equal to or more than 150 mm is not preferable because the size of image forming apparatus increases. When the image forming apparatus is of tandem type, in particular, the diameter is equal to or less than 70 mm, and preferably equal to or less than 60 mm because a plurality of photoconductors should be disposed. Also known conductive endless belts, such as nickel belt or stainless belt, may be used as a conductive support.

The backing layer of photoconductor for use in an exemplary embodiment may be a resin layer, a resin layer having white pigment, or a metal oxide layer obtainable by chemically or electrochemically oxidizing surface of conductive base, for example, and the resin layer having white pigment is preferred. Examples of the white pigment include metal oxide, such as titanium oxide, aluminum oxide, zirconium oxide, and zinc oxide, and among these, it is preferred to contain titanium oxide having excellent ability to prevent charges from being injected from the conductive base. Examples of the resin used in the backing layer include thermoplastic resin, such as polyamide, polyvinyl alcohol, casein, methyl cellulose; thermosetting resin, such as acryl, phenol, melamine, alkyd, unsaturated polyester, epoxy; and these may be used singly or in combination.

Examples of the charge generation material of photoconductor for use in an exemplary embodiment include organic pigments and dyes, such as azo pigments (e.g., monoazo pigments, bisazo pigments, trisazo pigments, tetrakisazo pigments), triarylmethane dyes, thiazine dyes, oxazine dyes, xanthene dyes, cyanine dyestuffs, styryl dyestuffs, pyrylium dyes, quinacridone dyes, indigo dyes, perylene pigments, polycyclic quinone pigments, bisbenzimidazole pigments, indathrone pigments, squarylium pigments, phthalocyanine pigments; and inorganic materials, such as serene, serene-arsenic, serene-tellurium, cadmium sulfide, zinc oxide, titanium oxide and amorphous silicon, and the charge generation material may be used singly or in combination of plural kinds. The backing layer of photoconductor may be composed of one layer or a plurality of layers.

Examples of the charge transport material of photoconductor for use in an exemplary embodiment include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives, and these may be used singly or in combination.

The binding resin used for forming the photosensitive layer of charge generation layer and charge transport layer include known thermoplastic resins, thermosetting resins, photosetting resins, and photoconductive resins having electric insulation. Examples of binding resin include thermoplastic resin, such as polyvinyl chloride, polyvinylidene chloride, vinyl chloride-vinyl acetate copolymer, vinyl chloride-vinyl acetate-maleic anhydride copolymdr, ethylene-vinyl acetate copolymer, polyvinyl butyral, polyvinyl acetal, polyester, phenoxy resin, (meth)acryl resin, polystyrene, polycarbonate, polyacrylate, polysulfone, polyethersulfone and ABS resin; thermosetting resin, such as phenol resin, epoxy resin, urethane resin, melamine resin, isocyanate resin, alkyd resin, silicone resin; thermosetting resin, such as thermosetting acryl resin; and photoconductive resin, such as polyvinyl carbazole, polyvinyl anthracene, polyvinylpyrene. These can be used alone or a mixture of plural kinds of binding resins can be used, but are not limited thereto. However, if the charge generation layer or charge transport layer is used as a top surface layer, the binding resin may use polycarbonate resin having a transparency to a light beam used for writing an image and a good level of insulation performance, physical strength, and adhesiveness.

As the antioxidant, those listed below may be used, for example.

Monophenol compound: 2,6-di-t-butyl-p-cresol, butylated hydroxy anisole, 2,6-di-t-butyl-4-ethylphenol, stearyl-β-(3,5-di-t-butyl-4-hydroxyphenyl)propionate, 3-t-butyl-4-hydroxyanisole or the like.

Bisphenol compound: 2,2'-methylene-biS-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) or the like.

Polymeric phenol compound: 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocopherols, or the like.

p-phenylenediamine: N-phenyl-N'-isopropyl-p-phenylene diamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, or the like.

Hydroquinone: 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone or the like.

Organic sulfur compound: Dilauryl-3,3'-thiodipropionate, distearyl-3,3'-thiodipropionate, ditetradecyl-3,3'-thiodipropionate, or the like.

Organic phosphor compound: Triphenyl phosphine, tri(nonylphenyl)phosphine, tri(dinonylphenyl)phosphine, tricresyl phosphine, tri(2,4-dibutylphenoxy)phosphine, or the like.

As the plasticizer, resin, such as dibutylphthalate and dioctylphthalate that is commonly used as a plasticizer, may be used, and an appropriate use amount is about 0 to 30 parts by weight, relative to 100 parts by weight of the binding resin.

Further, a leveling agent may be added to the charge transport layer. As the leveling agent, silicone oil, such as dimethyl silicone oil, methylphenyl silicone oil, and polymer or oligomer having perfluoroalkyl group as a side chain can be used, for example, and an appropriate use amount is about 0 to 1 part by weight, relative to 100 parts by weight of binding resin.

The surface layer of photoconductor is provided for improving or enhancing physical strength, abrasion resistance (or anti-abrasiveness), gas resistance (or anti-gas property), cleanability (or cleaning performance) of a photoconductor. As the surface layer, those of polymer having higher physical strength than the photosensitive layer, and those of polymer in which inorganic fillers are dispersed can be exemplified. The polymer used for the surface layer may be any polymers including thermoplastic polymers and thermosetting polymers, and thermosetting polymers are particularly preferred because they have high physical strength and a good ability of reducing abrasion, which may occur when frictioned with a cleaning blade. The surface layer may not need to have charge transport ability insofar as it has a smaller film thickness. However, when a thicker surface layer not having charge transport ability is formed, a photoconductor may decrease its photosensitivity, increase its post-exposure potential, and increase its residual potential. Therefore, it is preferred to contain the charge transport material in the surface layer or to use polymer having charge transport ability for the surface layer. In general, the photosensitive layer and the surface layer have physical strength, which are greatly different each other. When the surface layer is abraded and disappeared due to friction with a cleaning blade, the photosensitive layer will be also abraded in soon. Therefore, when providing a surface layer, the surface layer has a sufficient film thickness, ranging from 0.1 μm to 12 μm, preferably ranging from 1 μm to 10 μm, and more preferably from 2 μm to 8 μm. Film thickness of surface layer of equal to or less than 0.1 μm is not preferred because it is so thin that partial disappearance is likely to occur due to friction with a cleaning blade, and abrasion of photosensitive layer proceeds from the disappeared part. Film thickness of surface layer of equal to or more than 12 μm is not preferred because such thicker surface layer may decrease photosensitivity, increase post-exposure potential, and increase residual potential for a photoconductor, and if polymer having charge transport ability and relatively high price is used for surface layer, a cost of photoconductor becomes higher, which is not preferable.

As the polymer used in the surface layer of the photoconductor, polycarbonate resin having transparency to a light beam at the time of an image writing, excellent insulation, physical strength, and adhesiveness is preferred.

To enhance a physical strength of a surface layer, the surface layer may be dispersed with fine powders of metal component, metal oxide, or the like. Examples of the metal oxide include tin oxide, potassium titanate, titanium oxide, zinc oxide, indium oxide, and antimony oxide, or titanium nitride. Further, to enhance an anti-abrasiveness of a surface layer, the surface layer may be added with fluorocarbon resin, such as polytetrafluoroethylene, silicone resin, or compounds of these resins having dispersed inorganic materials, for example.

In an exemplary embodiment, photoconductor drums and an intermediate transfer member are used as image carrying member, in which toner images formed on photoconductors are transferred to the intermediate transfer member, and then the toner images are transferred to a transfer medium.

The intermediate transfer member may be preferably made of a conductive material having a volume resistance from $10^5$ Ω·cm to $10^{11}$ Ω·cm, and a surface resistance from $5\times10^{10}$ Ω/□ to $5\times10^{11}$ Ω/□, for example. If the surface resistance is less than $5\times10^{10}$ Ω/□, toner scattering may occur when a discharge is conducted for transferring a toner image from the photoconductor to the intermediate transfer member, by which toner image may be disturbed. If the surface resistance is greater than $5\times10^{11}$ Ω/□, electric charge corresponding to a toner image may remain on the intermediate 5 transfer member after transferring the toner image from the intermediate transfer member to a transfer medium, such as paper, by which such remained electric charge may unpreferably appear as an image during a subsequent image forming operation.

The intermediate transfer member may be made from a conductive material and thermoplastic resin, in which such materials are kneaded, extruded, and formed into a belt shape or a cylindrical shape. The conductive material may be metal oxide, such as tin oxide, indium oxide, conductive particle, such as carbon black, or conductive polymer. These may be used alone or in combination. Alternatively, such conductive material can be added in resin solution having monomer oligomer used for cross-linking reaction, and then a centrifugal molding is conducted while applying heat to form an endless belt.

If the intermediate transfer member is provided with a surface layer, the surface layer of the intermediate transfer member may include materials used for the surface layer of photoconductor surface except the charge transport material, and a conductive material to adjust resistance.

A description is now given to toner for use in an exemplary embodiment. The toner preferably has an average circularity of from 0.93 to 1.00. In an exemplary embodiment, an average value obtained by the following (Equation 2) is defined as circularity of toner particles. The average circularity is an index of the degree of irregularities of toner particles. If the toner has a perfect sphericity, the average circularity takes a value of 1.00. The more irregularities of surface profile, the smaller the average circularity.

Circularity $SR$=(circumferential length of a circle having an area equivalent to a projected area of a particle)/(circumferential length of a projected image of the particle) (Equation 2)

If the average circularity is in a range of 0.93 to 1.00, toner particles may have smooth surface, and thereby toner particles contact with each other at a small contact area, and toner particles and the photoconductor drum 1 also contact with each other at a small contact area, by which such toner particles can have an excellent transfer performance. Further, because such toner particles have no corners, an agitation torque for the developing agent in the developing unit 3 can be set smaller, and thereby the agitation can be conducted in a stable manner, by which defective images may not occur.

Further, because such toner particles have no corners, a pressure, applied to toner particles when transferring a toner image to a transfer member or a recording member, can be uniformly applied to the toner particles used for forming dot images. Accordingly, a void may not occur on a transferred image. Further, because such toner particles have no corners, the toner particles may not have grinding force so much, by which such toner particles may not damage or wear the surface of the photoconductor drum 1.

A description is given to a method of measuring circularity of toner particles. The degree of circularity SR of particles can be measured by using a flow-type particle image analyzing apparatus FPIA-1000 produced by Toa Medical Electronics Co., Ltd. Such measuring may be conducted as below.

First, 0.1-0.5 ml of surfactant, preferably alkyl benzene sulfonate, as a dispersing agent is added to 100-150 ml of water in a container from which impurities have been removed in advance, and about 0.1-0.5 g of measurement sample is further added thereto. Then, an ultrasonic wave is applied to a suspension having a sample dispersed therein for 1 to 3 minute to set a suspension dispersion density as 3,000-10,000 particles/ul, and the shape of a toner particles and distribution of the degree of circularity of toner particles are measured by using the above-mentioned flow-type particle image measuring apparatus.

A weight-average particle diameter D4 of toner particles is preferably from 3 μm to 10 μm, for example. In this range, the toner particles may have a diameter, which is a sufficiently small size for developing fine dots of latent image. Accordingly, such toner particles may have good reproducibility of image dots. If the weight-average particle diameter D4 is too small, a phenomenon such as lower transfer efficiency and lower blade cleaning performance may be more likely to occur. If the weight-average particle diameter D4 is too great, toner for forming characters and lines may unfavorably spatter.

Further, the toner particles preferably have a ratio (D4/D1) of from 1.00 to 1.40, wherein the D4/D1 is a ratio of the weight-average particle diameter D4 and the number-average particle diameter D1. The closer the ratio (D4/D1) is 1, the sharper the toner size distribution of the toner particles. If the (D4/D1) is in a range of 1.00 to 1.40, an latent image can be developed by any toner particles having different particle diameters but set in such D4/D1 ratio, by which an image having higher quality can be produced. Further, because the toner particles have a sharper size distribution, a tribo electrically-charging profile of toner particles becomes also sharp, by which fogging can be reduced. Further, if toner particles have uniform diameter, the toner particles can be developed on a latent image dot in a precise array manner, and thereby dot reproducibility by toner particles becomes excellent.

The weight average particle diameter (D4), number average particle diameter (D1), and particle diameter distribution of a toner can be measured using an instrument COULTER COUNTER TA-II or COULETR MULTISIZER II from Coulter Electrons Inc. The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the weight average particle diameter (D4) and the number average particle diameter (D1) are determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Such substantially spherically shaped toner particles can be prepared by a cross-linking reaction and/or an elongation reaction of toner composition in an aqueous medium in the presence of fine resin particles. Specifically, the toner composition includes a polyester prepolymer having a functional group containing nitrogen atom, a polyester, a colorant, and a release agent, for example. The surface of toner particles prepared by such method can be hardened, by which hot offset can be reduced, and thereby a contamination of a fixing unit by toner particles can be reduced. Accordingly, an occurrence of defective images can be reduced.

A prepolymer formed as modified polyester resin may be polyester prepolymer (a) having isocyanate group, and amine (b) may be elongated or cross-linked with the polyester prepolymer (a).

The polyester prepolymer (a) having isocyanate group may be a reaction product of polyester with polyisocyanate (3), in which the polyester is a polycondensation product of polyol (1) and polycarboxylic acid (2) and having an active hydrogen group. The active hydrogen group of the polyester may be hydroxyl group (e.g., alcoholic hydroxyl group, phenolic hydroxyl group), amino group, carboxyl group, and mercapto group, for example. Among these, alcoholic hydroxyl group is preferred.

Examples of the polyol (1) include diol (1-1) and tirvalent or more polyol (1-2), and (1-1) alone or a mixture of (1-1) and small amount of (1-2) is preferably used.

Examples of the diol (1-1) include alkylene glycol (e.g., ethylene glycol, 1,2-propylene glycol, 1,3-propylene glycol, 1,4-butane diol, 1,6-hexane diol); alkylene ether glycol (e.g., diethylene glycol, triethylene glycol, dipropylene glycol, polyethylene glycol, polypropylene glycol, polytetramethylene ether glycol); alicyclic diol (e.g., 1,4-cyclohexane dimethanol, hydrogenated bisphenol A); bisphenol(e.g., bisphenol A, bisphenol F, bisphenol S); adduct of alkylene oxide of the alicyclic diol (e.g., ethylene oxide, propylene oxide, butylene oxide); and adduct of alkylene oxide of the bisphenol (e.g., ethylene oxide, propylene oxide, butylene oxide). Among these, alkylene glycol having a carbon number of 2 to 12 and adduct of the alkylene oxide of the bisphenol are preferable. Particularly preferable are the adduct of the alkylene oxide of the bisphenol, and a combination of an adduct of the alkylene oxide of the bisphenol and alkylene glycol having a carbon number of 2 to 12.

Examples of the tirvalent or more polyol (1-2) include trihydric to otcahydric alcohols and polyvalent aliphatic alcohol (e.g., glycerin, trimethylolethane, trimethylolpropane, pentaerythritol, sorbitol); tirvalent or more phenol (e.g., trisphenol PA, phenol borax, cresol novolac); and adduct of alkylene oxide of the tirvalent or more polyphenol.

Examples of the polycarboxylic acid (2) include dicarboxylic acid (2-1) and a tirvalent or more polycarboxylic acid (2-2), and (2-1) alone or a mixture of (2-1) and a small amount of (2-2) are preferably used. Examples of the dicarboxylic acid (2-1) include alkylene dicarboxylic acid (e.g., succinic acid, adipic acid, sebacic acid); alkenylene dicarboxylic acid (e.g., maleic acid, fumaric acid); and aromatic dicarboxylic acid (e.g., phthalic acid, isophthalic acid, terephthalic acid, naphthalen dicarboxylic acid). Among these, alkenylene dicarboxylic acid having a carbon number of 4 to 20 or aromatic dicarboxylic acid having a carbon number of 8 to 20 are preferable. Examples of the tirvalent or more polycarboxylic acid (2-2) include aromatic polycarboxylic acid having a carbon number of 9 to 20 (e.g., trimellitic acid, pyromellitic acid). Acid anhydrides or lower alkyl ester (e.g., methyl ester, ethyl ester, isopropyl ester) of the polycarboxylic acid (2) may be reacted with polyol (1).

A ratio of the polyol (1) and the polycarboxylic acid (2) is preferably from 2/1 to 1/1, more preferably from 1.5/1 to 1/1, and further preferably from 1.3/1 to 1.02/1 as an equivalent ratio of [OH]/[COOH] between hydroxyl group [OH] and carboxyl group [COOH].

Examples of the polyisocyanate (3) include aliphatic polyisocyanate (e.g., tetramethylene diisocyanate, hexamethylene diisocyanate, 2,6-diisocyanate methyl caproate); alicyclic polyisocyanate (e.g., isophorone diisocyanate, cyclohexylmethane diisocyanate); aromatic diisocyanate (e.g., tolylene diisocyanate, diphenylmethane diisocyanate); aromatic aliphatic diisocyanate (e.g., α,α,α',α'-tetramethylxylylene diisocyanate); isocyanates; and compounds formed by blocking the polyisocyanate phenol derivative, oxime, or caprolactam. These can be used alone or in combination.

A ratio of the polyisocyanate (3) is preferably from 5/1 to 1/1, more preferably from 4/1 to 1.2/1, and further preferably from 2.5/1 to 1.5/1 as an as an equivalent ratio of [NCO]/[OH] between isocyanate group [NCO] and hydroxyl group [OH] of polyester having hydroxyl group. If the [NCO]/[OH] becomes too great, low-temperature fixability of the toner may deteriorate. For example, if the molar ratio of [NCO] becomes less than 1, the urea content in modified polyester becomes lower, by which hot offset resistance may be degraded.

The content of polyisocyanate (3) in the prepolymer (a) having isocyanate group is preferably from 0.5 wt % to 40 wt %, more preferably from 1 wt % to 30 wt %, and further preferably from 2 wt % to 20 wt %. If the content of polyisocyanate (3) is too small, hot offset resistance may be degraded, and a compatibility of thermostable preservability of the toner and low-temperature fixability of the toner may deteriorate. If the content of polyisocyanate (3) is too great, low-temperature fixability of the toner may deteriorate.

The number of isocyanate group contained in one molecule of the prepolymer (a) having isocyanate group is preferably at least 1, more preferably an average of 1.5 to 3, and further preferably an average of 1.8 to 2.5. If the number of isocyanate group per molecule is less than 1, the molecular weight of urea-modified polyester becomes lower, by which hot offset resistance may be degraded.

Examples of the amine (b) include diamine (B1), tirvalent or more polyamine (B2), amino alcohol (B3), amino mercaptan (B4), amino acid (B5), and compound (B6) of B1 to B5 in which amino group is blocked.

Examples of the diamine (B1) include aromatic diamine (e.g., phenylene diamine, diethyl toluene diamine, 4,4' diaminodiphenylmethane); alicyclic diamine (e.g., 4,4'-diamino-3,3'dimethyldicyclohexylmethane, diaminecyclohexane, isophorone diamine); and aliphatic diamine (e.g., ethylene diamine, tetramethylene diamine, hexamethylene diamine). Examples of the tirvalent or more polyamine (B2) include diethylene triamine, triethylene tetramine. Examples of the amino alcohol (B3) include ethanolamine and hydroxyethylaniline. Examples of the amino mercaptan (B4) include aminoethyl mercaptan and aminopropyl mercaptan. Examples of the amino acid (B5) include aminopropionic acid and aminocaproic acid. Examples of the compound (B6), in which amino group of B1 to B5 is blocked, include ketimine compound and oxazoline compound obtained from amines of B1 to B5 or ketones (e.g., acetone, methyl ethyl ketone, methyl isobutyl ketone). The preferable amine (b) is B1 alone or a mixture of B1 and a small amount of B2.

Further, a reaction inhibitor can be used, as required, for an elongation reaction to adjust a molecular weight of urea-modified polyester. Examples of the reaction inhibitor include monoamine (e.g., diethylamine, dibuthylamine, buthylamine, laurylamine) and compound (e.g., ketimine compound), in which monoamine is blocked.

A ratio of the amine (b) is preferably from 1/2 to 2/1, more preferably from 1.5/1 to 1/1.5, and further preferably from 1.2/1 to 1/1.2 as an equivalent ratio of [NCO]/[NHx] of isocyanate group [NCO] in the prepolymer (a) having isocyanate group and amino group [NHx] in the amine (b). If the [NCO]/[NHx] becomes too great or too small, a molecular weight of urea-modified polyester (i) becomes lower, and hot offset resistance may be degraded. In an exemplary embodiment, the urea-modified polyester (i) may have an urea bond and an urethane bond. A molar ratio of urea bond content and urethane bond content is preferably from 100/0 to 10/90, more preferably from 80/20 to 20/80, and further preferably from 60/40 to 30/70. If the molar ratio of urea bond becomes too small, hot offset resistance may be degraded.

The modified polyester such as urea-modified polyester (i), to be used for toner particles, can be manufactured by these reactions. The urea-modified polyester (i) can be prepared by a one shot method or a prepolymer method, for example. The weight-average molecular weight of the urea-modified polyester (i) is preferably 10,000 or more, more preferably from 20,000 to 10,000,000, and further preferably from 30,000 to 1,000,000. If the weight-average molecular weight is less than 10,000, hot offset resistance may be degraded. Further, the number average molecular weight of urea-modified polyester (i) is not particularly limited when an unmodified polyester (ii), to be described later, is used. In such a case, the number average molecular weight of the urea-modified polyester (i) is set to a given value which can obtain the aforementioned weight-average molecular weight.

When the urea-modified polyester (i) is used alone, the number average molecular weight is preferably 20,000 or less, more preferably from 1,000 to 10,000, and further preferably from 2,000 to 8,000. If the number average molecular weight becomes too great, low-temperature fixability of the toner may deteriorate and glossiness of images may be deteriorated when used for full-color image forming.

In an exemplary embodiment, the urea-modified polyester (i) can be used alone, and the urea-modified polyester (i) can be used with unmodified polyester (ii) as binder resin component. By using the urea-modified polyester (i) with the unmodified polyester (ii), low-temperature fixability of the toner and glossiness of full color image can be preferably enhanced compared to a case using the urea-modified polyester (i) alone.

Examples of the unmodified polyester (ii) include polycondensation product of the polyol (1) and polycarboxylic acid (2) as similar to the urea-modified polyester (i), and preferred compounds are the same as urea-modified polyester (i). Further, the unmodified polyester (ii) may not limited to unmodified polyester, but may also include compounds modified by chemical bond other than urea bond, such as urethane bond. From a viewpoint of low-temperature fixability of the toner and hot offset resistance, it is preferable that the urea-modified polyester (i) and the unmodified polyester (ii) are at least partially soluble each other. Accordingly, it is preferable that polyester component of (i) and (ii) have similar compositions. When (ii) is mixed with (i), a weight ratio of (i) and (ii) is preferably from 5/95 to 80/20, more preferably from 5/95 to 30/70, further preferably from 5/95 to 25/75, and still further preferably from 7/93 to 20/80. If the weight ratio of (i) is too small, such as less than 5 wt %, hot offset resistance may be degraded, and a compatibility of thermostable preservability of the toner and low-temperature fixability of the toner may deteriorate.

The peak molecular weight of (ii) is preferably from 1,000 to 30,000, more preferably from 1,500 to 10,000, and further preferably from 2,000 to 8,000. If the peak molecular weight becomes too small, thermostable preservability of the toner may deteriorate. If the peak molecular weight becomes too great, low-temperature fixability of the toner may deteriorate.

A hydroxyl group value of (ii) is preferably 5 or more, more preferably from 10 to 120, and further preferably from 20 to 80. If the hydroxyl group value is too small, a compatibility of thermostable preservability of the toner and low-temperature fixability of the toner may deteriorate. An acid value of (ii) is preferably from 1 to 30, and more preferably from 5 to 20. By having such acid value, the unmodified polyester (ii) can be easily set to a negative charged condition.

A glass-transition temperature (Tg) of the binder resin is preferably from 50 to 70 degrees Celcius, and more preferably from 55 to 65 degrees Celcius. If the glass-transition temperature is too low, toner particles may be easily subjected to a blocking phenomenon at a higher temperature, which is not preferable. If the glass-transition temperature is too high, low-temperature fixability of the toner may deteriorate.

Under the existence of the urea-modified polyester resin, toner particles of an exemplary embodiment has a good level of thermostable preservability even if the glass-transition temperature is low compared to known polyester-based toner particles.

The temperature (TG') that the binder resin has a storage modulus of 10,000 dyne/cm$^2$ at a measurement frequency of 20 Hz is preferably 100 degrees Celcius or more, and more preferably from 110 to 200 degrees Celcius. If the temperature TG' is too low, hot offset resistance may be degraded.

The temperature (Tη) that the binder resin has a viscosity of 1,000 poises at a measurement frequency of 20 Hz is preferably 180 degrees Celcius or less, and more preferably from 90 to 160 degrees Celcius. If the temperature Tη becomes too high, low-temperature fixability of the toner may deteriorate. Accordingly, from a viewpoint of compatibility of low-temperature fixability of the toner and hot offset resistance, TG' is preferably set higher than Tη. In other words, a difference between TG' and Tη ("TG'−Tη") is preferably 0 degrees Celcius or more, more preferably 10 degrees Celcius or more, and further preferably 20 degrees Celcius or more. Such difference between TG' and Tη has no specific upper limit value. From a viewpoint of compatibility of thermostable preservability of the toner and low-temperature fixability of the toner, the difference between Tη and TG' is preferably 0 to 100 degrees Celcius, more preferably from 10 to 90 degrees Celcius, and further preferably from 20 to 80 degrees Celcius.

The binder resin can be manufactured by the following method. Polyol (1) and polycarboxylic acid (2) are heated at a temperature of 150 to 280 degrees Celcius under a presence of a known esterification catalyst (e.g., tetrabutoxytitanate, dibuthyltin oxide), and water is distilled under depressurized condition, as required, to obtain polyester having hydroxyl group. Then, such polyester is reacted with polyisocyanate (3) at a temperature of 40 to 140 degrees Celcius to obtain prepolymer (a) having isocyanate group. The prepolymer (a) is reacted with an amine (b) at a temperature of 0 to 140 degrees Celcius to obtain urea-modified polyester. When the polyester is reacted with the polyisocyanate (3) and when the prepolymer (a) is reacted with the amine (b), a solvent can be used, as required. Examples of solvent include aromatic solvent (e.g., toluene, xylene); ketones (e.g., acetone, methyl ethyl ketone, methyl isobutyl ketone); esters (e.g., acetic ether); amide (e.g., dimethyl formamide, dimethyl acetamide), and ether (e.g., tetrahydrofuran), which are inactive to the polyisocyanate (3). When unmodified polyester (ii) is also used, unmodified polyester (ii) is prepared with a method similarly applied to polyester having hydroxyl group, and the unmodified polyester (ii) is solved and mixed with a solution having the modified polyester (i), reacted already.

Although the toner particles used in an exemplary embodiment can be manufactured by a following method, other methods can be used. As an aqueous medium, water may be used singly or in combination with a water-soluble solvent. Examples of the water-soluble solvent include alcohol (e.g., methanol, isopropanol, ethylene glycol), dimethyl formamide, tetrahydrofuran, cellosolves (e.g., methyl cellosolve), and lower ketones (e.g., acetone, methyl ethyl ketone).

The toner particles may be formed by reacting a dispersed prepolymer (a) having isocyanate group with amine (b) in the aqueous medium, or by using the urea-modified polyester (i) prepared in advance.

In the aqueous medium, a dispersion having the urea-modified polyester (i) and prepolymer (a) can be stably formed by adding compositions of toner materials having the urea-modified polyester (i) and prepolymer (a) in the aqueous medium, and by dispersing them by shear force. Toner materials including prepolymer (a) and other toner composition such as a colorant, a colorant master batch, a release agent, a charge control agent, an unmodified polyester resin, or the like can be mixed as a dispersion in the aqueous medium. However, it is more preferable to mix the toner materials in advance, and then to add such mixture in the aqueous medium to disperse such toner materials. Further, other toner materials such as a colorant, a release agent, a charge control agent, or the like are not necessarily mixed when toner particles are formed in the aqueous medium. Such other toner materials can be added after forming toner particles. For example, after forming toner particles having no colorant, a colorant can be added to the toner particles with known dyeing method.

The dispersion method includes known methods, such as a low-speed shearing method, a high-speed shearing method, a friction method, a high-pressure jet method, an ultrasonic wave method, for example, which can be selected depending on purpose. A high-speed shearing method is preferably used to obtain dispersed particles having a particle diameter of from 2 μm to 20 μm. Although a dispersing machine using high-speed shearing method can be rotated at any speed, the dispersing machine is preferably rotated at 1,000 rpm to 30,000 rpm (rotation per minute), and more preferably 5,000 rpm to 20,000 rpm. Although a dispersion time can be set any time, such dispersion time is usually set to 0.1 to 5 minutes for a batch method. The dispersion temperature is usually set to from 0 to 150 degrees Celcius (under pressurized condition), and more preferably from 40 to 98 degrees Celcius. A higher dispersion temperature is preferable because the urea-modified polyester (i) and prepolymer (a) can be easily dispersed when a dispersion solution has a lower viscosity.

The use amount of the aqueous medium with respect to 100 weight parts of toner composition having the urea-modified polyester (i) and prepolymer (a) is preferably 50 to 2,000 weight parts, and more preferably 100 to 1,000 weight parts. If the use amount of the aqueous medium is too small, toner compositions may not be dispersed effectively, by which toner particles having a given particle diameter cannot be obtained. If the use amount of the aqueous medium is too great, the manufacturing may not be conducted economically. Further, a dispersing agent can be used, as required. A dispersing agent is preferably used to obtain sharper particle-size distribution and stable dispersing condition.

In the process of synthesizing the urea-modified polyester (i) from the prepolymer (a), the amine (b) can be added and reacted in the aqueous medium before dispersing the toner compositions. Alternatively, the amine (b) can be added in the aqueous medium after dispersing the toner compositions to cause a reaction on an interface of particles. In this case, urea-modified polyester is formed preferentially on a surface of the toner particles prepared in the aqueous medium, by which a concentration gradient of urea-modified polyester may be set for a toner particle. For example, the concentration of urea-modified polyester may be set higher in a sub-surface portion of a toner particle and set lower in a center portion of a toner particle.

Dispersant for emulsifying or dispersing an oil phase having dispersed toner components to an aqueous phase may be anionic surfactant, cationic surfactant, nonionic surfactant, or zwitterionic surfactant. Examples of the anionic surfactant include alkyl benzene sulfonate salt, α-olefin sulfonate salt, alkyl salt, and phosphate ether salt. Examples of the cationic surfactant include amine salt surfactant, and quaternary ammonium salt cationic surfactant. Examples of the amine salt surfactant include alkylamine salt, amino alcohol fatty acid derivative, polyamine fatty acid derivative, and imidazoline. Examples of the quaternary ammonium salt cationic surfactant include alkyl trimethyl ammonium salt, dialkyldimethyl ammonium salt, alkyl dimethylbenzyl ammonium salt, pyridinium salt, alkyl isoquinolinium salt, and benzethonium chloride. Examples of the nonionic surfactant include aliphatic acid amide derivative, and polyalcohol derivative. Examples of the zwitterionic surfactant include alanine, dodecyldi(aminoethyl)glycine, di(octylaminoethyl)glycine, and N-alkyl N,N-dimethylammonium betaine.

Among these, the surfactant having fluoroalkyl group is preferably used to have favorable effect with a small amount. Examples of the anionic surfactant having the fluoroalkyl group include fluoroalkyl carboxylic acid having a carbon number of 2 to 10 or metal salt thereof, disodium perfluorooctane sulfonyl glutamic acid, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propane sulfonate, fluoroalkyl (C11 to C20) carboxylic acid or its metal salt, perfluoroalkyl carboxylic acid (C7 to C13) or its metal salt, perfluoroalkyl (C4 to C12) sulfonate or its metal salt, perfluorooctane sulfonic acid diethanolamide, N-propyl-N-(2-hydroxyethyl)perfluorooctane sulfonamide, perfluoroalkyl (C6 to C10) sulfonamide propyl trimethyl ammonium salt, perfluoroalkyl (C6 to C10)-N-ethylsulfonyl glycine salt, and mono perfluoroalkyl (C6 to C16) ethylphosphate ester.

Examples of trade name of surfactant having the fluoroalkyl group include SURFLON S-11, S-12, S-13 (manufactured by Asahi Glass Co., Ltd); FLUORAD FC-93, FC-95, FC-98, FC-129 (manufactured by Sumitomo 3M Co., Ltd); UNIDINE DS-101, DS-102 (manufactured by Daikin Industries, Ltd); MEGAFACE F-110, F-120, F-113, F-191, F-812, F-833 (manufactured by Dainippon Ink & Chemicals, Inc.); EKTOP EF-102, 103, 104, 105, 112, 123A, 123B, 306A, 501, 201, 204 (manufactured by Tochem Products Co., Ltd); and FTERGENT F-100, F150 (manufactured by Neos Co., Ltd).

Examples of the cationic surfactant include aliphatic primary, secondary, or tertiary amine having fluoroalkyl group, aliphatic quaternary ammonium salt, such as perfluoroalkyl (C6 to C10) sulfonamide propyl trimethyl ammonium salt, benzalkonium salt, benzethonium chloride, pyridinium salt, and imidazolinium salt. Trade names of the cationic surfactant include SURFLON S-121 (manufactured by Asahi Glass Co., Ltd); FLUORAD FC-135 (manufactured by Sumitomo 3M Co., Ltd); UNIDINE DS-202 (manufactured by Daikin Industries, Ltd), MEGAFACE F-150, F-824 (manufactured by Dainippon Ink & Chemicals, Inc.); EKTOP EF-132 (manufactured by Tochem Products Co., Ltd); and FTERGENT F-300 (manufactured by Neos Co., Ltd).

Examples of the inorganic compound dispersing agent having lower water solubility include tricalcium phosphate, calcium carbonate, titanium oxide, colloidal silica, and hydroxyapatite.

Further, high polymer protective colloid can be used to stabilize a dispersion droplet. Examples of the high polymer protective colloid include acids, (meth) acrylic monomer having hydroxyl group, vinyl alcohol or vinyl alcohol ether, ester compound having vinyl alcohol and carboxyl group, amide compound or its methylol compound, chloride, homopolymer or copolymer having nitrogen atom or heterocyclic ring of nitrogen atom, polyoxyethylene, and cellulose.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth) acrylic monomer having hydroxyl group include β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, dieethylene glycol monoacrylic ester, diethylene glycol monomethacrylic acidester, glycerin monoacrylic ester, glycerin monomethacrylic ester, N-methylol acrylamide, and N-methylol methacrylamide. Examples of the vinyl alcohol or vinyl alcohol ether include vinyl methyl ether, vinyl ethyl ether, and vinyl propyl ether. Examples of the ester compound having vinyl alcohol and carboxyl group include vinyl acetate, propionic acidvinyl, and vinyl butyrate. Examples of the amide compound or its methylol compound include acrylamide, methacrylamide, diacetone acrylamide acid, or methylol compound thereof. Examples of the chloride include acrylic acid chloride, and methacrylic acid chloride. Examples of the homopolymer or copolymer having nitrogen atom or heterocyclic ring of nitrogen atom include vinylviridin, vinylpyrrolidone, vinylimidazole, and ethyleneimine. Examples of the polyoxyethylene include polyoxyethylene, polyoxypropylene, polyoxyethylene alkylamine, polyoxypropylenealkylamine, polyoxyethylene alkylamide, polyoxypropylenealkylamide, polyoxyethylene nonyl phenyl ether, polyoxyethylene lauryl phenyl ether, polyoxyethylene stearyl phenyl ester, and polyoxyethylene nonyl phenyl ester. Examples of the cellulose include methyl cellulose, hydroxyethyl cellulose, and hydroxypropyl cellulose.

When preparing the aforementioned dispersion solution, a dispersion stabilizer can be used, as required. Such dispersion stabilizer include compound such as calcium phosphate salt, which can be solved in acid or alkali. When such dispersion stabilizer is used, calcium phosphate salt may be removed from fine particles by dissolving calcium phosphate salt using acid, such as hydrochloric acid, and then washing dispersion solution, or calcium phosphate salt may be removed from fine particles through decomposition by enzyme. If the dispersion agent is used, the dispersion agent can be remained on surface of toner particles. However, such dispersion agent is preferably washed and removed from toner particles after an elongation and/or cross-linking reaction to set preferable toner charge performance.

Further, to decrease the viscosity of toner composition, a solvent, which can solve the urea-modified polyester (i) and prepolymer (a), can be used. Such solvent is preferably used to obtain a sharper particle-size distribution. Such solvent may be preferably volatile, by which solvent can be removed easily. Examples of the solvent include toluene, xylene, benzene, tetrachloride carbon, dichloromethane, 1,2-dichloroethane, 1,1,2-trichloroethane, trichloroethylene, chloroform, monochlorobenzene, dichloroethylidene, methyl acetate, acetic ether, methyl ethyl ketone, and methyl isobutyl ketone. These can be used alone or in combination. Among these, aromatic solvent such as toluene and xylene, halogenated hydrocarbon such as dichloromethane, 1,2-dichloroethane, chloroform, and tetrachloride carbon are preferably used, and aromatic solvent such as toluene and xylene is more preferably used. The use amount of the solvent with respect to the prepolymer (a) of 100 weight parts is preferably from 0 to 300 weight parts, more preferably from 0 to 100 weight parts, and further preferably from 25 to 70 weight parts. When the solvent is used, the solvent is heated and removed under a normal or reduced pressure condition after an elongation and/or cross-linking reaction.

An elongation and/or cross-linking reaction time is determined based on reactivity of the isocyanate group of the prepolymer (a) and the amine (b). Such reaction time is usually 10 minutes to 40 hours, and preferably from 2 hours to 24 hours. The reaction temperature is preferably from 0 to 150 degrees Celcius, and more preferably from 40 to 98 degrees Celcius. Further, a known catalyst, such as dibuthyltin laurate and dioctyltin laurate, can be used, as required.

To remove an organic solvent from the emulsified dispersion solution, the emulsified dispersion solution is gradually heated to a higher temperature to vaporize and remove the organic solvent from the solution. Alternatively, an emulsified dispersion solution may be sprayed in a dry atmosphere to remove an organic solvent from droplets to form fine toner particles, and aqueous dispersing agent is also vaporized and removed. Such dry atmosphere may be a heated gas atmosphere using air, nitrogen, carbon dioxide, combustion gas, or the like. Such heated gas atmosphere may be heated to a temperature greater than a boiling point of solvent to be used. Targeted quality of toner particles can be obtained by a spray dryer, a belt dryer, or a rotary kiln with a shorter time.

When an emulsified dispersion solution has a broader particle-size distribution, such broader particle-size distribution can be segmented in a plurality of sizes after washing and drying the emulsified dispersion solution to obtain uniformly sized particles. Such segmentation process for separating fine particles size by size can be conducted to the dispersion solution by a cyclone method, a decanter method, or a centrifugal separation method or the like. Although the segmentation process can be conducted to dried particles, obtained by drying the dispersion solution, such segmentation process can be preferably conducted to the dispersion solution from a viewpoint of efficiency. Fine particles, obtained by the segmentation process but not used for product or not so fine particles may be reused in a kneading process to form particles. In such a case, such unnecessary fine particles or not so fine particles may be wet. It is preferable to remove the dispersing agent from the obtained dispersion solution as much as possible, and such removal of dispersing agent is preferably conducted when the segmentation process is conducted, for example.

Such obtained dried toner particles may be mixed other particles, such as a release agent, a charge control agent, a plasticizer, and a colorant, and then a impact force may be applied to the mixed particles to fix or fuse other particles on the surface of toner particles. Such fixed other particles may not be separated from the surface of toner particles so easily.

Specifically, a mixture of particles is applied with an impact force using an impeller vane rotating at a high speed, or a mixture of particles is introduced in a high speed air stream for accelerating particles, and accelerated particles are impacted one another or impacted against an impact plate. Examples of such machines are Ong Mill (manufactured by Hosokawa Micron Corp.), a modified I-type Mill (manufactured by Nippon Pneumatic Mfg. Co., Ltd) using reduced pulverization air pressure, Hybridizaition System (manufactured by Nara Kikai Seisakusho), Cryptron System (manufactured by Kawasaki Heavy Industries, Ltd), and an automatic mortar, for example.

Further, conventional colorants such as pigment and dye can be used as a colorant for the toner particles. Such colorant includes carbon black, lamp black, iron black, ultramarine blue, nigrosin dye, aniline blue, phthalocyanine blue, phthalocyanine green, Hansa yellow G, rhodamine 6C lake, chacloil blue, chrome yellow, quinacridone red, benzidine yellow, and rose bengal, for example. These can be used alone or in combination.

Further, if magnetic property is to be provided to toner particles, toner particles may be contained with magnetic component such as ferric oxide (e.g., ferrite, magnetite, maghemite) or metal and metal alloy of iron, cobalt, nickel, or the like. These magnetic components may be used alone or in combination. Further, such magnetic component may be used as a colorant component.

Further, the colorant used with the toner particles preferably has the number average particle diameter of 0.5 μm or less, more preferably 0.4 μm or less, and further preferably 0.3 μm or less. If the number-average particle diameter becomes too large, pigments may not be dispersed at an adequate level, and a preferable transparency may not be obtained. If the number average particle diameter becomes smaller, such fine colorant particles have a diameter effectively smaller than a half-wave length of visible light, by which such fine colorant particles may not affect reflection and absorption of light. Accordingly, such fine colorant particles may be useful for attaining a good level of color reproducibility and transparency of an OHP (overhead projector) sheet having an image.

If particles having a larger particle diameter are included in colorant in large amount, such larger particles may block transmission of incident light or scatter incident light, by which brightness and vividness of a projected image of OHP sheet may become lower. Further, if such larger particles are included in colorant in large amount, colorant may drop from the surface of toner particles, and thereby causing problems such as fogging, drum contamination, defective cleaning. Specifically, a ratio of colorant having a particle diameter greater than 0.7 μm is preferably 10% or less, and more preferably 5% or less of all colorant.

Further, colorant may be mixed with a binding resin and a moistening agent, and kneaded with the binding resin to adhere the colorant to the binding resin. When the colorant is mixed with the binding resin, such colorant may be dispersed more effectively, and thereby a particle diameter of colorant dispersed in toner particles can be set smaller. Accordingly, a better transparency of an OHP (overhead projector) sheet having an image can be obtained. The binding resin used for such kneading may include resin used as a binding resin for toner, but not limited thereto.

A mixture of the binding resin, colorant, and moistening agent can be mixed by using a blending machine, such as Henschel mixer, and then the mixture is kneaded by a kneading machine having two or three rolls at a temperature set lower than a melting temperature of the binding resin, by which kneaded mixture of the binding resin and colorant can be obtained. Further, the moistening agent may be water, an organic solvent, such as acetone, toluene, butanone in view of solubility of a binding resin and wet-ability with a colorant, and water is preferably used in view of dispersion performance of colorant. Water is preferable from a viewpoint of environmental load, and keeping dispersion stability of colorant in the following toner manufacturing process. Such process may preferably decrease a particle diameter of colorant particles included in toner particles, and colorant particles can be dispersed more uniformly. Accordingly, color reproducibility of a projected image of OHP sheet can be enhanced.

Further, the toner particles may preferably include a release agent in addition to the binder resin and the colorant. Examples of the release agent include polyolefin wax (e.g., polyethylene wax, polypropylene wax); long-chain hydrocarbon (e.g., paraffin wax, southall wax); and wax carbonyl group. Among these, wax having carbonyl group is preferable.

Examples of the wax having carbonyl group include ployalkanoic acid ester (e.g., camauba wax, montan wax, trimethylolpropane tribehenate, pentaerythritol tetraibehenate, pentaerythritol diacetate dibehenate, glycerin tribehenate, 1,18-octadecanediol distearate); ployalkanol ester (e.g., trimellitic acid tristearyl, distearyl maleate); ployalkanoic acid amide (e.g., ethylenediamine dibehenylamide); polyalkylamide (e.g., tristearylamide trimellitate); and dialkyl ketone (e.g., distearyl ketone). Among these, ployalkanoic acid ester is preferable.

The melting point of the release agent is preferably from 40 to 160 degrees Celcius, more preferably from 50 to 120 degrees Celcius, and further preferably from 60 to 90 degrees Celcius. If the melting point of the release agent is too low, such release agent may affect thermostable preservability of the toner. If the melting point of the release agent is too high, such release agent may more likely cause cold offset when a fixing process is conducted under low temperature.

The viscosity of the melted release agent measured at a temperature higher than the melting point for 20 degrees Celcius preferably has a value of from 5 to 1,000 cps, and more preferably from 10 to 100 cps. If the melted viscosity becomes too great, such release agent may not improve hot offset resistance and low temperature fixability of the toner. A content of the release agent in the toner particles is preferably 0 wt % to 40 wt %, and more preferably from 3 wt % to 30 wt %.

Further, toner particles may include a charge control agent to enhance charge amount and charging speed of toner particles, as required. If the charge control agent is a color material, such charge control agent may change the color of toner particles. Accordingly, colorless material or whitish material is preferably used. Examples of the charge control agent include triphenylmethane dye, chelate molybdate pigment, rhodamine dye, alkoxy amine, quaternary ammonium salt (including fluorine modified quaternary ammonium salt), alkylamide, phosphorus alone or phosphorus compound, tungsten alone or tungsten compound, fluorine-based activator, salicylic acid metal salt, and metal salt of salicylic acid derivative.

Example trade names of the charge control agent include Bontron P-51 as quaternary ammonium salt, E-82 as oxynaphthoic acid metal complex, E-84 as salicylic acid metal complex, E-89 as phenol condensate (manufactured by Orient Chemical 100 Industries, Ltd.); TP-302, TP-415 as quaternary ammonium salt molybdenum complex (manufactured by Hodogaya Chemical Industries, Ltd.); Copy Charge PSY VP2038 as quaternary ammonium salt, Copy Blue PR as triphenyl methane derivative, Copy Charge NEG VP2036 and Copy Charge NX VP434 as quaternary ammonium salt (manufactured by Hoechst Co., Ltd.);LRA-901, LR-147 as boron complex (both manufactured by Japan Carlit Co., Ltd.), quinacridone, azo pigment, and polymer compound having functional group such as sulfonic acid group, carboxyl group, quaternary ammonium salt, or the like.

The adding amount of the charge control agent is determined based on toner manufacturing condition such as types of binder resins, presence or absence of additives, and a dispersion method, or the like. The charge control agent is preferably used in a range of from 0.1 to 10 weight parts, and more preferably from 0.2 to 5 weight parts with respect to the binder resin of 100 weight parts. If the adding amount of the charge control agent becomes too great, the toner particles may be charged too high, by which an effect of charge control agent is reduced and the toner particles may be attracted to a developing roller with a greater electrostatic attraction force. Therefore, a developing agent may have a lower fluidity, and result in a lower image concentration.

Such charge control agent can be melted and kneaded with a resin in a master batch to disperse the charge control agent, or may be added to an organic solvent when to dissolute and disperse the charge control agent, or may be solidified on the surface of toner particles after toner particles are formed.

Further, when dispersing toner compositions in an aqueous medium during a toner manufacturing process, fine resin particles may be added to a solution to stabilize dispersion condition. Such fine resin particles may be any resins, which can be used for dispersion in an aqueous medium, and may be thermoplastic resin or thermosetting resin. Examples of the fine resin particles include vinyl resin, polyurethane resin, epoxy resin, polyester resin, polyamide resin, polyimide resin, silicone resin, phenol resin, melamine resin, urea resin, aniline resin, ionomer resin, and polycarbonate resin. These can be used alone or in combination. Among these, vinyl resin, polyurethane resin, epoxy resin, polyester resin or combination of these are preferably used to obtain spherical fine particles in an aqueous dispersion. Examples of the vinyl resin include homopolymer or copolymer of vinyl monomers, and may be styrene (meth)acrylic acid ester resin, copolymer of styrene/butadiene, copolymer of (meth)acrylic acid-acrylic acid ester, copolymer of styrene/acrylonitrile, copolymer of styrenemaleic anhydride, and copolymer of styrene (meth)acrylic acid, but not limited those.

Further, inorganic fine particles may be preferably used as external additives to facilitate fluidity, developing performance, charged performance of toner particles. Such inorganic fine particles preferably have a primary particle diameter of 5 nm (nanometer) to 2 μm, and more preferably 5 nm to 500 nm. Further, Such inorganic fine particles preferably have a specific surface area of 20 $m^2/g$ to 500 $m^2/g$ measured by the BET method. Such inorganic fine particles are preferably added to the toner particles with 0.01 wt %, to 5 wt %, and more preferably from 0.01 wt % to 2.0 wt %. Examples of the inorganic fine particles include silica, alumina, titanium oxide, barium titanate, magnesium titanate, calcium titanate, strontium titanate, zinc oxide, tin oxide, silica sand, clay, mica isinglass, sand-lime, diatomite, chrome oxide, cerium oxide, colcothar, antimony trioxide, magnesium oxide, zirconium oxide, barium sulfate, barium carbonate, calcium carbonate, silicon carbide, and silicon nitride.

In addition, polymer fine particles obtained by, for example, a soap-free emulsion polymerization, a suspension polymerization, or a dispersion polymerization can be used. Such polymer fine particles may be polystyrene, methacrylic acid ester, copolymer of acrylic acid ester, polycondensation polymer of silicone, polycondensation polymer of benzoganamine, polycondensation polymer of nylon, and polymer particles prepared from thermosetting resin, for example.

Such external additives are subjected to a surface treatment to enhance hydrophobicity, by which a deterioration of fluidity and charged performance of toner particles under high-humidity environment can be reduced. Examples of preferable surface treatment agent include silane coupling agent, silylating agent, silane coupling agent having fluorinated alkyl group, organic titanate coupling agent, aluminum coupling agent, silicone oil, and modified silicone oil.

Further, a cleaning improving agent may be added to toner composition, to facilitate removal of developing agent remaining on the photoconductor drum 1 or an intermediate transfer member after transfer process. Examples of the cleaning improving agent include aliphatic metal salt (e.g., zinc stearate, calcium stearate, stearic acid); and polymer fine particles manufactured by a soap-free emulsion polymerization (e.g., polymethyl methacrylate fine particles, polystyrene fine particles). Such polymer fine particles have relatively narrower particle-size distribution, and particles having volume-average particle diameter of 0.01 μm to 1 μm is preferable.

By using such toner particles having a good level of developing performance, a higher quality toner image can be produced in stable manner. However, toner particles, not transferred to a transfer member (or recording member) or an intermediate transfer member by a transfer unit but remaining on the photoconductor drum 1, may not be effectively removed by a cleaning unit because toner particles have fine spherical shape, and such toner particles may not be recovered by the cleaning unit. Although toner particles can be removed from the photoconductor drum 1 by pressing a particle remover such as cleaning blade against the photoconductor drum 1 with a greater force, for example, such configuration may shorten a lifetime of the photoconductor drum 1 or cleaning unit, and may not be preferable from a viewpoint of energy saving. However, if a pressure of the cleaning blade pressed against the photoconductor drum 1 is reduced, toner particles or small-sized carrier particles cannot be removed from the photoconductor drum 1 effectively, and such particles may cause damages on the photoconductor drum 1, by which an image forming apparatus may not produce images effectively.

Although toner for producing higher quality image, prepared by a polymerization method is used for the above described image forming apparatus, toner prepared by another method, such as indefinite shaped toner prepared by a pulverization method, can also be used for the image forming apparatus. Such toner may be preferably used to enhance a lifetime of image forming apparatus.

Further, in an exemplary embodiment, in addition to the above-described toner particles used for obtaining high quality images, an image forming apparatus can be used with irregular shaped toner particles prepared by a pulverization method, which may be useful for extending a lifetime of apparatus. Materials for such toner particles may not be limited to any specific materials, but materials used commonly for electrophotography can be used.

Examples of binding resin used for the pulverized toner particles include styrene or homopolymers of styrene derivative substitution (e.g., polystyrene, polyp-chlorostyrene, polyvinyl toluene); styrene copolymer (e.g., styrene/p-chlorostyrene copolymer, styrene/propylene copolymer, styrene/vinyl toluene copolymer, styrene/vinyl naphthalen copolymer, styrene/acrylic acid methyl copolymer, styrene/acrylic acid ethyl copolymer, styrene/acrylic acid buthyl copolymer, styrene/acrylic acid octyl copolymer, styrene/methacrylic acid methyl copolymer, styrene/methacrylic acid ethyl copolymer, styrene/methacrylic acid buthyl copolymer, styrene/α-chloromethacrylic acid methyl copolymer, styrene/acrylonitrile copolymer, styrene/vinyl methyl ketone copolymer, styrene/butadiene copolymer, styrene/isoprene copolymer, styrene/maleic acid copolymer); homopolymer or copolymer of acrylic acid ester (e.g., polymethyl acrylate, polybuthyl acrylate, polymethyl methacrylate, polybuthyl methacrylate methacrylic acid); polyvinyl derivative (e.g., polyvinyl chloride, polyvinyl acetate); polyester polymer, polyurethane polymer, polyamide polymer, polyimide polymer, polyol polymer, epoxy polymer, terpene polymer, aliphatic or alicyclic hydrocarbon resin, and aromatic petroleum resin. These can be used alone or in combination. Among these, styrene acrylic copolymer resin, polyester resin, polyol resin are preferably used in view of electrical property and cost, and polyester resin and polyol resin are preferably used in view of a good level of fixing performance.

The surface layer of the charging member such as charge roller may include a resin component used as binding resin of the toner particles, wherein such resin component may be linear polyester resin composition, linear polyolresin composition, linear styrene acrylic resin compositions or cross-linking composition of these, and at least one of these may be used.

Such pulverized toner particles may be prepared as follows: First, mix the aforementioned resin component and the aforementioned colorant component, a wax component, a charge control component, or the like, as required, then knead such mixture at a temperature slightly lower than a melting temperature of the resin component, and then cool the mixture. After segmenting toner particles size by size, toner particles can be prepared. Such toner particles may be further added with the aforementioned external additives, as required.

Hereinafter, a description is given to experiment and its results in detail using protective layer setting units prepared according to an exemplary embodiment. It should be noted that following Example 1 used in the experiment are just exemplary, and other configuration can be devised.

FIG. 7 illustrates a schematic configuration of the protective layer setting unit 2 used in the experiment. The photoconductor drum used in the experiment was manufactured as below.

Photoconductor Drum

An aluminum drum (conductive supporter) having a diameter of 30 mm was coated with an under layer, a charge generation layer, a charge transport layer, and a surface layer in this order, and dried to form the photoconductor drum having an under layer of 3.6 μm thickness, a charge generation layer of about 0.14 μm thickness, a charge transport layer of 23 μm thickness, and a surface layer of about 3.5 μm thickness. Such photoconductor drum was manufactured for thirty drums. The surface layer was coated using a spray method, and other layers were coated using a dipping method. The surface layer was added with alumina having an average particle diameter of 0.18 μm with a weight ratio of 23.8 wt %.

Agent Bar No. 11

FT115 (synthesize wax manufactured by Nippon Seiro Co.,Ltd.) of 90 weight part and TOPAS-TM (manufactured by manufactured by Ticona) of 10 weight part were placed in a glass vessel having a cap, and were agitated and melted at a temperature of 160 to 250 degrees Celcius using a hot stirrer. Then, the melted protective agent was poured in an internal space of an aluminum metal mold, having a size of 12 mm×8 mm×350 mm, heated to 115 degrees Celcius in advance. After cooling to 88 degrees Celcius on a wooden table, the aluminum metal mold was cooled to 40 degrees Celcius on an aluminum table. Then, the solidified product was removed from the mold, and then cooled to an ambient temperature while placing a weight on the product for preventing warping. After that, an agent bar No. 11 having a size of 7 mm×8 mm×310 mm was prepared by cutting some portion of the product. The agent bar No. 11 was attached with a double face tape and fixed to a metal supporter.

Samples of the agent bar No. 11 and photoconductor were analyzed by FT-IR Avatar370 (manufactured by Thermo Electron Corporation, Thunder Dome) under a condition of one time reflection, ATR prism of Ge, incident angle of 45° for IR spectrum analysis to obtain IR spectrum A and B, which is shown in FIG. 8, wherein the IR spectrum A is for the photoconductor, and the IR spectrum B is for the agent bar No. 11.

In the IR spectrum A of the photoconductor, the peak Pa1 attributed to polycarbonate bond was observed at 1770 $cm^{-1}$, and the peak Pa2 attributed to phenyl group was observed at 3040 $cm^{-1}$. In the IR spectrum B of the agent bar No. 11, the peak Pb1 attributed to methylene group was observed at 2850 $cm^{-1}$, and the peak Pb2 is observed at 2920 $cm^{-1}$. When the photoconductor was measured by the ATR, a measurement sample having 1 cm×1 cm size was cut from an aluminum base of the photoconductor.

EXAMPLE 1-1

Methylene Index

The photoconductor, a brush roller No.2 (fiber having a thickness of 10 denier, fiber density of 50,000 fibers per square inch), and a urethane blade were assembled in a protective layer setting unit (see FIG. 7). The agent bar No. 11 was pressed against the brush with a spring force of 4.8 N to apply a protective agent to photoconductors (1-1) to (1-5). The photoconductor and the brush roller rotated at a linear velocity of 125 mm/sec and 146 mm/sec, respectively.

After applying the protective agent for 120 minutes to photoconductor (1-4) using the protective layer setting unit (11), a sample of the photoconductor was sliced using a ultramicrotome and TEM (transmission electron microscope) observation was conducted, and it was found that the layer thickness of protective agent was 20 nm to 50 nm based on TEM photo.

The photoconductors (1-1) to (1-5) were applied with the protective agent by changing an application time (3, 10, 40, 120, 360 minutes), and samples of each the photoconductors were prepared after applying the protective agent. After applying the protective agent, samples of the photoconductors (1-1) to (1-5) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8).

Based on the IR spectrum C, a peak area ratio between the peak Pb1 (2850 $cm^{-1}$) having the peak area "Sb" and the peak Pa1 (1770 $cm^{-1}$) having the peak area "Sa" was evaluated as a peak area ratio or evaluation index "Sb/Sa."

The peak Pb1 (2850 $cm^{-1}$) is a peak attributed to the agent bar No. 11. Because a peak attributed to the photoconductor also exists around the peak Pb1 (2850 $cm^{-1}$) and overlaps with the peak Pb1, a differential spectrum D between the IR spectrum C (obtained after applying the protective agent to the photoconductor) and the IR spectrum A for photoconductor not applied with the protective agent is computed so that the peak area of the peak Pb1 (2850 $cm^{-1}$) attributed to the agent bar No. 11 is not effected by the peak area of the peak attributed to the photoconductor, and then the peak area ratio or evaluation index "Sb/Sa" is computed. When computing the differential spectrum D (see FIG. 8), peak intensity was adjusted, such as increased or decreased, as required. For example, a given coefficient is multiplied to the absorbance of spectrum so as to set zero value for the peak area of the peak at 1770 $cm^{-1}$.

Figures 12, 13:
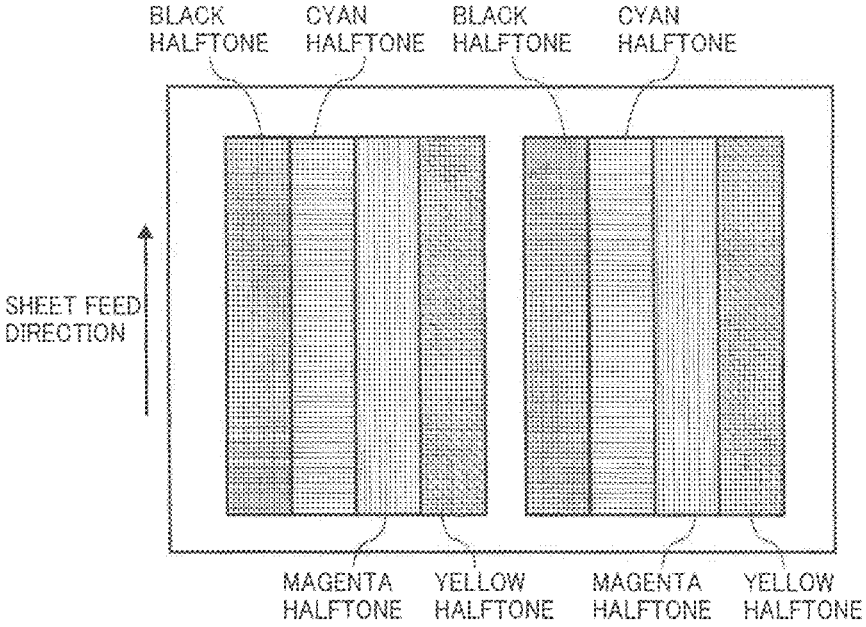
FIG. 12 illustrates an image pattern used for evaluating a process cartridge according to exemplary embodiments.
FIG. 13 shows conditions of peak used for computing a peak area for each of peaks, in which start and end point of background for computing a peak area, and integration area of peak are included with wavenumber information.

The evaluation index "Sb/Sa," which indicates an application amount of the protective agent, increases as the application time increases. For example, the evaluation index "Sb/Sa" was 0.19 at the application time of 10 minutes, and the evaluation index "Sb/Sa" was 0.38 at the application time of 360 minutes. Further, an error of Sb/Sa was checked using five samples of the photoconductor (1-5) applied with the protective agent for 360 minutes, wherein the five samples were adjacent each other in a circumferential direction. When the Sb/Sa was computed with the five samples, the Sb/Sa had an error of 8%. FIG. 13 shows conditions of peak used for computing a peak area for each of peaks, in which start and end point of background for computing a peak area, and integration area of peak are included with wavenumber information.

EXAMPLE 1-2

Phenyl Index

As for the IR spectrum obtained in Example 1-1, a peak area ratio or evaluation index "Sb/Sa" was computed for the peak Pb2 (2920 $cm^{-1}$) having a peak area Sb and the peak Pa2 (3040 $cm^{-1}$) having a peak area Sa. The peak Pb2 (2920 $cm^{-1}$) is a peak attributed to the agent bar No. 11. Although a peak attributed to the photoconductor also exists around the peak Pb2 (2920 $cm^{-1}$) and overlaps with the peak Pb2, the peak Pb2 (2920 $cm^{-1}$) has a peak area sufficiently greater than the peak area of the peak attributed to the photoconductor. Accordingly, a step of computing a differential spectrum of the IR spectrum C after applying the protective agent to the photoconductor and the IR spectrum A for the photoconductor not applied with the protective agent was omitted, different from Example 1-1.

The evaluation index "Sb/Sa," which indicates an application amount of the protective agent, increases as the application time increases. For example, the evaluation index "Sb/Sa" was 10.3 at the application time of 10 minutes, and the evaluation index "Sb/Sa" was 23.2 at the application time of 360 minutes. Further, an error of Sb/Sa was checked using five samples of the photoconductor (1-5) applied with the protective agent for 360 minutes, wherein the five samples were adjacent each other in a circumferential direction, and were different from the five samples used for Example 1-1. When the Sb/Sa was computed with the five samples, the Sb/Sa had an error of 12%.

EXAMPLE 1-3

The photoconductor, a brush roller No. 3 (fiber having a thickness of 20 denier, fiber density of 50,000 fibers per square inch), and a urethane blade were assembled in a protective layer setting unit (see FIG. 7). The agent bar No. 11 was pressed against the brush with a spring force of 4.8 N to apply a protective agent to the photoconductors (3-1) to (3-5). The photoconductor and the brush roller rotated at a linear velocity of 125 mm/sec and 146 mm/sec, respectively.

The photoconductors (3-1) to (3-5) were applied with the protective agent by changing an application time (3, 10, 40, 120, 360 minutes), and samples of each the photoconductors were prepared after applying the protective agent. After applying the protective agent, samples of the photoconductors (3-1) to (3-5) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As for the IR spectrum C, a peak area ratio or evaluation index "Sb/Sa" was computed for the peak Pb1 (2850 $cm^{-1}$) having a peak area Sb and the peak Pa1 (1770 $cm^{-1}$) having a peak area Sa as similar to Example 1-1.

The evaluation index "Sb/Sa," which indicates an application amount of the protective agent, increases as the application time increases. For example, the evaluation index "Sb/Sa" was 0.06 at the application time of 10 minutes, and the evaluation index "Sb/Sa" was 0.71 at the application time of 360 minutes. Further, an error of Sb/Sa was checked using five samples of the photoconductor (3-5) applied with the protective agent for 360 minutes, wherein the five samples were adjacent each other in a circumferential direction. When the Sb/Sa was computed with the five samples, the Sb/Sa had an error of 11%.

EXAMPLE 1-4

As for the IR spectrum obtained in Example 1-3, a peak area ratio or evaluation index "Sb/Sa" was computed for the peak Pb2 (2920 $cm^{-1}$) having a peak area Sb and the peak Pa2 (3040 $cm^{-1}$) having a peak area Sa as similar to Example 1-2.

The evaluation index "Sb/Sa," which indicates an application amount of the protective agent, increases as the application time increases. For example, the evaluation index "Sb/Sa" was 7.8 at the application time of 10 minutes, and the evaluation index "Sb/Sa" was 39.8 at the application time of 360 minutes. Further, an error of Sb/Sa was checked using five samples of the photoconductor (3-5) applied with the protective agent for 360 minutes, wherein the five samples were adjacent each other in a circumferential direction, and were different from the five samples used for Example 1-3. When the Sb/Sa was computed with the five samples, the Sb/Sa had an error of 7%.

(Comparison of ATR Prism and Incident Angle)

EXAMPLE 1-5

Change of ATR Prism

After applying the protective agent to the photoconductors (1-1) to (1-5), another samples of the photoconductors (1-1) to (1-5) were analyzed by FT-IR Avatar370 (manufactured by Thermo Electron Corporation, Smart Orbit) under a condition of one time reflection, ATR prism of diamond, incident angle of 45° for IR spectrum analysis to obtain the IR spectrum C (see FIG. 8) as similar to Example 1-1.

Although the peak Pa1 (1770 $cm^{-1}$) has a sufficient peak area, the peak area of the peak Pa1 changed little even if an application time is varied, and the peak Pb1 (2850 $cm^{-1}$) attributed to the protective agent had a too small area. The peak area for the peak Pb1 (2850 $cm^{-1}$) was computed to obtain the evaluation index "Sb/Sa," which indicates an application amount of the protective agent. Although the "Sb/Sa" increases as the application time increases, the increase amount of the "Sb/Sa" was too small. Further, an error of Sb/Sa was checked using five samples of the photoconductor (1-5) applied with the protective agent for 360 minutes, wherein the five samples were adjacent each other in a circumferential direction. When the Sb/Sa was computed with the five samples, the Sb/Sa had an error of 35%.

EXAMPLE 1-6

Change of Incident Angle

After applying the protective agent in Example 1-3, another samples of the photoconductors (3-1) to (3-5) were analyzed by FT-IR Avatar370 (manufactured by Thermo Electron Corporation, Seagull) under a condition of one time reflection, ATR prism of Ge, incident angle of 85° for IR spectrum analysis to obtain the IR spectrum C (see FIG. 8). In Example 1-6,the peak area of peak Pb1 and the peak Pa1 was checked. Although the peak area of the peak Pb1 (2850 $cm^{-1}$) attributed to the protective agent increases as the application time increases, the increase amount of the peak area of the peak Pb1 was too small. The peak area of peak Pa1 (1770 $cm^{-1}$) had a too small area. The evaluation index "Sb/Sa," which indicates an application amount of the protective agent, increases as the application time increases, but the increase amount of the "Sb/Sa" was too small. Further, an error of Sb/Sa was checked using five samples of the photoconductor (3-5) applied with the protective agent for 360 minutes, wherein the five samples were adjacent each other in a circumferential direction. When the Sb/Sa was computed with the five samples, the Sb/Sa had an error of 32%.

EXAMPLE 1-7

Change of Incident Angle

After applying the protective agent in Example 1-1, another samples of the photoconductors (1-1) to (1-5) were analyzed by FT-IR Avatar370 (manufactured by Thermo Electron Corporation, GATR) under a condition of one time reflection, ATR prism of Ge, incident angle of 30° for IR spectrum analysis to obtain the IR spectrum C (see FIG. 8). A fixing screw, an accessory of the GATR, was used to fix a sample for measurement by rotating the fixing screw. The fixing screw was rotated for ½ rotation from a point when the peak was started to be detected, and fixed at such ½ rotation position to sufficiently hold the sample against the ATR prism to conduct measurement of IR spectrum of the sample. As similar to Example 1-1, the peak Pa1 (1770 $cm^{-1}$) and the peak Pb1 (2850 $cm^{-1}$) were clearly detected. The evaluation index "Sb/Sa," which indicates an application amount of the protective agent, increases as the application time increases, but the increase amount of the "Sb/Sa" was small. Further, an error of Sb/Sa was checked using five samples of the photoconductor (1-5) applied with the protective agent for 360 minutes, wherein the five samples were adjacent each other in a circumferential direction. When the Sb/Sa was computed with the five samples, the Sb/Sa had an error of 25%.

Agent Bar No. 12

FT115 (synthesize wax manufactured by Nippon Seiro Co.,Ltd.) of 60 weight part and trisorbitan stearate (HLB: 1.5) of 25 weight part, and normal paraffin (average molecular weight 640) of 15 weight part were placed in a glass vessel having a cap, and were agitated and melted at a temperature of 180 degrees Celcius using a hot stirrer. Then, the melted protective agent was poured in an internal space of an aluminum metal mold, having a size of 12 mm×8 mm×350 mm, heated to 115 degrees Celcius in advance. After cooling to 90 degrees Celcius on a wooden table, the aluminum metal mold was cooled to 40 degrees Celcius on an aluminum table. Then, the solidified product was removed from the mold, and cooled to an ambient temperature while placing a weight on the product for preventing a warping. After that, an agent bar No. 12 having a size of 7 mm×8 mm×310 mm was prepared by cutting some portion of the product. The agent bar No. 12 was attached with a double face tape and fixed to a metal supporter.

EXAMPLES 1-8 TO 1-12

Protective layer setting units were evaluated using a peak area ratio or evaluation index "Sb/Sa" using the peak Pb1

(2850 $cm^{-1}$) having the peak area Sb and the peak Pa1 (1770 $cm^{-1}$) having the Sa by setting a threshold value for the evaluation index "Sb/Sa." Specifically, the protective layer setting unit was evaluated as "acceptable" when the Sb/Sa at the 10-minute application time of the protective agent was 0.03 or more, and when the Sb/Sa at the 360-minute application time of the protective agent was 0.90 or less. Examples 1-8 to 1-12 were evaluated as below.

EXAMPLE 1-8

Protective Layer Setting Unit (11)

The photoconductors (8-1) and (8-2) were applied with the protective agent by changing an application time (10, 360 minutes). Specifically, the photoconductors (8-1) and (8-2), a brush roller No. 2 (fiber having a thickness of 10 denier, fiber density of 50,000 fibers per square inch), and a urethane blade were assembled in a protective layer setting unit (see FIG. 7). The agent bar No. 11 was pressed against the brush with a spring force of 4.8 N to apply a protective agent to the photoconductor drum for 10 minutes and 360 minutes. The photoconductor drum and the brush roller rotated at a linear velocity of 125 mm/sec and 146 mm/sec, respectively. After applying the protective agent, samples of the photoconductors (8-1) to (8-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 1-1, the Sb/Sa was computed to obtain Sb/Sa=0.17 at the 10-minute application time, and Sb/Sa=0.36 at the 360-minute application time, by which the protective layer setting unit (11) was evaluated as "acceptable," which is indicated by a circle in FIG. 15.

EXAMPLE 1-9

Protective Layer Setting Unit (12)

The photoconductors (9-1) and (9-2), a brush roller No. 3 (fiber having a thickness of 20 denier, fiber density of 50,000 fibers per square inch), and a urethane blade were assembled in a protective layer setting unit (see FIG. 7). The agent bar No. 12 was pressed against the brush with a spring force of 4.8 N to apply a protective agent to the photoconductor drum for 10 minutes and 360 minutes. The photoconductor drum and the brush roller rotated at a linear velocity of 125 mm/sec and 146 mm/sec, respectively. After applying the protective agent, samples of the photoconductors (9-1) and (9-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 1-1, the Sb/Sa was computed to obtain Sb/Sa=0.06 at the 10-minute application time, and Sb/Sa=0.82 at the 360-minute application time, by which the protective layer setting unit (12) was evaluated as "acceptable," which is indicated by a circle in FIG. 15.

EXAMPLE 1-10

Protective Layer Setting Unit (13)

The photoconductors (10-1) and (10-2), a brush roller No. 1 (fiber having a thickness of 10 denier, fiber density of 30,000 fibers per square inch), and a urethane blade were assembled in a protective layer setting unit (see FIG. 7). The agent bar No. 12 was pressed against the brush with a spring force of 2 N to apply a protective agent to the photoconductor drum for 10 minutes and 360 minutes. The photoconductor drum and the brush roller rotated at a linear velocity of 125 mm/sec and 146 mm/sec, respectively. After applying the protective agent, samples of the photoconductors (10-1) and (10-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 1-1, the Sb/Sa was computed to obtain Sb/Sa=0.02 at the 10-minute application time, and Sb/Sa=0.23 at the 360-minute application time, by which the protective layer setting unit (13) was evaluated as "not acceptable," which is indicated by a cross in FIG. 15.

EXAMPLE 1-11

Protective Layer Setting Unit (14)

The photoconductors (11-1) and (11-2), a brush roller No. 3 (fiber having a thickness of 20 denier, fiber density of 50,000 fibers per square inch), and a urethane blade were assembled in a protective layer setting unit (see FIG. 7). The agent bar No. 11 was pressed against the brush with a spring force of 2 N to apply a protective agent to the photoconductor drum for 10 minutes and 360 minutes. The photoconductor drum and the brush roller rotated at a linear velocity of 125 mm/sec and 146 mm/sec, respectively. After applying the protective agent, samples of the photoconductors (11-1) and (11-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 1-1, the Sb/Sa was computed to obtain Sb/Sa=0.02 at the 10-minute application time, and Sb/Sa=0.43 at the 360-minute application time, by which the protective layer setting unit (14) was evaluated as "not acceptable," which is indicated by a cross in FIG. 15.

EXAMPLE 1-12

Protective Layer Setting Unit (15)

The photoconductors (12-1) and (12-2), a brush roller No. 3 (fiber having a thickness of 20 denier, fiber density of 50,000 fibers per square inch), and a urethane blade were assembled in a protective layer setting unit (see FIG. 7). The agent bar No. 12 was pressed against the brush with a spring force of 4.8 N to apply a protective agent to the photoconductor drum for 10 minutes and 360 minutes. The photoconductor drum and the brush roller rotated at a linear velocity of 125 mm/sec and 146 mm/sec, respectively. After applying the protective agent, samples of the photoconductors (12-1) and (12-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 1-1, the Sb/Sa was computed to obtain Sb/Sa=0.12 at the 10-minute application time, and Sb/Sa=1.1 at the 360-minute application time, by which the protective layer setting unit (15) was evaluated as "not acceptable," which is indicated by a cross in FIG. 15.

EXAMPLES 1-13 TO 1-17

Protective layer setting units were evaluated using a peak area ratio or evaluation index "Sb/Sa" using the peak Pb2

(2920 $cm^{-1}$) having the peak area Sb and the peak Pa2 (3040 $cm^{-1}$) having the Sa by setting a threshold value for the evaluation index "Sb/Sa." Specifically, the protective layer setting unit was evaluated as "acceptable" when the Sb/Sa at the 10-minute application time of the protective agent was 6.5 or more, and when the Sb/Sa at the 360-minute application time of the protective agent was 44.0 or less. Examples 1-13 to 1-17 were evaluated as below.

EXAMPLE 1-13

Protective Layer Setting Unit (11)

As for the IR spectrum obtained in Example 1-8, the Sb/Sa was computed using the peak Pb2 (2920 $cm^{-1}$) having the peak area Sb and the peak Pa2 (3040 $cm^{-1}$) having the peak area Sa. The Sb/Sa was computed to obtain Sb/Sa=12.1 at the 10-minute application time, and Sb/Sa=22.8 at the 360-minute application time, by which the protective layer setting unit (11) was evaluated as "acceptable," which is indicated by a circle in FIG. 15.

EXAMPLE 1-14

Of Protective Layer Setting Unit (12)

As for the IR spectrum obtained in Example 1-9, the Sb/Sa was computed using the peak Pb2 (2920 $cm^{-1}$) having the peak area Sb and the peak Pa2 (3040 $cm^{-1}$) having the peak area Sa. The Sb/Sa was computed to obtain Sb/Sa=8.0 at the 10-minute application time, and Sb/Sa=43.3 at the 360-minute application time, by which the protective layer setting unit (12) was evaluated as "acceptable," which is indicated by a circle in FIG. 15.

EXAMPLE 1-15

Protective Layer Setting Unit (13)

As for the IR spectrum obtained in Example 1-10, the Sb/Sa was computed using the peak Pb2 (2920 $cm^{-1}$) having the peak area Sb and the peak Pa2 (3040 $cm^{-1}$) having the peak area Sa. The Sb/Sa was computed to obtain Sb/Sa=6.0 at the 10-minute application time, and Sb/Sa=18.7 at the 360-minute application time, by which the protective layer setting unit (13) was evaluated as "not acceptable," which is indicated by a cross in FIG. 15.

EXAMPLE 1-16

Protective Layer Setting Unit (14)

As for the IR spectrum obtained in Example 1-11, the Sb/Sa was computed using the peak Pb2 (2920 $cm^{-1}$) having the peak area Sb and the peak Pa2 (3040 $cm^{-1}$) having the peak area Sa. The Sb/Sa was computed to obtain Sb/Sa=5.8 at the 10-minute application time, and Sb/Sa=27.6 at the 360-minute application time, by which the protective layer setting unit (14) was evaluated as "not acceptable," which is indicated by a cross in FIG. 15.

EXAMPLE 1-17

Protective Layer Setting Unit (15)

As for the IR spectrum obtained in Example 1-12, the Sb/Sa was computed using the peak Pb2 (2920 $cm^{-1}$) having the peak area Sb and the peak Pa2 (3040 $cm^{-1}$) having the peak area Sa. The Sb/Sa was computed to obtain Sb/Sa=10.3 at the 10-minute application time, and Sb/Sa=73.2 at the 360-minute application time, by which the protective layer setting unit (15) was evaluated as "not acceptable," which is indicated by a cross in FIG. 15.

EXAMPLE 1-18

When evaluating performance of an image forming apparatus, the photoconductors (8-2) and (9-2) were respectively assembled to black and cyan image forming units of IPSIO CX400, a tandem type color image forming apparatus produced by Ricoh Company, Ltd. The photoconductor (8-2) was used for Example 1-8 and the photoconductor (9-2) was used for Example 1-9. A charge roller was pressed to the photoconductor (8-2) using an agent biasing spring of the protective layer setting unit (11), and a charge roller was pressed to the photoconductor (9-2) using an agent biasing spring of the protective layer setting unit (12). The black photoconductor unit (or black unit) was used under a condition of the protective layer setting unit (11) having brush roller No. 2 and urethane blade. The cyan photoconductor unit (or cyan unit) was used under a condition of the protective layer setting unit (15) having brush roller No. 3 and urethane blade. The charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller. The photoconductors (8-2) and (9-2) were supplied with the protective agent using the protective layer setting units (11) and (15), respectively.

FIG. 11 illustrates evaluation image patterns used for the experiment. As shown in FIG. 12, striped halftone images of each colors of black, cyan, magenta, and yellow are formed side by side. When evaluating performance of an image forming apparatus used for the experiment, such evaluation image pattern was used as a test image, and the image forming apparatus was operated to copy such test image on a greater number of sheets. The copied image quality was checked based on image evaluation criteria. When the black unit and the cyan unit were operated to produce one-by-one halftone image of A4 size shown in FIG. 12 for five sheets to evaluate image quality, it was evaluated that the black unit and the cyan unit produced higher quality image, as indicated by a circle in FIG. 16. Further, the black unit and the cyan unit were operated to produce one-by-one halftone image of A4 size shown in FIG. 12 for 70,000 sheets to evaluate image quality, in which five sheets were printed as one set until 70,000 sheets were printed. In this case, the black unit produced higher quality image (as indicated by a circle in FIG. 16). but the cyan unit produced images having a white streak (as indicated by a cross in FIG. 16).

With the results obtained by above described experiment, a protective layer setting unit can be evaluated as "acceptable" or "not acceptable" by setting threshold values as described with Examples 1-8 to 1-12 and Examples 1-13 to 1-17.

FIGS. 14 to 17 show conditions for protective agent bars, protective layer setting units, ATR analysis, and results of ATR analysis and image evaluation for Examples 1-1 to 1-18.

A description is given to experiment and its results in detail using a process cartridge prepared according to an exemplary embodiment. It should be noted that following Example 2 used in the experiment are just exemplary, and other configuration can be devised.

FIG. 7 illustrates a schematic configuration of the protective layer setting unit 2 used in the experiment, in which the blade of the protective layer setting unit contacts the photoconductor surface in a counter direction. The photoconductor drum used in the experiment was manufactured as below.

Photoconductor Drum

An aluminum drum (conductive supporter) having a diameter of 30 mm was coated with an under layer, a charge generation layer, a charge transport layer, and a surface layer in this order, and dried to form the photoconductor drum having an under layer of 3.6 μm thickness, a charge generation layer of about 0.14 μm thickness, a charge transport layer of 23 μm thickness, and a surface layer of about 3.5 μm thickness. The surface layer was coated using a spray method, and other layers were coated using a dipping method. The surface layer includes following materials.

(Surface Layer)

Z-type polycarbonate: 10 parts triphenylamine compound (see structural formula 1): 7 parts fine alumina particles (particle diameter of 0.3 μm): 5 parts tetrahydrofuran: 400 parts cyclohexanone: 150 parts (structural formula 1)

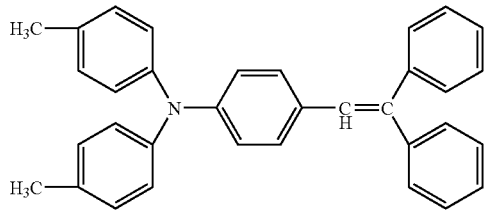

Agent bar No. 21

FT115 (synthesize wax manufactured by Nippon Seiro Co.,Ltd.) of 85 weight part, TOPAS-TM (manufactured by manufactured by Ticona) of 10 weight part, and trisorbitan stearate (HLB: 1.5) of 5 weight part were placed in a glass vessel having a cap, and were agitated and melted at a temperature of 160-250 degrees Celcius using a hot stirrer. Then, the melted protective agent was poured in an internal space of an aluminum metal mold, having a size of 12 mm×8 mm×350 mm, heated to 115 degrees Celcius in advance. After cooling to 88 degrees Celcius on a wooden table, the aluminum metal mold was cooled to 40 degrees Celcius on an aluminum table. Then, the solidified product was removed from the mold, and then cooled to an ambient temperature while placing a weight on the product for preventing warping. After that, an agent bar No. 21 having a size of 7 mm×8 mm×310 mm was prepared by cutting some portion of the product. The agent bar No. 21 was attached with a double face tape and fixed to a metal supporter.

Samples of the photoconductor and the agent bar No. 21 were analyzed by FT-IR Avatar370 (manufactured by Thermo Electron Corporation, Thunder Dome) under a condition of one time reflection, ATR prism of Ge, incident angle of 45° for IR spectrum analysis to obtain spectrum (or absorbance spectrum), which was similar to the IR spectrum A and B shown in FIG. 8. In the IR spectrum A of the photoconductor, the peak Pa1 attributed to polycarbonate bond is observed at 1770 $cm^{-1}$. In the IR spectrum B of the agent bar No. 21, the peak Pb1 (2850 $cm^{-1}$) and the peak Pb2 (2920 $cm^{-1}$) attributed to methylene group are observed. When the photoconductor was measured by the ATR, a measurement sample having 1 cm×1 cm size was cut from an aluminum base of the photoconductor.

EXAMPLE 2-1

Protective Layer Setting Unit (21)

The photoconductors (1-1) and (1-2), a brush roller No. 2 (fiber having a thickness of 10 denier, fiber density of 50,000 fibers per square inch), and a urethane blade were assembled in a protective layer setting unit (see FIG. 7). The agent bar No. 21 was pressed against the brush with a spring force of 4 N to apply a protective agent to the photoconductor. The photoconductor and the brush roller rotated at a linear velocity of 125 mm/sec and 146 mm/sec, respectively. After applying the protective agent for 150 minutes to photoconductor (1-2) using the protective layer setting unit (21), a sample of the photoconductor was sliced using a ultramicrotome and TEM (transmission electron microscope) observation was conducted, and it was found that the layer thickness of protective agent was 50 nm to 85 nm based on TEM photo.

The photoconductors (1-1) and (1-2) were applied with the protective agent by changing an application time (5, 150 minutes), and samples of each the photoconductors were prepared after applying the protective agent. After applying the protective agent, samples of the photoconductors (1-1) and (1-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum (or absorbance spectrum), similar to the IR spectrum C shown in FIG. 8, when the application time was 150 minutes.

Based on the IR spectrum C, a peak area ratio between the the peak Pb1 (2850 $cm^{-1}$) having the peak area "Sb1" and the peak Pa1 (1770 $cm^{-1}$) having the peak area "Sa1" was evaluated as a peak area ratio or evaluation index "Sb1/Sa1." The peak Pb1 (2850 $cm^{-1}$) is a peak attributed to the agent bar No.21. Because a peak attributed to the photoconductor also exists around the peak Pb1 (2850 $cm^{-1}$) and overlaps with the peak Pb1, a differential spectrum D between the IR spectrum C (obtained after applying the protective agent to the photoconductor) and the IR spectrum A for photoconductor not applied with the protective agent is computed so that the peak area of the peak Pb1 (2850 $cm^{-1}$) attributed to the agent bar No. 21 is not effected by the peak area of the peak attributed to the photoconductor, and then the peak area ratio or evalution index "Sb1/Sa1" is computed. When computing the differential spectrum D (see FIG. 8), peak intensity was adjusted, such as increased or decreased, as required. For example, a given coefficient is multiplied to the absorbance of spectrum so as to set zero value for the peak area of the peak at 1770 $cm^{-1}$. The evaluation index "Sb1/Sa1," which indicates an application amount of the protective agent, increases as the application time increases. For example, the evaluation index "Sb1/Sa1" was 0.082 at the application time of 5 minutes, and the evaluation index "Sb1/Sa1" was 0.23 at the application time of 150 minutes.

FIG. 18 shows conditions of peak used for computing a peak area for each of peaks, in which start and end point of background for computing a peak area, and integration area of peak are included with wavenumber information.

EXAMPLE 2-2

Protective Layer Setting Unit (22)

The photoconductor drums (2-1) and (2-2), a brush roller No. 3 (fiber having a thickness of 20 denier, fiber density of 50,000 fibers per square inch), and a urethane blade were assembled in a protective layer setting unit (see FIG. 7). The agent bar No. 21 was pressed against the brush with a spring force of 4 N to apply a protective agent to the photoconductors for 5 minutes and 150 minutes, respectively. The photoconductor drum and the brush roller rotated at a linear velocity of 125 mm/sec and 146 mm/sec, respectively. After applying the protective agent, samples of the photoconductors (2-1) and (2-2) were analyzed by FT-IR Avatar370 (manufactured by Thermo Electron Corporation, Thunder Dome) under a condition of one time reflection, ATR prism of Ge, incident angle of 450 for IR spectrum analysis to obtain the IR spectrum C (see FIG. 8). As similar to Example 2-1, the Sb1/Sa1 was computed to obtain Sb1/Sa1=0.044 at the 5-minute application time, and Sb1/Sa1=0.45 at the 150-minute application time.

Agent bar No. 22

FT115 (synthesize wax manufactured by Nippon Seiro Co.,Ltd.) of 55 weight part, trisorbitan stearate (HLB: 1.5) of 20 weight part, and normal paraffin (average molecular weight 640) of 25 weight part were placed in a glass vessel having a cap, and were agitated and melted at a temperature of 180 degrees Celcius using a hot stirrer. Then, the melted protective agent was poured in an internal space of an aluminum metal mold, having a size of 12 mm×8 mm×350 mm, heated to 115 degrees Celcius in advance. After cooling to 90 degrees Celcius on a wooden table, the aluminum metal mold was cooled to 40 degrees Celcius on an aluminum table. Then, the solidified product was removed from the mold, and then cooled to an ambient temperature while placing a weight on the product for preventing warping. After that, an agent bar No. 21 having a size of 7 mm×8 mm×310 mm was prepared by cutting some portion of the product. The agent bar No. 22 was attached with a double face tape and fixed to a metal supporter.

COMPARATIVE EXAMPLE 2-1

Protective Layer Setting Unit (23)

The photoconductor drums (3-1) and (3-2), a brush roller No. 1 (fiber having a thickness of 10 denier, fiber density of 3,000 fibers per square inch), and a urethane blade were assembled in a protective layer setting unit (see FIG. 7). The agent bar No. 21 was pressed against the brush with a spring force of 1.8 N to apply a protective agent to the photoconductors for 5 minutes and 150 minutes, respectively. The photoconductor and the brush roller rotated at a linear velocity of 125 mm/sec and 146 mm/sec, respectively. After applying the protective agent, samples of the photoconductors (3-1) and (3-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 2-1, the Sb1/Sa1 was computed to obtain Sb1/Sa1=0.022 at the 5-minute application time, and Sb1/Sa1=0.13 at the 150-minute application time.

COMPARATIVE EXAMPLE 2-2

Protective Layer Setting Unit (24)

The photoconductor drums (4-1) and (4-2), a brush roller No. 3 (fiber having a thickness of 20 denier, fiber density of 50,000 fibers per square inch), and a urethane blade were assembled in a protective layer setting unit (see FIG. 7). The agent bar No. 22 was pressed against the brush with a spring force of 6 N to apply a protective agent to the photoconductors for 5 minutes and 150 minutes, respectively. The photoconductor and the brush roller rotated at a linear velocity of 125 mm/sec and 146 mm/sec, respectively. After applying the protective agent, samples of the photoconductors (4-1) and (4-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 2-1, the Sb1/Sa1 was computed to obtain Sb1/Sa1=0.14 at the 5-minute application time, and Sb1/Sa1=0.88 at the 150-minute application time.

COMPARATIVE EXAMPLE 2-3

Protective Layer Setting Unit (25)

The photoconductor drums (5-1) and (5-2), a brush roller No. 3 (fiber having a thickness of 20 denier, fiber density of 50,000 fibers per square inch), and a urethane blade were assembled in a protective layer setting unit (see FIG. 7). The agent bar No. 22 was pressed against the brush with a spring force of 3 N to apply a protective agent to the photoconductors for 5 minutes and 150 minutes, respectively. The photoconductor and the brush roller rotated at a linear velocity of 125 mm/sec and 146 mm/sec, respectively. After applying the protective agent, samples of the photoconductors (5-1) and (5-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 2-1, the Sb1/Sa1 was computed to obtain Sb1/Sa1=0.032 at the 5-minute application time, and Sb1/Sa1=0.32 at the 150-minute application time.

[Evaluation of Image Quality]

When evaluating performance of an image forming apparatus, IPSIO CX400, a tandem type color image forming apparatus produced by Ricoh Company, Ltd was used. As for a black process cartridge (1), a protective layer setting unit having a similar configuration of the protective layer setting unit (21), used in Example 2-1, was assembled, wherein the protective layer setting unit includes a protective agent bar, a brush, and a biasing spring. As for a cyan process cartridge (1), a protective layer setting unit having a similar configuration of the protective layer setting unit (23), used in Comparative Example 2-1, was assembled. As for a magenta process cartridge (1), a protective layer setting unit having a similar configuration of the protective layer setting unit (24), used in Comparative Example 2-2, was assembled. The process cartridges were installed in IPSIO CX400. A charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller. Each of the process cartridges was installed with a new photoconductor, which is similar to photoconductors used in Examples 2-1 to 2-3 and Comparative Examples 2-1 and 2-2.

When the black, cyan, and magenta process cartridges were operated to produce one-by-one halftone image of A4 size shown in FIG. 12 for five sheets to evaluate image quality, it was evaluated that the black, cyan, and magenta process cartridges produced higher quality image, as indicated by a circle in FIG. 21.

Further, the black, cyan, and magenta process cartridges were operated to produce one-by-one halftone image of A4 size shown in FIG. 12 for 60,000 sheets to evaluate image quality, in which five sheets were printed as one set until 60,000 sheets were printed. In this case, the black process cartridge produced higher quality image (as indicated by a circle in FIG. 21), but the cyan process cartridge produced images having a white streak and the magenta process cartridge produced images having a black streak, which are not preferable image quality (as indicated by a cross in FIG. 21).

Further, another evaluation of image quality was similarly conducted using the protective layer setting units used in Example 2-2 and Comparative Example 2-3 and process cartridges having such protective layer setting units. When evaluating performance of an image forming apparatus, IPSIO CX400, a tandem type color image forming apparatus produced by Ricoh Company, Ltd was used. As for a black process cartridge (2), a protective layer setting unit having a similar configuration of the protective layer setting unit (22), used in Example 2-2, was assembled, wherein the protective layer setting unit includes a protective agent bar, a brush, and a biasing spring. As for a cyan process cartridge (2), a protective layer setting unit having a similar configuration of the protective layer setting unit (25), used in Comparative Example 2-3, was assembled. The process cartridges were installed in IPSIO CX400. A charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller. Each of the process cartridges was installed with a new photoconductor, which is similar to photoconductors used in Examples 2-1 to 2-3 and Comparative Examples 2-1 and 2-2.

When the black, and cyan process cartridges were operated to produce one-by-one halftone image of A4 size shown in FIG. 12 for five sheets to evaluate image quality, it was evaluated that the black and cyan process cartridges produced higher quality image, as indicated by a circle in FIG. 21. Further, the black and cyan process cartridges were operated to produce one-by-one halftone image of A4 size shown in FIG. 12 for 60,000 sheets to evaluate image quality, in which five sheets were printed as one set until 60,000 sheets were printed. In this case, the black process cartridge produced higher quality image (as indicated by a circle in FIG. 21), but the cyan process cartridge produced images having a white streak, which is not preferable image quality (as indicated by a cross in FIG. 21).

FIGS. 19 to 22 show conditions for protective agent bars, protective layer setting units, ATR analysis, and results of ATR analysis and image evaluation for Examples 2 and Comparative Examples 2.

A description is now given to experiment and its results in detail using a process cartridge prepared according to an exemplary embodiment. It should be noted that following Example 3 used in the experiment are just exemplary, and other configuration can be devised.

FIG. 7 illustrates a schematic configuration of the protective layer setting unit 2 used in the experiment. The photoconductor drum used in the experiment was manufactured as below.

Photoconductor Drum

An aluminum drum (conductive supporter) having a diameter of 30 mm was coated with an under layer, a charge generation layer, a charge transport layer, and a surface layer in this order, and dried to form the photoconductor drum having an under layer of 3.6 μm thickness, a charge generation layer of about 0.14 μm thickness, a charge transport layer of 23 μm thickness, and a surface layer of about 3.5 μm thickness. The surface layer was coated using a spray method, and other layers were coated using a dipping method. The surface layer includes following material.

(Surface Layer)

Z-type polycarbonate: 10 parts triphenylamine compound (the aforementioned structural formula 1): 7 parts fine alumina particles (particle diameter of 0.3 μm): 5 parts tetrahydrofuran: 400 parts cyclohexanone: 150 parts Agent bar No. 31

FT115 (synthesize wax manufactured by Nippon Seiro Co.,Ltd.) of 90 weight part, TOPAS-TM (manufactured by manufactured by Ticona) of 5 weight part, and trisorbitan stearate (HLB: 1.5) of 5 weight part were placed in a glass vessel having a cap, and were agitated and melted at a temperature of 160-250 degrees Celcius using a hot stirrer. Then, the melted protective agent was poured in an internal space of an aluminum metal mold, having a size of 12 mm×8 mm×350 mm, heated to 115 degrees Celcius in advance. After cooling to 88 degrees Celcius on a wooden table, the aluminum metal mold was cooled to 40 degrees Celcius on an aluminum table. Then, the solidified product was removed from the mold, and then cooled to an ambient temperature while placing a weight on the product for preventing warping. After that, a protective agent bar No. 31 having a size of 7 mm×8 mm×310 mm was prepared by cutting some portion of the product. The protective agent bar No. 31 was attached with a double face tape and fixed to a metal supporter.

Samples of the photoconductor and the agent bar No. 31 were analyzed by FT-IR Avatar370 (manufactured by Thermo Electron Corporation, Thunder Dome) under a condition of one time reflection, ATR prism of Ge, incident angle of 45° for IR spectrum analysis to obtain spectrum (or absorbance spectrum), which was similar to the IR spectrum A and B shown in FIG. 8. In the IR spectrum A of the photoconductor, the peak Pa2 attributed to phenyl group is observed at 3040 $cm^{-1}$. In the IR spectrum B of the agent bar No. 31, the peak Pb1 (2850 $cm^{-1}$) and peak Pb2 (2920 $cm^{-1}$) attributed to methylene group are observed. When the photoconductor was measured by the ATR, a measurement sample having 1 cm×1 cm size was cut from an aluminum base of the photoconductor.

EXAMPLE 3-1

Protective Layer Setting Unit (31)

The photoconductor drums (1-1) and (1-2), a brush roller No. 2 (fiber having a thickness of 10 denier, fiber density of 50,000 fibers per square inch), and a urethane blade were assembled in a protective layer setting unit (see FIG. 7). The protective agent bar No. 31 was pressed against the brush with a spring force of 4.8 N to apply a protective agent to the photoconductors. The photoconductor drum and the brush roller rotated at a linear velocity of 125 mm/sec and 146 mm/sec, respectively. After applying the protective agent for 120 minutes to photoconductor (1-2) using the protective layer setting unit (31), a sample of the photoconductor was sliced using a ultramicrotome and TEM (transmission electron microscope) observation was conducted, and it was found that the layer thickness of protective agent was 25 nm to 70 nm based on TEM photo.

The photoconductors (1-1) and (1-2) were applied with the protective agent by changing an application time (5, 120 minutes), and samples of each the photoconductors were prepared after applying the protective agent. After applying the protective agent, samples of the photoconductors (1-1) and (1-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum (or absorbance spectrum), similar to the IR spectrum C shown in FIG. 8, when the application time was 120 minutes. Based on the IR spectrum C, a peak area ratio between the the peak Pb2 (2920 $cm^{-1}$) having the peak area "Sb2" and the peak Pa2 (3040 $cm^{-1}$) having the peak area "Sa2" was evaluated as a peak area ratio or evaluation index "Sb2/Sa2." The peak Pb2 (2920 $cm^{-1}$) is a peak attributed to the agent bar No. 31. Although a peak attributed to the photoconductor also exists around the peak Pb2 (2920 $cm^{-1}$) and overlaps with the peak Pb2, the peak Pb2 (2920 $cm^{-1}$) has a peak area sufficiently greater than the peak area of the peak attributed to the photoconductor. Accordingly, a step of computing a differential spectrum of the IR spectrum C after applying the protective agent to the photoconductor and the IR spectrum A for the photoconductor not applied with the protective agent was omitted. The evaluation index "Sb2/Sa2," which indicates an application amount of the protective agent was 9.8 at the application time of 15 minutes, and the evaluation index "Sb2/Sa2" was 13.5 at the application time of 120 minutes. FIG. 23 shows conditions of peak used for computing a peak area for each of peaks, in which start and end point of background for computing a peak area, and integration area of peak are included with wavenumber information.

EXAMPLE 3-2

Protective Layer Setting Unit (32)

The photoconductor drums (2-1) and (2-2), a brush roller No. 3 (fiber having a thickness of 20 denier, fiber density of 50,000 fibers per square inch), and a urethane blade were assembled in a protective layer setting unit (see FIG. 7). The agent bar No. 11 was pressed against the brush with a spring force of 4.8 N to apply a protective agent to the photoconductors for 15 minutes and 120 minutes. The photoconductor and the brush roller rotated at a linear velocity of 125 mm/sec and 146 mm/sec, respectively. After applying the protective agent, samples of the photoconductors (2-1) and (2-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 3-1, the Sb2/Sa2 was computed to obtain Sb/Sa=8.0 at the 15-minute application time, and Sb2/Sa2=18.6 at the 120-minute application time.

Agent Bar No. 32

FT115 (synthesize wax manufactured by Nippon Seiro Co.,Ltd.) of 55 weight part and trisorbitan stearate (HLB: 1.5) of 25 weight part, and normal paraffin (average molecular weight 640) of 20 weight part were placed in a glass vessel having a cap, and were agitated and melted at a temperature of 180 degrees Celcius using a hot stirrer. Then, the melted protective agent was poured in an internal space of an aluminum metal mold, having a size of 12 mm×8 mm×350 mm, heated to 115 degrees Celcius in advance. After cooling to 90 degrees Celcius on a wooden table, the aluminum metal mold was cooled to 40 degrees Celcius on an aluminum table. Then, the solidified product was removed from the mold, and cooled to an ambient temperature while placing a weight on the product for preventing a warping. After that, an agent bar No. 12 having a size of 7 mm×8 mm×310 mm was prepared by cutting some portion of the product. The protective agent bar No. 32 was attached with a double face tape and fixed to a metal supporter.

COMPARATIVE EXAMPLE 3-1

Protective Layer Setting Unit (33)

The photoconductor drums (3-1) and (3-2), a brush roller No. 1 (fiber having a thickness of 10 denier, fiber density of 30,000 fibers per square inch), and a urethane blade were assembled in a protective layer setting unit (see FIG. 7). The agent bar No. 31 was pressed against the brush with a spring force of 2 N to apply a protective agent to the photoconductors for 15 minutes and 120 minutes. The photoconductor and the brush roller rotated at a linear velocity of 125 mm/sec and 146 mm/sec, respectively. After applying the protective agent, samples of the photoconductors (3-1) and (3-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 3-1, the Sb2/Sa2 was computed to obtain Sb/Sa=6.3 at the 15-minute application time, and Sb2/Sa2=8.1 at the 120-minute application time.

COMPARATIVE EXAMPLE 3-2

Protective Layer Setting Unit (34)

The photoconductor drums (4-1) and (4-2), a brush roller No. 3 (fiber having a thickness of 20 denier, fiber density of 50,000 fibers per square inch), and a urethane blade were assembled in a protective layer setting unit (see FIG. 7). The agent bar No. 32 was pressed against the brush with a spring force of 6 N to apply a protective agent to the photoconductors for 15 minutes and 120 minutes. The photoconductor and the brush roller rotated at a linear velocity of 125 mm/sec and 146 mm/sec, respectively. After applying the protective agent, samples of the photoconductors (4-1) and (4-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 3-1, the Sb2/Sa2 was computed to obtain Sb/Sa=13.2 at the 15-minute application time, and Sb2/Sa2=38.9 at the 120-minute application time.

COMPARATIVE EXAMPLE 3-3

Protective Layer Setting Unit (35)

The photoconductor drums (5-1) and (5-2), a brush roller No. 3 (fiber having a thickness of 20 denier, fiber density of 50,000 fibers per square inch), and a urethane blade were assembled in a protective layer setting unit (see FIG. 7). The protective agent bar No. 32 was pressed against the brush with a spring force of 3 N to apply a protective agent to the photoconductors for 15 minutes and 120 minutes. The photoconductor drum and the brush roller rotated at a linear velocity of 125 mm/sec and 146 mm/sec, respectively. After applying the protective agent, samples of the photoconductors (5-1) and (5-2) were analyzed by FT-IR Avatar370 (manufactured by Thermo Electron Corporation, Thunder Dome) under a condition of one time reflection, ATR prism of Ge, incident angle of 45° for IR spectrum analysis to obtain the IR spectrum C (see FIG. 8). As similar to Example 3-1, the Sb2/Sa2 was computed to obtain Sb/Sa=9.4 at the 15-minute application time, and Sb2/Sa2=25.5 at the 120-minute application time.

[Evaluation of Image Quality]

When evaluating performance of an image forming apparatus, IPSIO CX400, a tandem type color image forming apparatus produced by Ricoh Company, Ltd was used. As for a black process cartridge (1), a protective layer setting unit having a similar configuration of the protective layer setting unit (31), used in Example 3-1, was assembled, wherein the protective layer setting unit includes a protective agent bar, a brush, and a biasing spring. As for a cyan process cartridge (1), a protective layer setting unit having a similar configuration of the protective layer setting unit (33), used in Comparative Example 3-1, was assembled. As for a magenta process cartridge (1), a protective layer setting unit having a similar configuration of the protective layer setting unit (34), used in Comparative Example 3-2, was assembled. The process cartridges were installed in IPSIO CX400. A charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller. Each of the process cartridges was installed with a new photoconductor, which is similar to photoconductors used in Examples 3-1 to 3-2 and Comparative Examples 3-1 and 3-3.

When the black, cyan, and magenta process cartridges were operated to produce one-by-one halftone image of A4 size shown in FIG. 12 for five sheets to evaluate image quality, it was evaluated that the black, cyan, and magenta process cartridges produced higher quality image, as indicated by a circle in FIG. 26. Further, the black, cyan, and magenta process cartridges were operated to produce one-by-one halftone image of A4 size shown in FIG. 12 for 50,000 sheets to evaluate image quality, in which five sheets were printed as one set until 50,000 sheets were printed. In this case, the black process cartridge produced higher quality image (as indicated by a circle in FIG. 26), but the cyan process cartridge produced images having a white streak and the magenta process cartridge produced images having a black streak, which are not preferable image quality (as indicated by a cross in FIG. 26).

Further, another evaluation of image quality was similarly conducted using the protective layer setting units used in Example 3-2 and Comparative Example 3-3 and process cartridges having such protective layer setting units. When evaluating performance of an image forming apparatus, IPSIO CX400, a tandem type color image forming apparatus produced by Ricoh Company, Ltd was used. As for a black process cartridge (2), a protective layer setting unit having a similar configuration of the protective layer setting unit (32), used in Example 3-2, was assembled, wherein the protective layer setting unit includes a protective agent bar, a brush, and a biasing spring. As for a cyan process cartridge (2), a protective layer setting unit having a similar configuration of the protective layer setting unit (35), used in Comparative Example 3-3, was assembled. The process cartridges were installed in IPSIO CX400. A charge roller was disposed above the photoconductor drum, the photoconductor drum rotated at a linear velocity of 125 mm/sec, a superimposed voltage having a direct-current voltage of −600 V and an alternating-current voltage having a frequency 1450 Hz and an amplitude of 1100 V was applied between the photoconductor drum and the charge roller. Each of the process cartridges was installed with a new photoconductor, which is similar to photoconductors used in Examples 3-1 to 3-2 and Comparative Examples 3-1 and 3-3.

When the black, and cyan process cartridges were operated to produce one-by-one halftone image of A4 size shown in FIG. 12 for five sheets to evaluate image quality, it was evaluated that the black and cyan process cartridges produced higher quality image, as indicated by a circle in FIG. 26.

Further, the black and cyan process cartridges were operated to produce one-by-one halftone image of A4 size shown in FIG. 12 for 50,000 sheets to evaluate image quality, in which five sheets were printed as one set until 50,000 sheets were printed.

In this case, the black process cartridge produced higher quality image (as indicated by a circle in FIG. 26), but the cyan process cartridge produced images having a white streak, which is not preferable image quality (as indicated by a cross in FIG. 26).

FIGS. 24 to 27 show conditions for protective agent bars, protective layer setting units, ATR analysis, and results of ATR analysis and image evaluation for Examples 3 and Comparative Examples 3.

As above described in exemplary embodiments, an amount of protective agent applied on an image carrying member, such as photoconductor, can be reliably evaluated with the aforementioned method even if the protective agent does not include metal component, wherein such protective agent may include paraffin, for example. With such evaluation method, an application amount of the protective agent can be reliably evaluated, by which a protective layer setting unit that can reduce an occurrence of abnormal image can be provided. Further, such protective layer setting unit can be preferably employed for a process cartridge and an image forming apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A protective agent application unit for applying a protective agent on a surface of an image carrying member, an amount of the protective agent applied on the surface of an image carrying member is evaluated by an attenuated total reflection (ATR) using infrared (IR) absorption spectrum, and using an ATR prism of germanium (Ge) and an incident angle of infrared light of 45° as a measurement condition, wherein an IR spectrum A is an IR spectrum of a surface of the image carrying member before applying the protective agent, an IR spectrum B is as an IR spectrum of the protective agent alone, and an IR spectrum C is an IR spectrum of the surface of the image carrying member after applying the protective agent, wherein a peak Pa1 at a wavenumber of 1770 $cm^{-1}$ in the IR spectrum A is not substantially observed in the IR spectrum B, the peak Pa1 having a peak area Sa1 in the IR spectrum C being detected, a peak Pb1 at a wavenumber 2850 $cm^{-1}$ in the IR spectrum B is not substantially observed in the IR spectrum A, the peak Pb1 having a peak area Sb1 in the IR spectrum C being detected, and an application amount of the protective agent to the image carrying member being evaluated using a peak area ratio of Sb1/Sa1, detected in the IR spectrum C, the protective agent application unit comprising:

an applying device that applies the protective agent, wherein the value of Sb1/Sa1 becomes 0.02 or more after applying the protective agent to the image carrying member for 5 minutes, and the value of Sb1/Sa1 becomes 0.85 or less after applying the protective agent to the image carrying member for 150 minutes, wherein the protective agent has paraffin as a main component, and wherein the protective agent includes the paraffin for 50 to 95 weight percent in the protective agent.

2. The protective agent application unit according to claim 1, wherein the protective agent having the paraffin as a main component is shaped in a protective agent bar, the applying device includes:

a brush roller having a metal core and a number of fibers formed on the metal core by an electrostatic implantation method with a fiber density of 50,000 to 600,000 fibers per square inch, each of the fibers having a diameter of from 28 μm to 42 μm, the protective agent bar being pressed against the fibers to scrape the protective agent, and the fibers being pressed against the image carrying member to apply the protective agent to the image carrying member; and a blade configured being pressed against the image carrying member to form a uniform layer of the protective agent on the image carrying member.

3. An image forming apparatus, comprising:

an image carrying member;

a charge device configured to charge the image carrying member; and the protective agent application unit of claim 1.

4. The image forming apparatus according to claim 3, wherein the image carrying member is a photoconductor.

5. The image forming apparatus according to claim 3, wherein the protective agent application unit is assembled with the image carrying member as a process cartridge.

6. The image forming apparatus according to claim 5, wherein the process cartridge further includes the charge device.

7. The image forming apparatus according to claim 3, wherein the charge device charges the image carrying member by an AC charging method using a direct current voltage superimposed with an alternating current voltage.

* * * * *